US009113257B2

(12) United States Patent
Collins

(10) Patent No.: US 9,113,257 B2
(45) Date of Patent: Aug. 18, 2015

(54) PHASE-UNIFIED LOUDSPEAKERS: PARALLEL CROSSOVERS

(71) Applicant: William E. Collins, Swansea, IL (US)

(72) Inventor: William E. Collins, Swansea, IL (US)

( * ) Notice: Subject to any disclaimer, the term of this patent is extended or adjusted under 35 U.S.C. 154(b) by 339 days.

(21) Appl. No.: 13/756,929

(22) Filed: Feb. 1, 2013

(65) Prior Publication Data

US 2014/0219480 A1 Aug. 7, 2014

(51) Int. Cl.
*H04R 5/04* (2006.01)
*H04R 3/14* (2006.01)

(52) U.S. Cl.
CPC ..... *H04R 3/14* (2013.01)

(58) Field of Classification Search
CPC ..... H04R 5/033; H04R 5/0335; H04R 5/00; H04R 5/04; H04R 3/12; H04R 3/14; H04R 3/00; H04R 3/04; H04R 3/06; H04R 3/08; H04R 2203/12; H04R 25/407; H04R 2205/022; H04R 2205/024; H04R 2205/026; H04R 2205/041; H04R 1/20
USPC ..... 381/1, 300, 74, 111, 116, 117, 98, 99
See application file for complete search history.

(56) References Cited

U.S. PATENT DOCUMENTS

| | | | | |
|---|---|---|---|---|
| 3,457,370 | A | 7/1969 | Boner | |
| 3,814,857 | A * | 6/1974 | Thomasen | 381/99 |
| 4,031,321 | A | 6/1977 | Bakgaard | |
| 4,897,879 | A | 1/1990 | Geluk | |
| 5,937,072 | A | 8/1999 | Combest | |
| 6,381,334 | B1 | 4/2002 | Alexander | |
| 6,633,648 | B1 * | 10/2003 | Bauck | 381/303 |
| 8,577,065 | B2 * | 11/2013 | Lau | 381/310 |
| 2009/0185694 | A1 | 7/2009 | Sumitani et al. | |
| 2012/0155652 | A1 * | 6/2012 | Vickers | 381/17 |

FOREIGN PATENT DOCUMENTS

SU 510171 A3 4/1976

OTHER PUBLICATIONS

International Search Report and Written Opinion of International Searching Authority in PCT/US2014/014199 Mechanical Translation of SU 510171 A3.

* cited by examiner

*Primary Examiner* — Ahmad F Matar
*Assistant Examiner* — Sabrina Diaz
(74) *Attorney, Agent, or Firm* — Grace J. Fishel

(57) ABSTRACT

Complimentary crossovers that reduce phase distortion in loudspeaker systems, typically pairs, are described. In the fundamental embodiment, each loudspeaker possesses two drivers, a woofer and a tweeter. The "effective third-order" crossover on the right-hand loudspeaker remains "symmetric," but the "effective third-order" crossover on the left-hand loudspeaker is rendered "asymmetric," as described. Other embodiments apply this principle to other crossover orders and/or greater numbers of drivers. This technology can be combined with other circuits like a Zobel, typically used for impedance correction. Some configurations of "phase-unified" loudspeakers require that a Zobel is applied to all drivers except the tweeter. Accordingly a rule combining effective crossover order and handedness is established.

25 Claims, 42 Drawing Sheets

Prior Art

PHASE-UNIFIED LOUDSPEAKERS: PARALLEL CROSSOVERS

Illustrative prior art crossover designs are disclosed in U.S. Pat. No. 3,457,370 to Boner, U.S. Pat. No. 4,031,321 to Bakgaard, U.S. Pat. No. 4,198,540 to Cizek, U.S. Pat. No. 4,897,879 to Geluk, U.S. Pat. No. 5,937,072 to Combest and U.S. Pat. No. 6,381,334 to Alexander. Additional background information is found in *High Performance Loudspeakers*, sixth ed., Martin Colloms, Wiley, 2005 and *Loudspeaker Design Handbook*, seventh ed., Vance Dickason, Amateur Audio Press, 2006.

BACKGROUND OF THE INVENTION

Previous approaches to loudspeaker design failed to consider the prospective interference effects between the two loudspeakers, one on the left and the other on the right, comprising stereo sound reproduction. These two combine to form a "loudspeaker system," which also includes, but is not limited to, a quadraphonic or stereo system. Since the output of these two loudspeakers combine to produce a stereo image, interference is likely; they operate in parallel. To demonstrate this concept simply, two-way loudspeakers will be used in the stereo loudspeaker system. In addition to the interference and phase effects between the woofer and tweeter in either loudspeaker for the right or left channels, interference and phase effects are possible between the right tweeter and the left woofer as well as between the left tweeter and the right woofer. These concepts can be extended to sound reproduction in more than two channels like quadraphonic reproduction or home theater. Although the discussion of phase and interference in loudspeaker design can seem abstruse, these effects are quite audible.

Loudspeakers capable of reproduction approximating the entire audio band have been developed using various crossover circuitry and configurations. To extend the frequency response and power handling of a loudspeaker, multiple drivers are employed with each driver predominating in a specific portion of the frequency spectrum. Thus a loudspeaker can have woofers, tweeters and midranges, with tweeters reproducing higher frequencies, woofers reproducing lower frequencies and midranges reproducing the frequencies in between. A woofer, midwoofer, midrange, upper midrange or tweeter is called a "driver". The typical two-way loudspeaker has a woofer or tweeter for drivers. Accordingly a 2.5-way loudspeaker is a modern design with a woofer, midwoofer and tweeter. Modern designs can use a midwoofer and a tweeter, but for the sake of simplicity, this will also be referred to as a woofer and a tweeter henceforward unless otherwise noted. A three-way loudspeaker has a woofer, midrange and tweeter. Each of the drivers is selected to perform best in a specific portion of the frequency spectrum, and a crossover circuit is applied to tailor driver response in this portion. The crossover network accomplishes this typically by attenuating driver response where undesired. The overwhelming majority of crossover networks connect the drivers in parallel and subsequent references to crossover networks refer to parallel circuits unless otherwise stated. The applicant will define the nouns "crossover network," "crossover circuit," or "crossover," as referring to the network apportioning the different frequency bands of the input signal to the different drivers for the entire loudspeaker. The noun "filter" refers to the smaller network apportioning the given frequency band of the input signal to a single driver in the entire loudspeaker.

The frequency at which an audio crossover network delivers signals to two drivers operating in adjacent frequency ranges is called the crossover frequency. A crossover attenuates the response of a driver at the crossover frequency at a rate called the crossover slope. Crossover slopes are calculated in dB of attenuation per octave, with steeper slopes displaying more attenuation. The steepness of a crossover's slope is primarily determined by the number of capacitors and inductors used. For instance, passive crossovers in two-way loudspeakers having crossover slopes of 6 dB/octave generally have one inductor L or capacitor C for each filter in the crossover. These filters together form a $1^{st}$ order electrical crossover. Crossover slopes of 12 dB/octave in two-way loudspeakers generally have one L and one C for each filter in the crossover, to total two inductors and two capacitors in the crossover. These two filters together form a $2^{nd}$ order electrical, or half-section, crossover network. Analogously $4^{th}$ order electrical crossover circuits are called full-section crossovers. These crossovers possess crossover slopes of 24 dB/octave and in two-way loudspeakers, generally have two inductors and two capacitors for each filter in the crossover, to total four inductors and four capacitors.

Loudspeaker drivers nonetheless reproduce waves and simultaneous reproduction from more than one driver at a given frequency produces interference effects. When two drivers of different size and shape are mounted on a conventional planar baffle, the depths of these drivers differ so that the fronts of these drivers' voice coils lie in different planes. For instance, a tweeter is typically smaller than a woofer and a tweeter cone is typically significantly shallower than a woofer cone. Accordingly when a tweeter and woofer reproduce the same frequency, the distances of the corresponding sound waves to the listener's ear differ, inducing interference. A crossover reduces these interference effects, but introduces its own interference effects. A crossover circuit between a woofer and a tweeter rolls the woofer response off at the crossover frequency, but gradually increases the tweeter response as the crossover frequency is approached. The woofer and tweeter responses at the crossover frequency are therefore out-of-phase to some extent. The crossed-over woofer and tweeter responses overlap substantially at some frequencies, where these responses are also out-of-phase to some extent.

Interference effects sound unpleasant. The original crossovers described in U.S. Pat. No. 3,457,370 to Boner were $2^{nd}$ order electrical and accordingly introduced anomalies in frequency response whether the drivers were connected in-phase or out-of-phase, a deficiency characteristic of even-order electrical crossovers. Many listeners feel out-of-phase $2^{nd}$ order electrical crossovers reproduce the human voice with a nasal quality. Accordingly he introduced impedance-correction networks into these crossovers.

Many other techniques have been proposed to improve the frequency response and phase behavior of loudspeakers. The interference effects between multiple drivers can be conveyed as a pair of drivers operating in-phase or out-of-phase. The more drivers there are in a given loudspeaker, the more possible driver pairs exist and consequently the more out-of-phase responses are possible. An example of a loudspeaker configuration diminishing undesirable phase effects is the d'Appolito configuration in which a specific driver configuration on the mounting baffle combined with a specific crossover type are applied. Polar response figures reveal the benefits of the popular d'Appolito configuration. There is nevertheless some variety among driver and crossover configurations yielding the characteristic d'Appolito phase behavior. Alternatively a loudspeaker can be configured with a stepped baffle so that the drivers are time-aligned. This configuration often reproduces more three-dimensional stereo images than conventional configurations.

Another approach to decrease loudspeaker interference effects in theory is to augment a loudspeaker with at least one auxiliary driver to improve the transfer function of the loudspeaker. The transfer functions of a woofer and a tweeter for a given crossover order differ so that the loudspeaker transfer function lacks fidelity with respect to the input for all but $1^{st}$ order electrical crossovers. When an auxiliary driver is added with the appropriate crossover slopes, the fidelity of the loudspeaker transfer function is restored. Higher crossover orders entail more auxiliary drivers and more sophisticated selection of crossover slopes. At least one auxiliary driver is required for every crossover frequency, which divulges the problems generated with this approach. First the auxiliary driver will interfere with both the woofer and the tweeter in a two-way loudspeaker, which already interfere with each other in an unaugmented two-way loudspeaker. A crossover network tailors this interference, but does not eliminate it entirely. More drivers in an unaugmented loudspeaker simply produce more possible interference effects. Augmenting these loudspeakers with auxiliary drivers in the recommended approach simply compounds the possible interference effects. Moreover this approach corrects the transfer functions of the crossover network rather than those of the network plus the drivers. Drivers without a filter applied nevertheless roll off frequencies with characteristic slopes. The typical woofer rolls off high frequencies at approximately 12 dB/octave and the typical tweeter reaches full output at approximately 6 dB/octave from resonance. These characteristics are used in the determination of "effective" crossover orders, which refer to the slope of the roll off in frequency response that a driver filtered by a crossover actually displays. This is distinguished from the slope of the electrical filter in a crossover. Effective crossover orders complicate the recommended approach to loudspeaker design and provide transfer functions corresponding to the woofer and tweeter in a two-way system that differ even more. Thus design of the appropriate filter for the auxiliary driver is made more difficult, often enjoining the use of active crossover networks. Active crossovers can be used to optimize transfer functions, but like the approach using auxiliary drivers, are developed in the absence of actual drivers and their impedances, which depend on frequency.

Approximately infinite crossover slopes also render the auxiliary approach more difficult. These crossovers typically apply many sequential crossover sections to each driver in a loudspeaker. Accordingly many auxiliary drivers would be demanded for each pair of drivers consecutive in frequency. However some consider designing loudspeakers with approximately infinite crossover slopes sufficient improvement. Interference between a pair of drivers consecutive in frequency is reduced because there is little overlap in their frequency response. These loudspeakers can be enhanced by coupling adjacent inductors to increase slopes at diminished cost though the sheer number of crossover elements in these systems can be considered expensive. Furthermore active crossovers can be used, but at even greater expense.

The aforementioned loudspeaker designs connect the drivers in parallel. Drivers in a loudspeaker can be connected in series to minimize some interference and phase effects. Possible deficiencies of loudspeakers with series crossovers are limited selection in crossover slope, reduced efficiency and fewer possible designs. Loudspeakers with series crossovers often demand drivers with similar impedances. A transformer can be incorporated into series crossover networks to increase slopes to at least $2^{nd}$ order. Recently $2^{nd}$, $3^{rd}$ and $4^{th}$ order series topologies have been developed using traditional crossover elements.

Most, if not all, the aforementioned crossover circuits and approaches can include impedance-compensation networks to smooth impedance and improve phase behavior. These networks can be applied across individual drivers as appropriate or across an entire loudspeaker.

The present art reduces phase and interference effects in sound reproduction and moderates lobing error between the loudspeakers comprising a loudspeaker system. The vertical polar response of a loudspeaker reveals lobe structure. Loudspeakers reproduce a spectrum of frequencies and lobe structure strongly depends on frequency. An increase in crossover order decreases driver overlap and thus lobing error, henceforth abbreviated as "lobing". Lobing nonetheless remains at high crossover orders. Moreover the lobe structures of the loudspeakers comprising a loudspeaker system interact.

The art of the present invention applies to the prior art of paired loudspeakers using crossover circuits. It is an object of the present invention to reduce phase distortion and reduce interference effects compared to prior art crossovers, including the popular $1^{st}$ order electrical crossover.

Another object of the present invention is to incorporate the concept of symmetry complemented by asymmetry for effective crossover orders in a pair of stereo loudspeakers to reduce phase distortion without significantly increasing cost.

A further object of the present invention is to incorporate the concept of handedness to distinguish effective odd-numbered crossover orders from effective even-numbered crossover orders and from prior art. This concept is also used in conjunction with specified polarity.

SUMMARY OF THE INVENTION

The vertical polar response (VPR) of the present embodiment reveals coupling between the two loudspeakers in a loudspeaker system as compared to a pair of loudspeakers in the prior art. If the respective loudspeakers for the right and left channels have the same lobe structure, there is lobing and possible interference between the channels. If the respective loudspeakers for the right and left channels have complimentary lobe structures, lobing and possible interference between the channels is reduced and possibly eliminated. This reduction would occur irregardless of crossover order though lobing depends on such. For instance, as crossover order increases, driver overlap and thus lobing decrease. However a phase angle remains between two drivers that are crossed over because the response of one driver rises while the response of the other driver falls at the crossover frequency and adjacent frequencies.

Below the baffle step frequency $\nu_b$, reproduction becomes omnidirectional and lobing decreases so that the vertical polar response approaches a perfect sphere. The tweeter dominates reproduction in the upper two octaves so that VPR approaches a perfect hemisphere. However reproduction near $\nu_b$ lobes substantially. Therefore selecting a crossover frequency near $\nu_b$ optimizes phase-unification, as will be discussed below.

The effective third-order crossover on the right-hand loudspeaker remains symmetric, but the effective third-order crossover on the left-hand loudspeaker is rendered asymmetric in an example of the present art, as described. However, the loudspeaker system is only part of a stereo system reproducing, or producing, sound. A receiver, integrated amplifier or separate components combined to function as such applies a full frequency spectrum of audio signals across the input of a loudspeaker. A power supply, such as an integrated amplifier or the like, amplifies audio signals from an audio signal source, such as a compact disc player, other digital source, microphone or a tape player. The preferred audio crossover circuit passes audio signals from an audio signal source to each loudspeaker in a loudspeaker system, typically a pair, to reduce phase distortion. This crossover circuit includes more than one filter and those skilled in the art will appreciate that a plurality of filters may be provided for a plurality of drivers. A resistor R can be appropriately applied to each driver so that the frequency response of each loudspeaker is approximately flat. In this example, each loudspeaker is a two-way, possessing two drivers, a woofer and a tweeter. The two drivers are connected in phase and the negative terminal of the tweeter is connected to the negative terminal of the power supply for each channel. As previously mentioned, the typical woofer rolls off high frequencies at approximately 12 dB/octave and the typical tweeter rolls off low frequencies at approximately 6 dB/octave from resonance. Accordingly if a $1^{st}$ order electrical filter is applied to the right-hand woofer, then the total attenuation is –6 dB-12 dB and the woofer effectively rolls off at 18 dB/octave, an effective third-order filter. Furthermore if a $2^{nd}$ order filter is applied to the tweeter in the right-handed loudspeaker, then the total attenuation on the right-handed tweeter is –12 dB-6 dB and the tweeter also effectively rolls off at 18 dB/octave. Such a woofer and tweeter are filtered with a symmetric effective third-order crossover because the effective crossover slopes are the same for the two drivers. A symmetric effective third-order crossover can also be called a third-order acoustic crossover, but the latter notation will not be used in this application. In a two-way loudspeaker, a symmetric "effective $n^{th}$ order" crossover has the higher order electrical filter applied to the tweeter.

However the effective third-order crossover on the left-hand loudspeaker is rendered asymmetric. If a $2^{nd}$ order filter is applied to the left-hand side (LHS) woofer, then the total attenuation is –12 dB-12 dB and the woofer effectively rolls off at 24 dB/octave. If nevertheless a $1^{st}$ order electrical filter is applied to the LHS tweeter, then the total attenuation is –6 dB-6 dB and the tweeter effectively rolls off at 12 dB/octave. Accordingly this is an asymmetric effective third-order crossover because the effective crossover slopes for the two drivers differ. However the average attenuation for the two drivers in the left-hand loudspeaker is (12+24)dB/2 or 18 db/octave, the same as the right-hand loudspeaker and also effective third-order. In a 2-way loudspeaker, an asymmetric effective $n^{th}$ order crossover has the higher order electrical filter applied to the woofer.

Other embodiments apply this principle to higher crossover orders and greater numbers of drivers. For example, in a loudspeaker system consisting of loudspeakers that possess three drivers, a woofer, a midrange and a tweeter, the effective third-order crossover on the right-hand loudspeaker remains symmetric, and the effective third-order crossover on the left-hand loudspeaker remains asymmetric, as previously described. Accordingly a rule combining effective crossover order and handedness is established. Odd effective crossover orders possess symmetry in the right-hand loudspeaker for the aforementioned polarity.

Even effective crossover orders however possess symmetry in the left-hand loudspeaker for the aforementioned polarity. For example, in a loudspeaker system consisting of loudspeakers that that possess two drivers, a woofer and a tweeter, the effective fourth-order crossover on the right-hand loudspeaker is rendered asymmetric, as described, but the effective fourth-order crossover on the left-hand loudspeaker is symmetric. In this example, like the previous example, the two drivers are connected in phase and the negative terminal of the tweeter is connected to the negative terminal of the power supply for each channel. Accordingly if a $2^{nd}$ order electrical filter is applied to the left-hand woofer, then the total attenuation is –12 dB-12 dB and the woofer effectively rolls off at 24 dB/octave, an effective fourth-order filter. If nevertheless a $3^{rd}$ order electrical filter is applied to the LHS tweeter, then the total attenuation is –6 dB-18 dB and the tweeter also effectively rolls off at 24 dB/octave. Such a woofer and tweeter are filtered with a symmetric effective fourth-order crossover and roll off with the same effective slope. Again, in a two-way loudspeaker, a symmetric effective $n^{th}$ order crossover has the higher order electrical filter applied to the tweeter. In addition, if a $3^{rd}$ order electrical filter is applied to the right-hand-side (RHS) woofer, then the total attenuation is –18 dB-12 dB and the woofer effectively rolls off at 30 dB/octave. Furthermore if a $2^{nd}$ order filter is applied to the tweeter in the RHS loudspeaker, then the total attenuation is –12 dB-6 dB and the tweeter effectively rolls off at 18 dB/octave. The effective fourth-order crossover on the right-hand loudspeaker is rendered asymmetric, as previously described, where the average attenuation for two drivers in the RHS loudspeaker is (30+18)dB/2 or 24 db/octave, the same as the left-hand loudspeaker and also effective fourth-order. There can be some discussion of whether or not, unfiltered woofers typically rolloff high frequencies at 12 dB/octave and unfiltered tweeters typically rolloff low frequencies at 6 dB/octave. For instance, unfiltered woofers could possibly typically rolloff high frequencies at 18 dB/octave and unfiltered tweeters typically rolloff low frequencies at 12 dB/octave. This discussion is not indulged further because the salient feature used to phase-unify loudspeakers is that unfiltered woofers typically rolloff high frequencies at a slope that is 6 dB/octave steeper than the slope at which unfiltered tweeters typically rolloff low frequencies.

This technology can be combined with other circuits. For instance, an RL circuit can be applied in series to a woofer typically in front of the filter proper to attenuate the baffle step that increases woofer response as the reproduced wavelength approaches the width of the loudspeaker baffle. Such circuits are popular with higher order crossovers.

This technology can also be combined with other auxiliary circuits. For instance, a Zobel is a circuit typically used for impedance correction on a woofer or midrange. Woofers, midwoofers, midranges and upper midranges display a rise in impedance and a reduction in output as frequency increases. The voice coils for these drivers are ordinarily large enough to exhibit substantial inductance. Furthermore these drivers are heavier and slower than tweeters and subject to cone breakup modes as frequency increases. A Zobel flattens the impedance and smooths the roll off of these drivers as frequency increases. A Zobel circuit thus thwarts the peakiness in falling woofer response that cone-breakup modes cause. A Zobel can also be called a phase-correction circuit and consists of a resistor R in series with a capacitor C, with the Zobel applied in parallel with the driver of interest. The values of the Zobel resistor and capacitor, henceforward designated by $R_z$ and $C_z$ respectively, are given by $$R_z=1.25R_e \quad (1)$$

$$C_z=L_e/R_z^2 \quad (2)$$

where $R_e$ is the DC resistance of the driver and $L_e$ is the inductance of the driver's voice coil. The values chosen for $R_z$ and $C_z$ should equal or exceed the values calculated from eqs. (1) and (2) respectively.

Many configurations of phase-unified loudspeakers require that a Zobel is applied to all drivers except the tweeter. However when the crossover frequency falls near the frequency at which the Zobel is tuned, the Zobel can sometimes be omitted. Also some consider a Zobel a $1^{st}$ order, low-pass filter and the present invention can occasionally exploit this by eliminating the inductor connected in series with a driver. The figures that follow use RC Zobel circuits though presumably LCR circuits, typically applied to tweeters, will also work, where appropriate. An LCR circuit, properly tuned, can be connected in parallel to a driver to form a circuit with a notching action that tames output peaks or resonant peaks in impedance: a "notch filter," as it is commonly named.

Active crossover networks and those applying digital signal processing as well as combinations thereof can also realize the present invention. Below shows how to phase-unify loudspeakers using active crossovers and the capacitors, resistors, op amps and power amplifiers therein. Active crossovers can be more awkward for loudspeaker design because they typically use more elements than the equivalent passive crossover. However, somewhat analogous to parallel crossovers, sequential sections can be added to increase the order of active crossovers. One can use this principle to develop higher effective orders in active crossovers according to the present art.

Sometimes the present invention improves reproduction considerably when only applied to one crossover point in a loudspeaker system with more than two drivers. This simplification is made more effective when the present invention is applied to a crossover frequency in the range of about 500 to 2000 Hz, a frequency range corresponding to typical frequencies for the baffle step. The value of the baffle-step frequency depends upon the geometry and dimensions of the loudspeaker enclosure and can be calculated for a wide variety of such with software such as "Edge". The value of $\nu_b$ decreases as the enclosure width increases for a rectangular parallelepiped enclosure. For example $\nu_b$ is 1125 Hz if such an enclosure is 11" wide, but increases to 1500 Hz if this enclosure is 9" wide. A crossover frequency in the range of about 500 to 2000 Hz is recommended to phase-unify two-way loudspeakers with a rectangular parallelepiped enclosure of typical dimensions.

Phase-unified loudspeakers have approximately the same crossover frequency. However properly designed crossovers tailor the crossover frequency and type of circuit to the different drivers in the loudspeaker. Technically a crossover frequency is the frequency at which the frequency response of a driver reproducing lower frequencies intersects the frequency response of a driver reproducing higher frequencies when the drivers' output curves are plotted on a figure for frequency response. Crossover equations often do not designate such a crossover frequency, but designate $\nu_f$, the frequency at which the output of a given driver is ordinarily reduced 3 dB. Accordingly $\nu_f$ for the woofer in a two-way loudspeaker might be different from $\nu_f$ for the tweeter in this loudspeaker, with the crossover frequency for the entire loudspeaker ordinarily falling somewhere in between. Investigations have demonstrated that two octaves constitutes the largest difference between each crossover frequency for the RHS and LHS loudspeakers to maximize phase-unification. Another name for $\nu_f$ is the filter frequency.

The detailed description of the present art describes a plurality of embodiments for stereo loudspeaker systems of various sizes and crossover designs to render smoother polar response which further reduce phase effects in order to improve imaging and reproduction significantly. These principles can also be applied to devices such as stereo headphones which use more than one driver per channel and cross these drivers over with parallel circuits. Phase-unified loudspeakers work in conjunction with subwoofers because subwoofers operate and are crossed over in the frequency range where output is omnidirectional.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
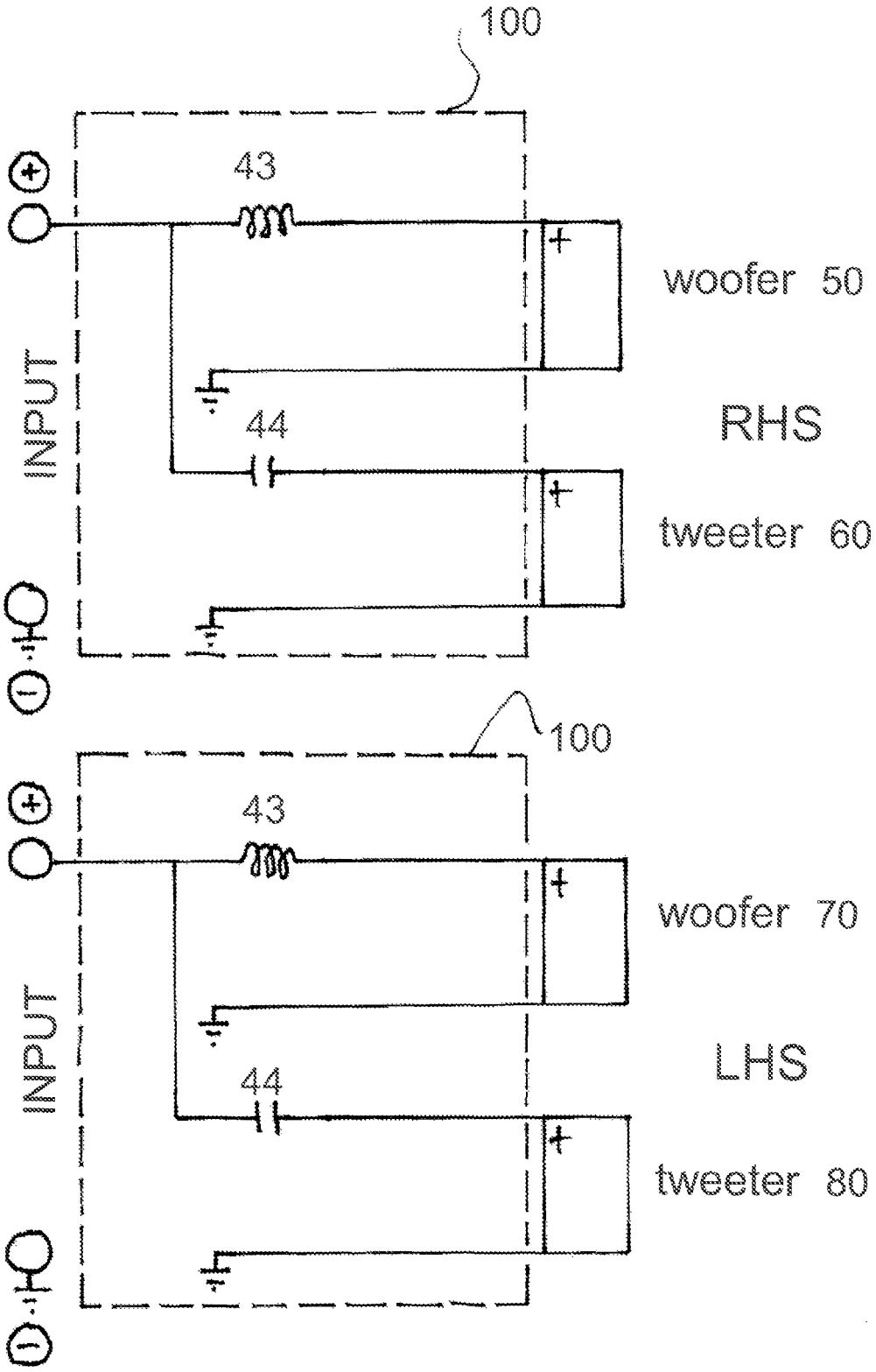
Prior Art Fig. 1
FIG. 1 shows a $1^{st}$ order crossover electrical circuit for a two-way loudspeaker system in accordance with the prior art.

Complimentary crossover networks are therefore used in the RHS and LHS loudspeakers to phase-unify their reproduction. A symmetric effective crossover for the loudspeaker in one channel and an asymmetric effective crossover of typically the same order for the loudspeaker in the other channel comprise said complimentary crossover networks, phase-unifying reproduction in accordance with handedness rules that are hereafter described. Ordinarily an effective crossover can be third order or of a higher order, which is theoretically unlimited, simply depending upon the number of crossover elements used.

Phase-unified loudspeakers with parallel crossovers, which will henceforth be abbreviated to "parallel phase-unified loudspeakers," include, but are not restricted to stereophonic, home theater and quadraphonic loudspeaker systems. It is assumed that the same drivers are used in both loudspeakers comprising a stereo system of parallel phase-unified loudspeakers, a definition extending to include drivers that are stereo-imaged. Furthermore each loudspeaker has two or more drivers, for which a definite polarity is selected and including at least one driver reproducing lower frequencies and at least one driver reproducing higher frequencies. Ordinarily each loudspeaker in the pair would also possess the same cabinet, bass loading, configuration and crossover order. All drivers for a given loudspeaker are connected in-phase. Also it is understood that the right channel of the integrated amplifier or the like is connected to the RHS loudspeaker and the left channel of the integrated amplifier or the like is connected to the LHS loudspeaker, a condition more for clarification than for phase-unification.

Not only are a woofer, midwoofer, midrange, upper midrange or tweeter each called a driver, there are many types of each driver. For instance, tweeters include, but are not limited to electrostatic, cone, ribbon and dome tweeters. There are soft dome tweeters and hard dome tweeters. Soft dome tweeters include, but are not limited to tweeters with cloth, paper or polymer domes while hard dome tweeters are often coated with metals like aluminum, beryllium or titanium. There are soft dome midranges and hard dome midranges. There are midranges with paper, polymer or metal cones. Cone-breakup modes sound particularly harsh for the latter. Some of these midranges can be used as midwoofers. There are even diamond-coated tweeters and midranges. Woofers include, but are not limited to woofers with paper, polypropylene, Kevlar or metal cones. There are woofers with cones specially slitted via computer design to tame cone-breakup modes.

Loudspeaker drivers come in a variety of impedances, typically 4 to 16Ω. Power supplies ordinarily prefer to drive impedances of 4 to 8Ω although some amplifiers can drive loudspeakers with impedances as low as 2Ω. Loudspeakers with impedances over 16Ω significantly reduce the power that a power supply can provide to them. The impedance of a driver depends on frequency so that the impedance of a finished loudspeaker containing more than one driver also depends on frequency.

Phase-unification does not depend on loudspeaker orientation, as long as all loudspeakers in a phase-unified system point towards the listener(s). Included in this definition is both loudspeakers comprise a pair that faces the same direction, a direction opposite the listener(s), situated midway between loudspeakers, but an appreciable distance from them. Or, if preferred, both loudspeakers comprise a pair that is "toed in" toward the listener(s) who are situated as before. The conventional orientation for a loudspeaker is the tweeter is at the top of the loudspeaker and the woofer is at the bottom although more esoteric loudspeaker configurations like d'Appolito or line arrays do not follow convention. For instance, if such a listener is 10 feet from the fronts of such conventionally oriented loudspeakers, it is recommended for substantial phase-unification that the listener's ears be approximately 2 feet above the tweeter axes. Pointing any loudspeaker in a loudspeaker system away from the listener (s) disrupts phase-unification appreciably.

Loudspeaker configurations include stereo-imaged, d'Appolito and time-aligned. For instance, a pair of stereo-imaged loudspeakers typically places the tweeter of one loudspeaker toward an inner uppermost corner of the front baffle, but places the tweeter of the other loudspeaker so that at least its tweeter configuration is the stereo, or mirror, image of the first loudspeaker. The popular d'Appolito, or WTW, configuration is most often applied to a loudspeaker with two woofers and one tweeter. The woofers are placed towards the top and bottom of the front baffle and the tweeter is placed in between: namely WTW. Time-aligned configurations use a stepped, or sometimes sloped, front baffle and exploit the different physical configurations of different drivers. For example, a tweeter is smaller and shallower than a woofer typically. Accordingly when such a tweeter and woofer are mounted on a conventional planar front baffle, the front of the tweeter voice coil is in front of the front of the woofer voice coil: the two drivers are not time-aligned. Stepping the front baffle so that the fronts of the tweeter voice coil and woofer voice coil lie in the same plane time-aligns these drivers and the loudspeaker. For any configuration, a sensible layout of the drivers on the baffles is suggested.

In the present art, for both loudspeakers constituting parallel phase-unified loudspeakers crossovers are calculated to produce reasonably flat frequency response, ordinarily ±4 dB. For all embodiments, the crossover frequency(s) for the one channel approximately equal(s) that for other channels. The two loudspeakers in a phase-unified system have approximately the same crossover frequency within a two-octave range. The human ear hears over a 10-octave range so that crossover frequencies differing by one or two octaves are approximately equivalent. The present art phase-unifies loudspeaker reproduction irrespective of driver type, fabrication or impedance. The present art phase-unifies loudspeaker reproduction for different baffle configurations and combinations thereof.

Two-Way Phase-Unified Loudspeakers with Passive Crossovers

Figure 2:
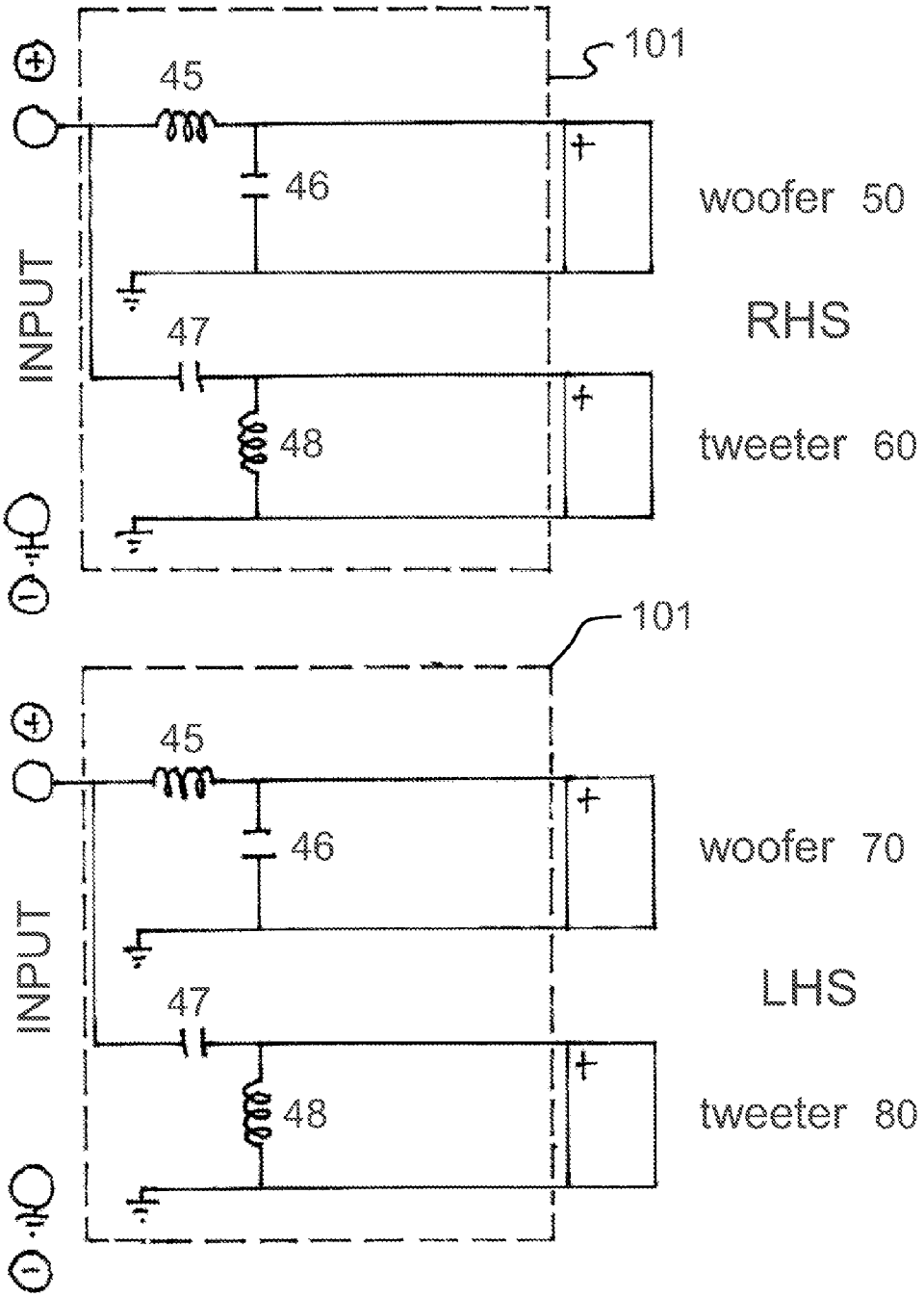
Prior Art Fig. 2
FIG. 2 shows a $2^{nd}$ order crossover electrical circuit for a two-way loudspeaker system in accordance with the prior art.
Figure 3:
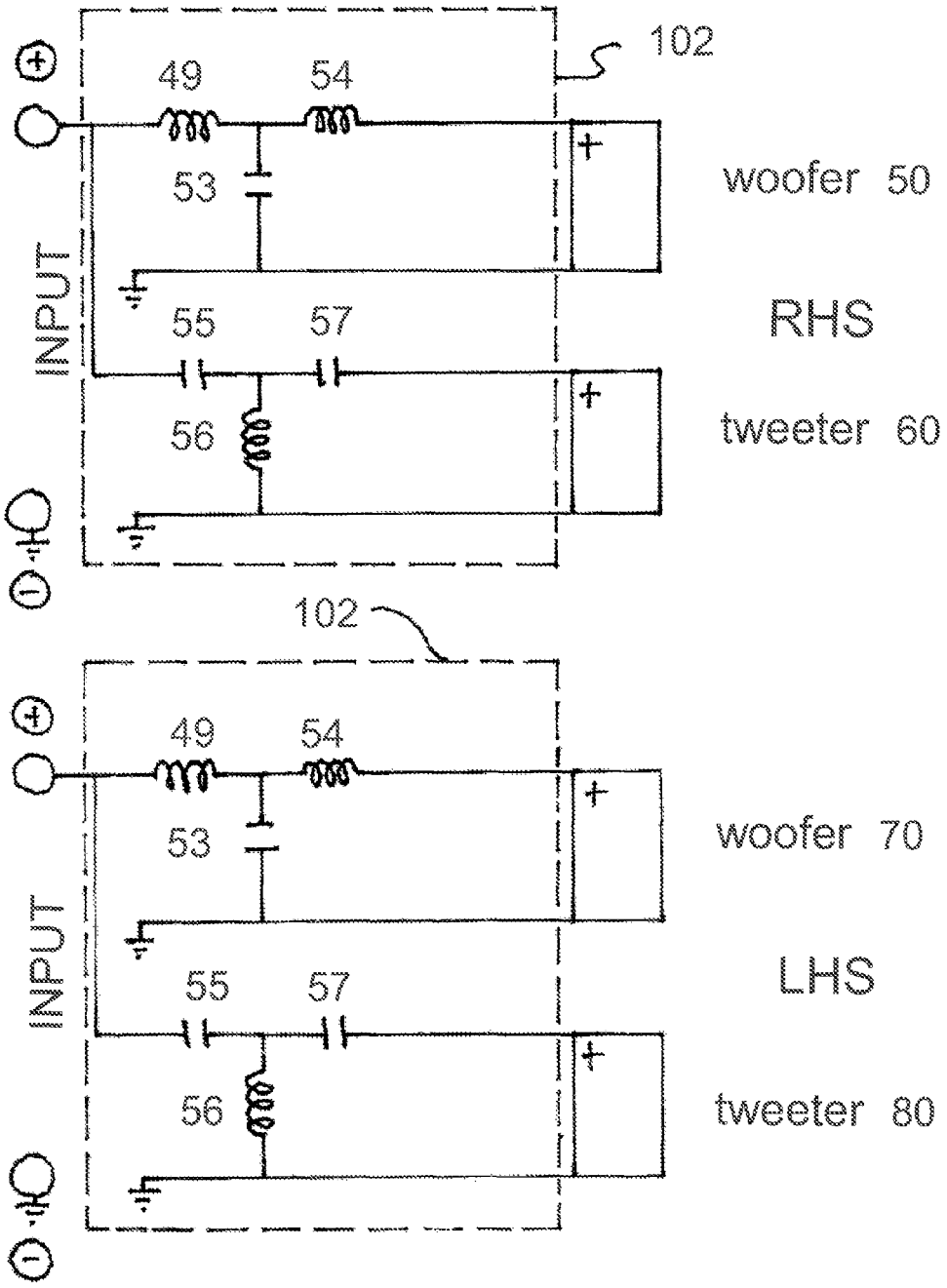
Prior Art Fig. 3
FIG. 3 shows a $3^{rd}$ order electrical crossover circuit for a two-way loudspeaker system in accordance with the prior art.
Figure 4:
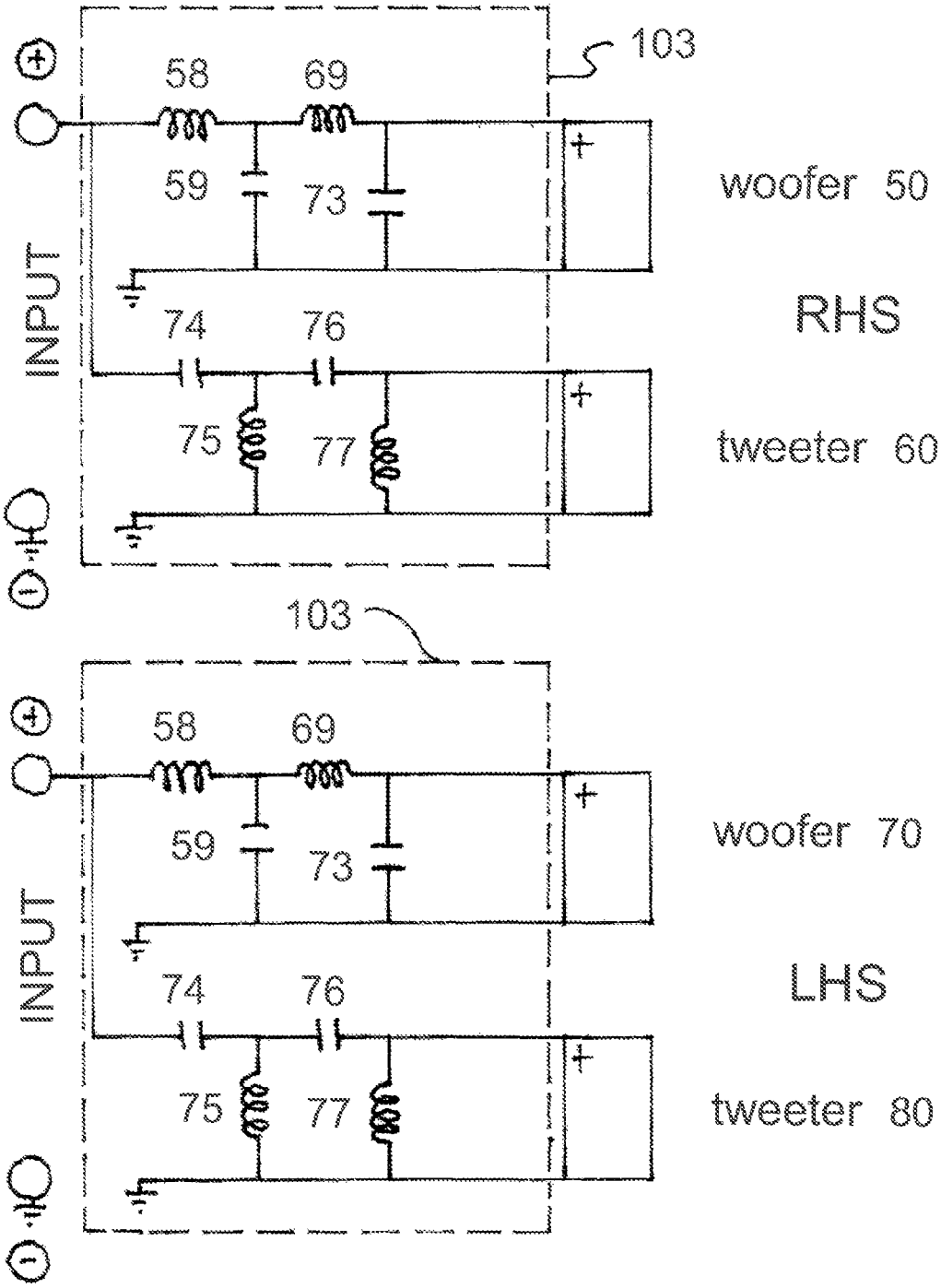
Prior Art Fig. 4
FIG. 4 shows a $4^{th}$ order electrical crossover circuit for a two-way loudspeaker system in accordance with the prior art.

FIGS. 1-4 depict the prior art, $1^{st}$-$4^{th}$ order electrical crossovers respectively. In FIG. 1, an inductor 43 is connected in series with woofer 50 and a capacitor 44 is connected in series with tweeter 60 and analogously 43 is connected in series with woofer 70 and 44 is connected in series with tweeter 80. The first inductor connected in series to 50 is 43 and the first capacitor connected in series to 60 is 44 in a passive $1^{st}$ order electrical crossover for a two-way loudspeaker 100. Henceforward crossovers are assumed to be passive unless stated otherwise. In FIGS. 1-4, the RHS and LHS crossovers are the same. In FIG. 2, the first inductor connected in series to 50 is 45 and the first capacitor connected in parallel to 50 is 46 in a $2^{nd}$ order electrical crossover for a two-way loudspeaker 101. The first capacitor connected in series to 60 is 47 and the first inductor connected in parallel to 60 is 48 in 101. Analogously 45 is connected in series with woofer 70, with 46 connected in parallel, and 47 is connected in series with tweeter 80, with 48 connected in parallel. A $3^{rd}$ order electrical crossover network adds an element to the circuit applied to each driver. FIG. 3 correspondingly shows the first inductor connected in series to 50 is 49 and the first capacitor connected in series to 60 is 55 in a $3^{rd}$ order electrical crossover for a two-way loudspeaker 102. The first capacitor connected in parallel to 50 is 53 and the first inductor connected in parallel to 60 is 56 in 102. The second inductor connected in series to 50 is 54 and the second capacitor connected in series to 60 is 57 in 102. FIG. 4 depicts a $4^{th}$ order electrical crossover network. Consequently the first inductor connected in series to 50 is 58 and the first capacitor connected in series to 60 is 74 in a $4^{th}$ order electrical crossover for a two-way loudspeaker 103. The first capacitor connected in parallel to 50 is 59 and the first inductor connected in parallel to 60 is 75 in 103. The second inductor connected in series to 50 is 69 and the second capacitor connected in series to 60 is 76 in 103; the second capacitor connected in parallel to 50 is 73 and the second inductor connected in parallel to 60 is 77. "First capacitor," "second inductor" and like notation refer only to those crossover elements that constitute low-pass, bandpass or high-pass filters on the respective drivers.

Figure 5:
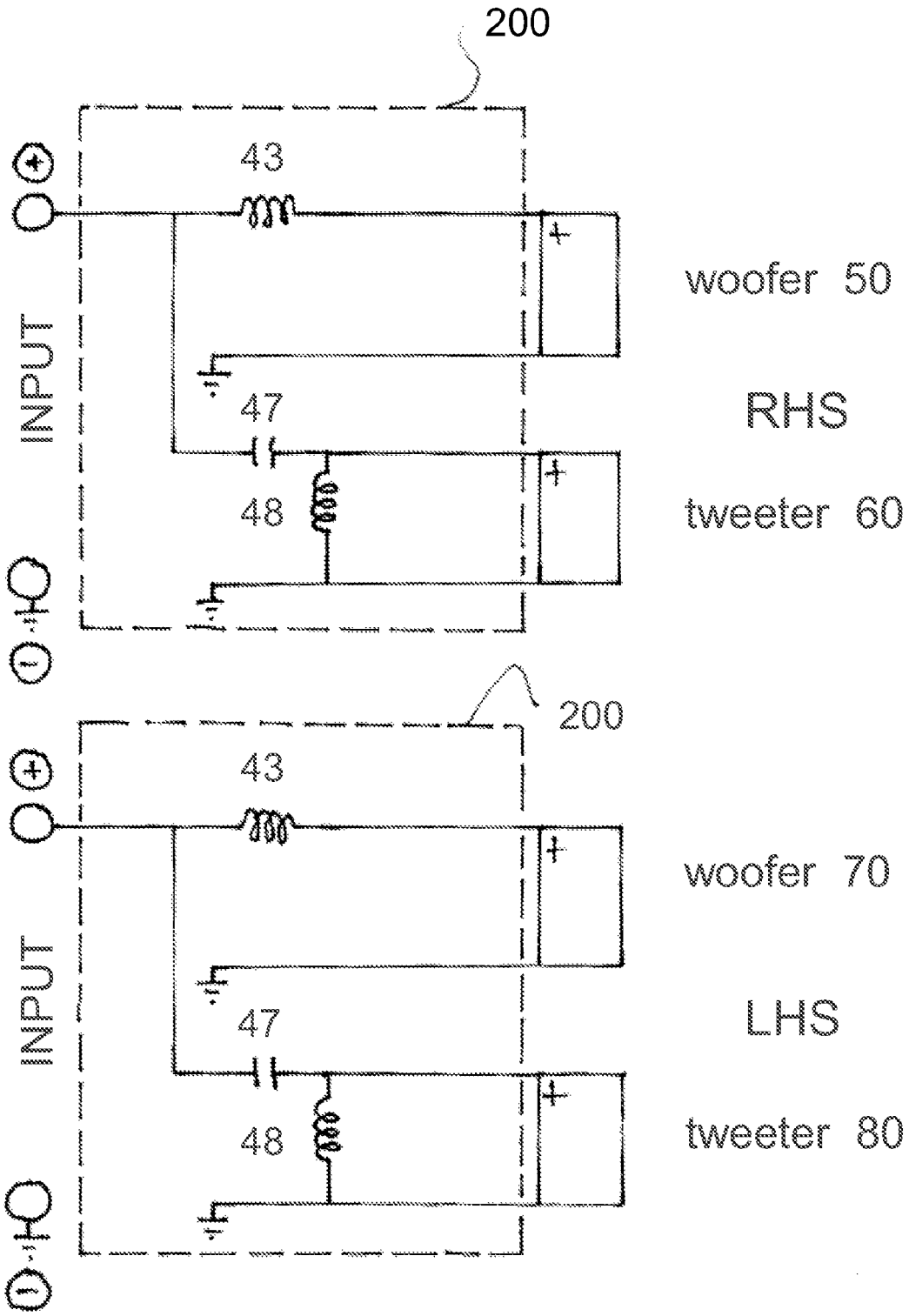
Prior Art Fig. 5
FIG. 5 shows an effective third-order crossover circuit for a two-way loudspeaker system in accordance with the prior art.

Background on the prior art clarifies discussion of the present art. Like FIGS. 1-4, the LHS effective third-order crossover network in the prior art is the same as the RHS crossover network. FIG. 5 therefore shows that 43 is the first inductor connected in series to 50, 47 is the first capacitor connected in series to 60 and 48 is the first inductor connected in parallel to 60. FIG. 5 thus constitutes a symmetric effective third-order crossover for a two-way loudspeaker 200: namely, a $1^{st}$ order filter has been applied to the woofer, but a $2^{nd}$ order filter has been applied to the tweeter.

Figure 6:
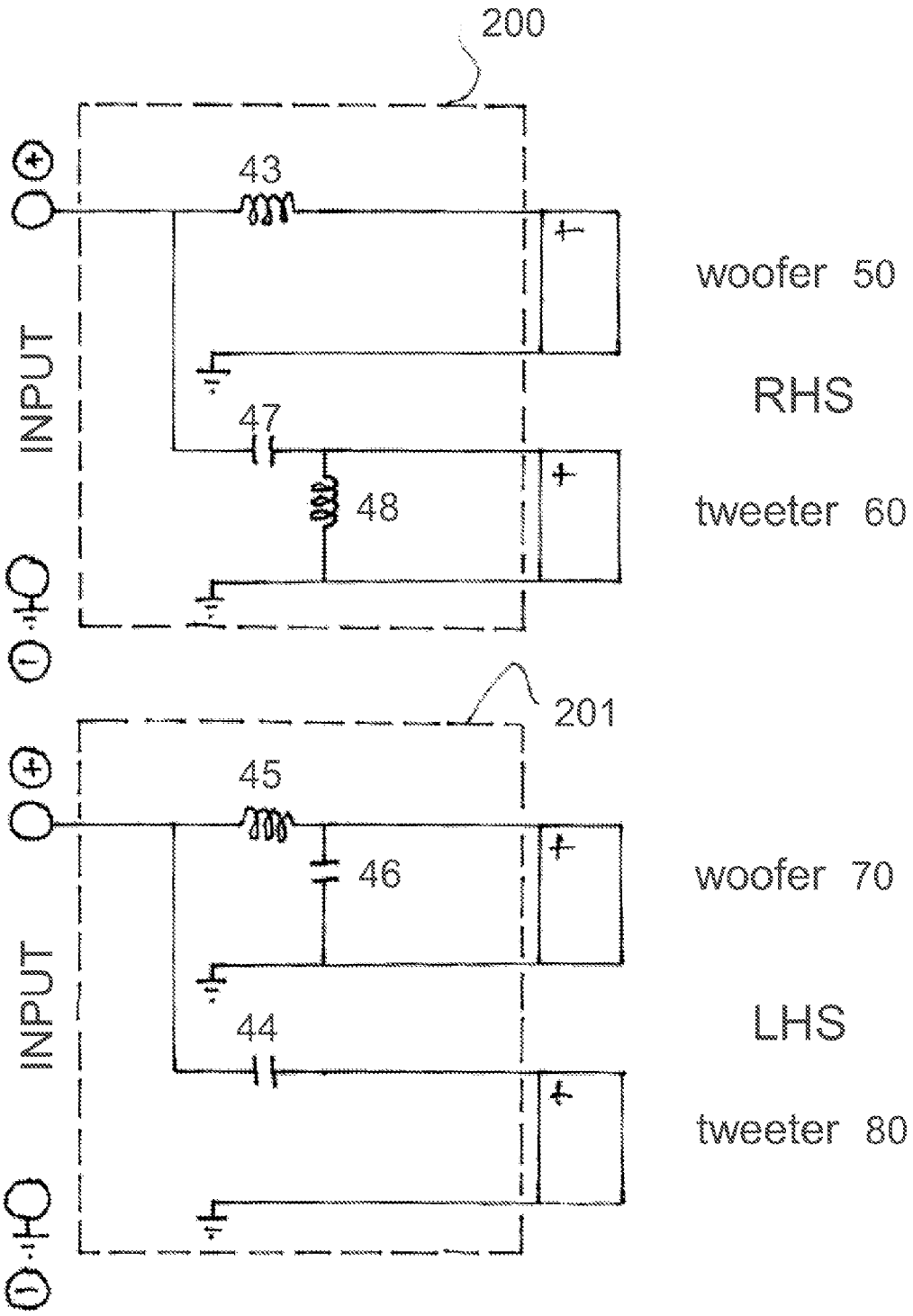
FIG. 6 shows the effective third-order crossover circuit for a two-way loudspeaker system, in accordance with the first alternative embodiment of the present invention. Note that the negative terminal of the tweeter is connected to the negative terminal of the power supply.

The RHS crossover network for the present art is consequently in accordance with the prior art, but FIG. 6 shows that the LHS crossover network is not in accordance. FIG. 6 shows that 43 is the first inductor connected in series to 50, 47 is the first capacitor connected in series to 60 and 48 is the first inductor connected in parallel to 60 in a symmetric effective third-order crossover for a two-way loudspeaker 200. Furthermore a first series inductor 45 is therefore connected to woofer 70, which also has a first parallel capacitor 46 connected, and a first series capacitor 44 is connected to tweeter 80. This constitutes an asymmetric effective third-order crossover for a two-way loudspeaker 201, which is rarely encountered and moreover has never before been complemented with a symmetric effective third-order crossover for the two-way loudspeaker in the right channel. A $2^{nd}$ order filter has thus been applied to the LHS woofer, but a $1^{st}$ order filter has been applied to the LHS tweeter.

Crossover component values are calculated according to the conventional equations defining the half-power, or −3 dB point, (i.e. attenuation) frequency $\nu_f$ for designing electrical filters of a given order. For example, for $1^{st}$ order electrical filters (FIG. 1), e.g. Butterworth, the equations are $$C=1/(2\pi Z\nu_f) \tag{3}$$

$$L=Z/(2\pi\nu_f) \tag{4}$$

where L is the inductor, C is the capacitor used in the crossover network that eqs. (3)-(6) describe and Z is the impedance of the driver at $\nu_f$. Nearly all odd-ordered electrical filters are Butterworth filters and are relatively insensitive to horizontal driver offset. Even-ordered electrical filters are named differently depending on their damping and are sensitive to horizontal driver offset. The convention for $\nu_f$ differs for even-ordered electrical filters because the damping differs. For instance, $\nu_f$ for a $2^{nd}$ order electrical Linkwitz-Riley filter is the frequency that attenuates driver response 6 dB. The conventional equations for designing a $2^{nd}$ Butterworth electrical filter (FIG. 2) are $$C=1/(2\pi Z\nu_f\sqrt{2}) \tag{5}$$

$$L=Z\sqrt{2}/(2\pi\nu_f) \tag{6}$$

and are used to calculate crossover component values where warranted. Other filter equations can be used to either increase damping (e.g. Linkwitz-Riley) or decrease damping (e.g. Chebychev), as the user deems fit. The negative terminals of the tweeters are connected to the negative terminals of the power supply in phase-unified loudspeakers, unless otherwise noted. In FIG. 6 and other embodiments of the present invention, capacitors, resistors and inductors used are typically numbered to correspond to the particular filter indicated in the prior art. This convention is warranted because a given crossover element used in the crossover network for the RHS loudspeaker is typically not equal in value to that element used in the crossover network for the LHS loudspeaker. For example, in FIG. 6, the value of the first series inductor applied to 50 is given by eq. (4), but the value of the first series inductor applied to 70 is given by eq. (6). In FIGS. 1-21, the two-way loudspeaker for the right channel has a woofer 50 and a tweeter 60 connected in parallel and the two-way loudspeaker for the left channel has a woofer 70 and a tweeter 80, also connected in parallel.

Figure 7:
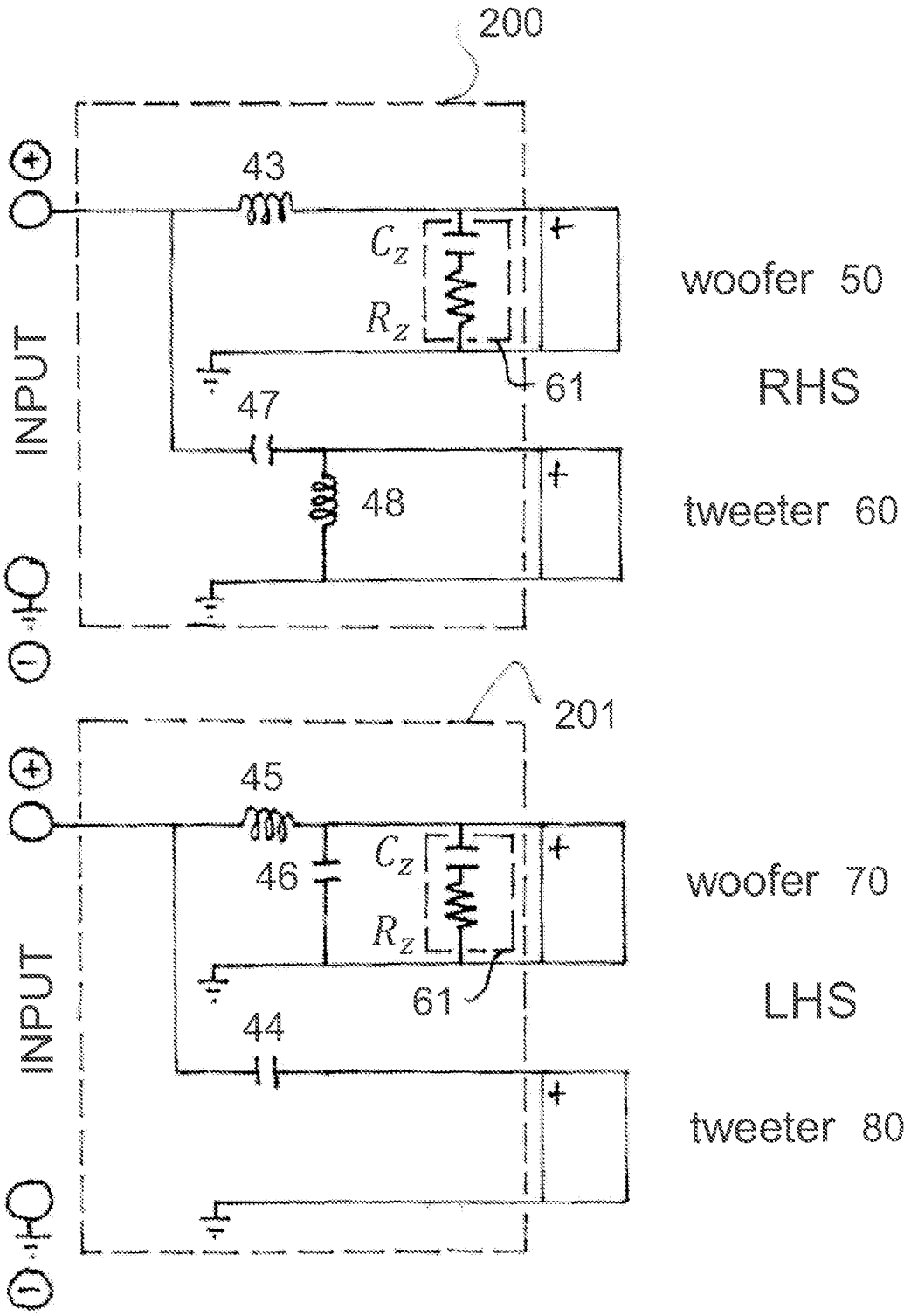
FIG. 7 shows the effective third-order crossover circuit for a two-way loudspeaker system, with a Zobel circuit applied to the woofer, in accordance with the preferred embodiment of the present invention.

FIG. 7 shows the effective third-order crossover for a two-way loudspeaker system, with an impedance correction circuit typically called a "Zobel" applied to the woofer, in accordance with the preferred embodiment of the present invention: a capacitor $C_z$ and resistor $R_z$ are connected in series to form the Zobel 61, which is connected in parallel with woofer 50 and similarly connected to woofer 70. Alternative embodiments use auxiliary circuits, circuit shortcuts, more drivers and/or different effective crossover orders. For instance, FIG. 6 shows the same crossover network without a Zobel, to form the first alternative embodiment of the present invention. Although most parallel phase-unified two-way loudspeakers apply a Zobel circuit to the woofer, the first alternative embodiment will phase-unify some loudspeakers, particularly those using woofers not heavily subject to cone breakup and peaked response at higher frequencies.

Figure 8:
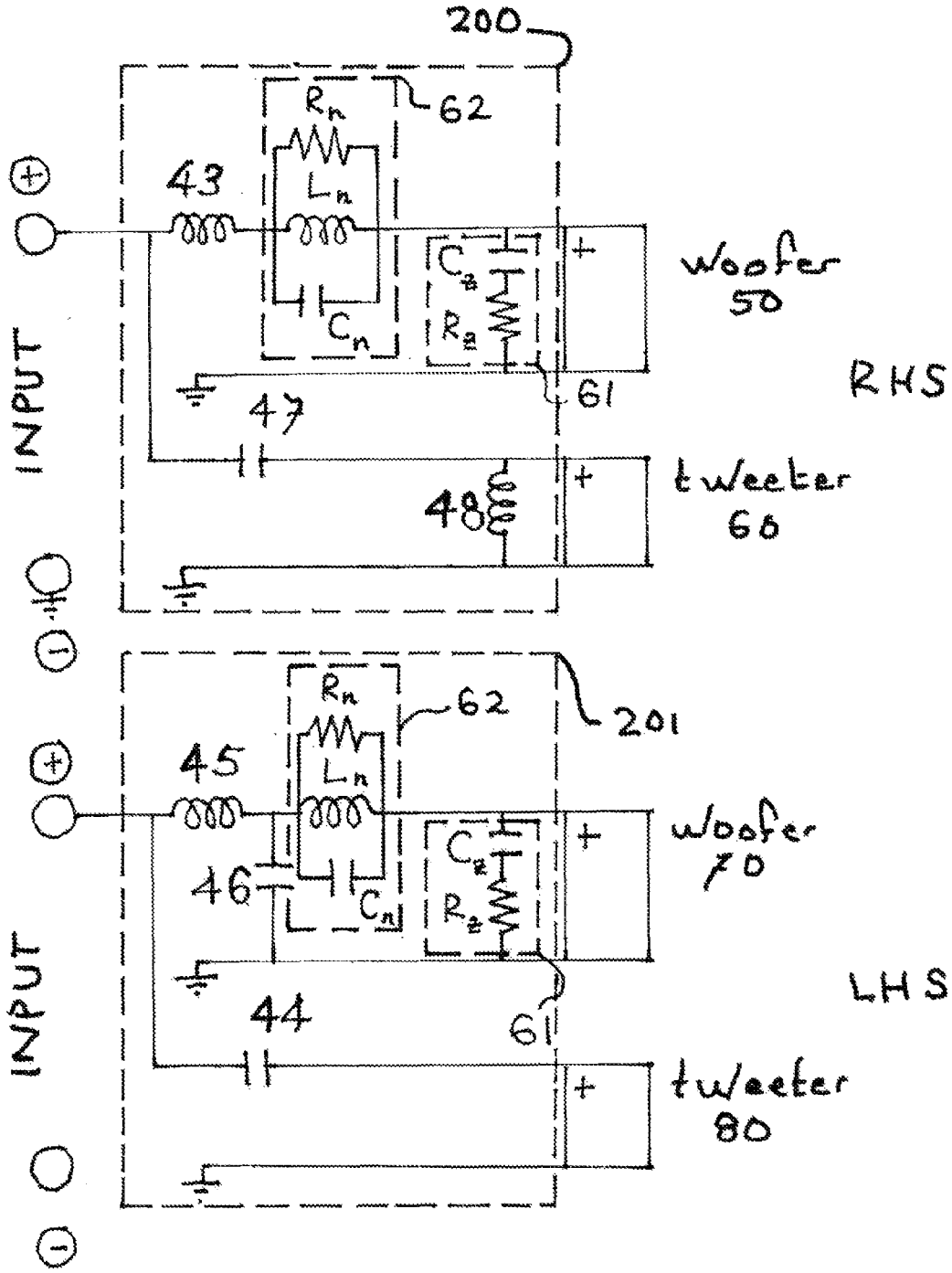
FIG. 8 shows an equivalent effective third-order crossover circuit for a two-way loudspeaker system, with a Zobel circuit and a notch filter applied to the woofer, in accordance with the second alternative embodiment of the present invention.
Figure 9:
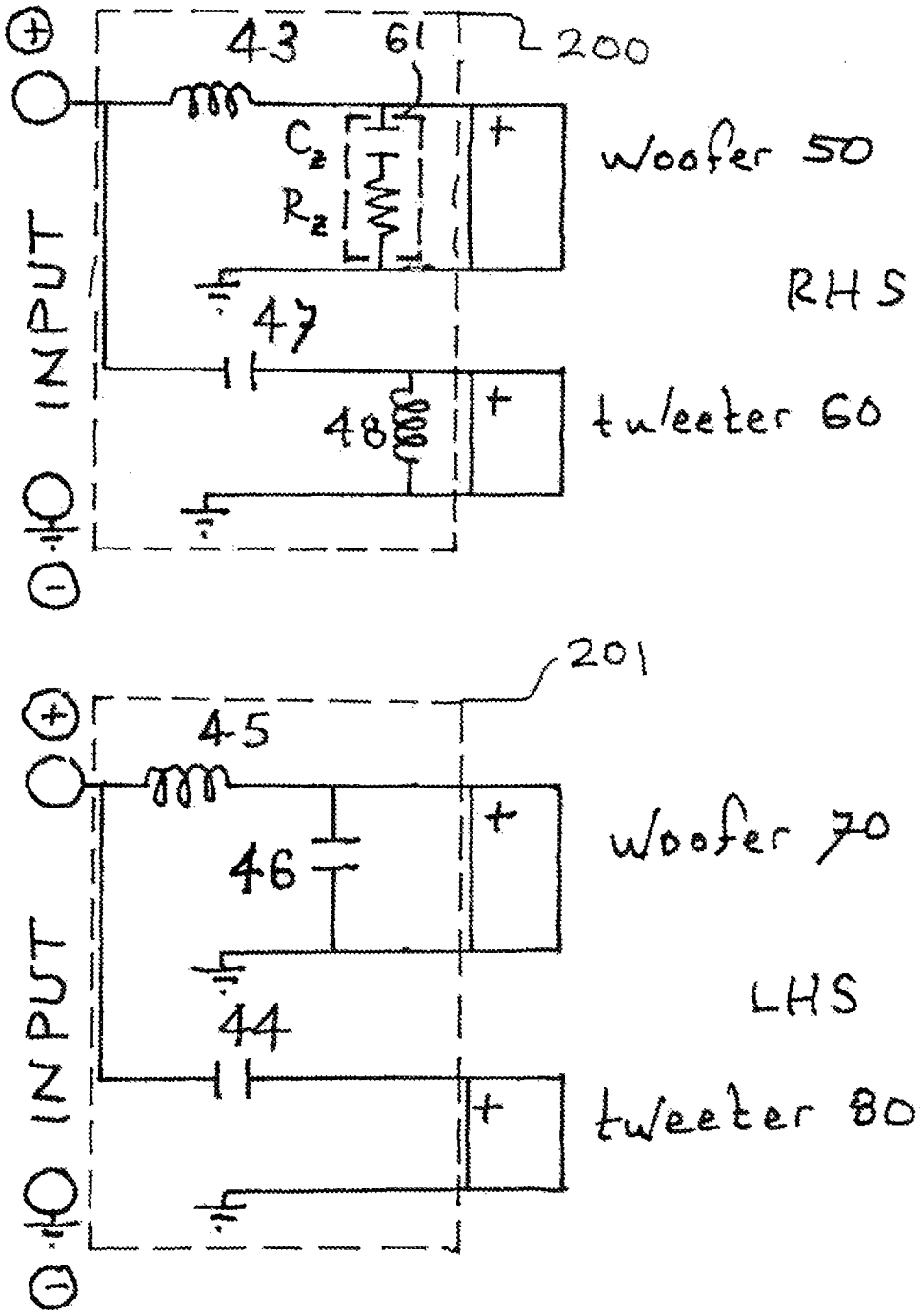
FIG. 9 shows the effective third-order crossover circuit for a two-way loudspeaker system, with a Zobel circuit applied to the woofer and because it is redundant with the shunt C, the Zobel capacitor omitted on the LHS woofer, in accordance with the third alternative embodiment of the present invention.

Note that in addition to the Zobel circuit, a notch filter can also be applied to the woofer to compensate for a peak in response and form the second alternative embodiment of the present invention (FIG. 8). More than one configuration for a notch filter, a circuit very sensitive to phase effects, is available. A notch filter 62 ordinarily consists of a resistor, inductor and capacitor in parallel, respectively $R_n$, $L_n$ and $C_n$ in FIG. 8 with values calculated from conventional equations, taking care to mitigate possible, severe phase effects. The notch filter is then applied in series to the drivers of interest, 50 and 70 in FIG. 8, after the crossover elements that constitute low-pass, bandpass or high-pass filters proper. A heavily ringing, resonant peak in the impedance of a tweeter or other driver can be minimized with an LCR (elements connected in series) circuit applied in parallel to that driver, again after the low-pass, bandpass or high-pass filters proper.

A capacitor connected in series with a driver forms a $1^{st}$ order electrical high-pass filter in accordance with eq. (3). However an L connected in series with the capacitor, either before the capacitor or between the capacitor and driver, forms a bandpass filter rolling off driver response with 6 dB/octave slopes. In this bandpass filter, equations (3) and (4) define $\nu_f$ for the two crossover elements and therefore the range of frequencies that the driver will reproduce at full output.

According to the Thevenin equivalences, an inductor connected in parallel with a driver forms forms a $1^{st}$ order electrical high-pass filter in accordance with eq. (4). However in addition, a C connected in parallel with the driver forms a bandpass filter rolling off driver response with 6 dB/octave slopes. In this bandpass filter, equations (3) and (4) again define $\nu_f$ for the two crossover elements and therefore the range of frequencies that the driver will reproduce at full output. The section on phase-unified 3-way loudspeakers below applies bandpass filters.

Notch filter construction differs from bandpass filter construction. For instance, in one type of notch filter, an inductor is connected in parallel with a driver. In addition, a capacitor is connected in series with the inductor, and implicitly in parallel with the driver. This forms a notch, as opposed to a peak, in the driver response. The addition of a resistor in parallel with the crossover elements comprising this notch filter enables one to control the amount of current flowing across the notch filter. For example, at infinite resistance, no current flows across this filter. The notch filter is typically applied to stop the ringing that can occur at a driver's resonance frequency. Thus the value of the inductor, capacitor and resistor in the notch filter depend on the electrical and mechanical damping factors of the driver as well as on its DC resistance and resonance frequency.

In another type of notch filter, an inductor is connected in series with a driver. In addition, a capacitor is connected in parallel with the inductor, and implicitly in series with the driver. This forms a notch, as opposed to a peak, in the driver response. The addition of a resistor in parallel with the crossover elements comprising this notch filter enables one to control the amount of current flowing across the notch filter. For example, at zero resistance, no current flows across this filter. This notch filter is often applied to eradicate the peak in a driver's frequency response that can occur due to cone breakup modes. Thus the value of the inductor, capacitor and resistor in this notch filter depend on the frequency at which this peak arises.

Additional topologies for notch filters are available. For instance, a notch filter can be formed when an inductor is connected in series to a woofer or midrange. A capacitor is connected in parallel to this inductor, but a resistor is connected in series to the capacitor to form an RC circuit across the inductor. This inductor experiences the conventional rolloff of approximately 6 dB/octave, but the capacitor displays a rolloff that can be varied depending on the application of infinite to zero resistance. This reasoning can be extended to tailor the rolloff slope for individual reactive elements in a filter. A resistor can be put across an inductor or capacitor connected in series with a driver to attenuate the rolloff slope, as desired, from 6 dB/octave to 0 dB/octave. A resistor can be connected in series to an inductor or capacitor connected in parallel with a driver to attenuate the rolloff slope continuously from 6 dB/octave to 0 dB/octave.

These concepts can be incorporated into suitable electrical filters to combine rolling off and notching actions. For example, a Cauer elliptic filter rolls off driver response, also functions as a notch filter to an appreciable extent and can be applied to the present art to constitute additional alternative embodiments. Cauer elliptic filters have independently adjustable rolloff and notch functions, but also possess considerable phase effects. These filters are further distinguished because for a given electrical order, they roll off with substantially greater slopes than the slopes of their less sophisticated counterparts. For example, the slope of a $4^{th}$ order electrical Cauer elliptic filter is substantially greater than the 24 dB/octave slope that a $4^{th}$ order electrical Butterworth or Bessel filter exhibits. Care must therefore be taken to measure the effective crossover slope that a Cauer elliptic filter elicits and to use this slope to implement the present art. Ordinarily these filters are limited to higher crossover orders and are relatively undamped, which can cause some drivers to ring.

Also the value of the shunt capacitor applied to the woofer can obviate the need to apply a woofer Zobel (FIG. 9), typically when the shunt and Zobel capacitors are very similar in value in the third alternative embodiment of the present invention. In this case, one could use $C_z$ and omit 46, but $C_z$ is damped with $R_z$, reducing the magnitude of the filter slope, a point to developed further below. Accordingly if 46 equals or exceeds $C_z$, one can generally omit the woofer Zobel. Similarly in a two-way system, the L for the right-hand side woofer can occasionally be omitted if the crossover frequency is selected to coincide with the frequency for the woofer Zobel.

Furthermore note that the capacitor in series with the left-hand side tweeter can be replaced with a Thevenin equivalence 63, which connects a first series resistor $R_{1T}$ and a Thevenin-equivalent inductor $L_T$ in parallel to the tweeter (FIG. 10), to substitute for 44 in 201. This constitutes the fourth alternative embodiment of the present invention. Some tweeters ring substantially and 63 is applied to decrease ringing or to reduce the distortion that inferior capacitors add to the signal provided to the tweeter. Premium capacitors, ranging in quality from polypropylene to a combination of silver, gold and oil, are ordinarily used in series with the tweeter to reduce distortion, but this Thevenin equivalence eliminates the reactive crossover element in series with the tweeter to reduce distortion even further. This Thevenin equivalence also reduces loudspeaker cost because premium capacitors can be prohibitively expensive. Analogous substitutions can be made in the woofer filters, or when a midrange is present, including substituting for inductors and in higher crossover orders. These and similar substitutions fall under the Norton-Thevenin equivalences.

Figure 11:
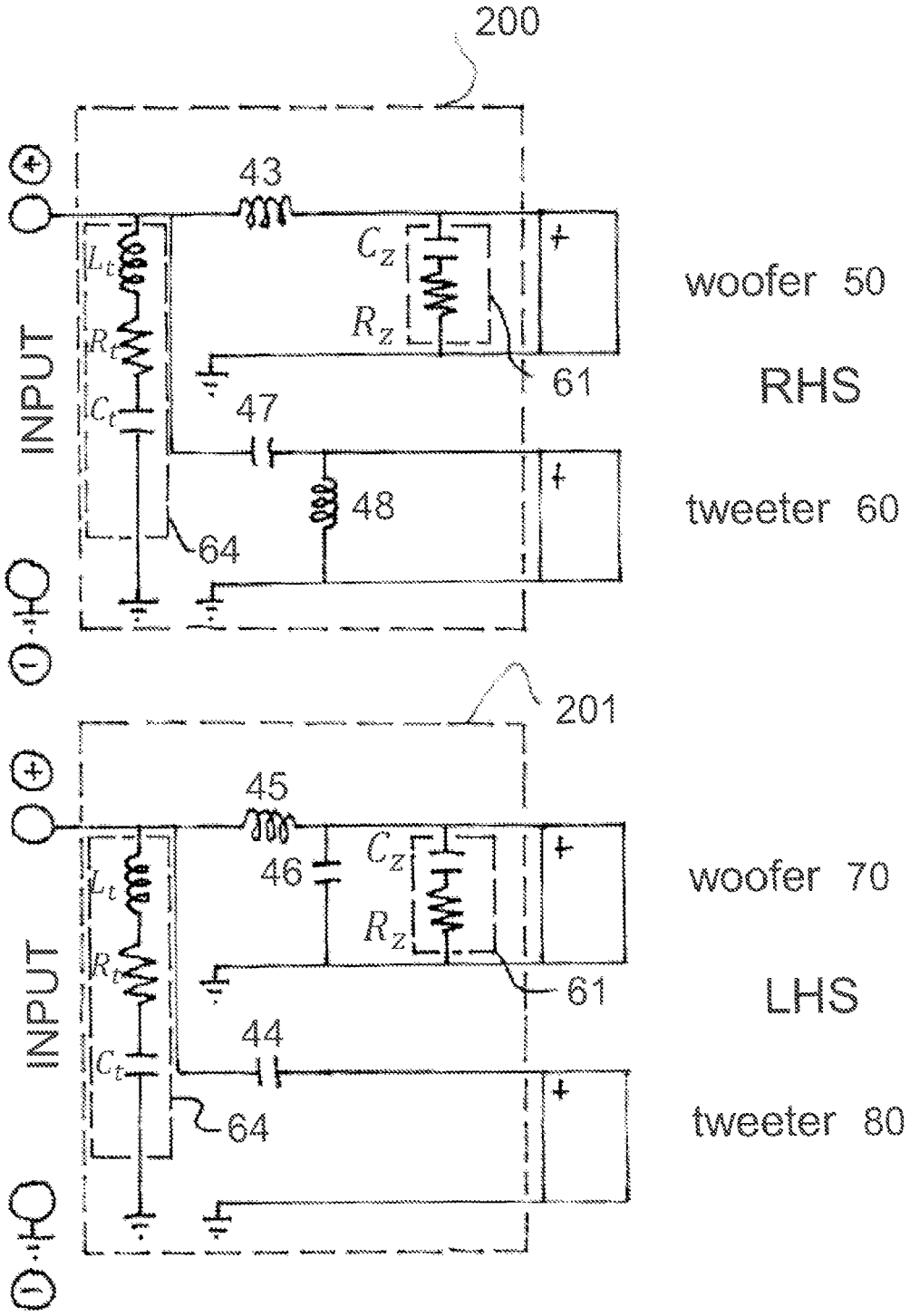
FIG. 11 shows the effective third-order crossover circuit for a two-way loudspeaker system, with a Zobel circuit applied to the woofer and a twister circuit applied across both drivers, in accordance with the fifth alternative embodiment of the present invention.

The fifth alternative embodiment of the present invention applies a "twister" circuit to any of the previous embodiments, as shown applied to the preferred embodiment in FIG. 11. A twister circuit is applied across the negative and positive terminals of the entire loudspeaker. A twister circuit 64 consists of a resistor, inductor and capacitor in series, respectively $R_t$, $L_t$ and $C_t$ in FIG. 11 with values calculated from conventional equations.

A twister circuit ordinarily comprises a notch filter tuned to the impedance peak for a 2-way loudspeaker, a frequency that falls near $\nu_x$. A twister circuit thus corrects the impedance of an entire 2-way loudspeaker so that the amplifier has an easier load to drive and driver performance near $\nu_x$ is smoother. In 3-way or better loudspeakers consisting of multiple drivers, a twister circuit can still be applied, but one must choose which $\nu_x$ to tune this circuit to. In the present art, this would typically be the crossover frequency nearest $\nu_b$.

Figure 12:
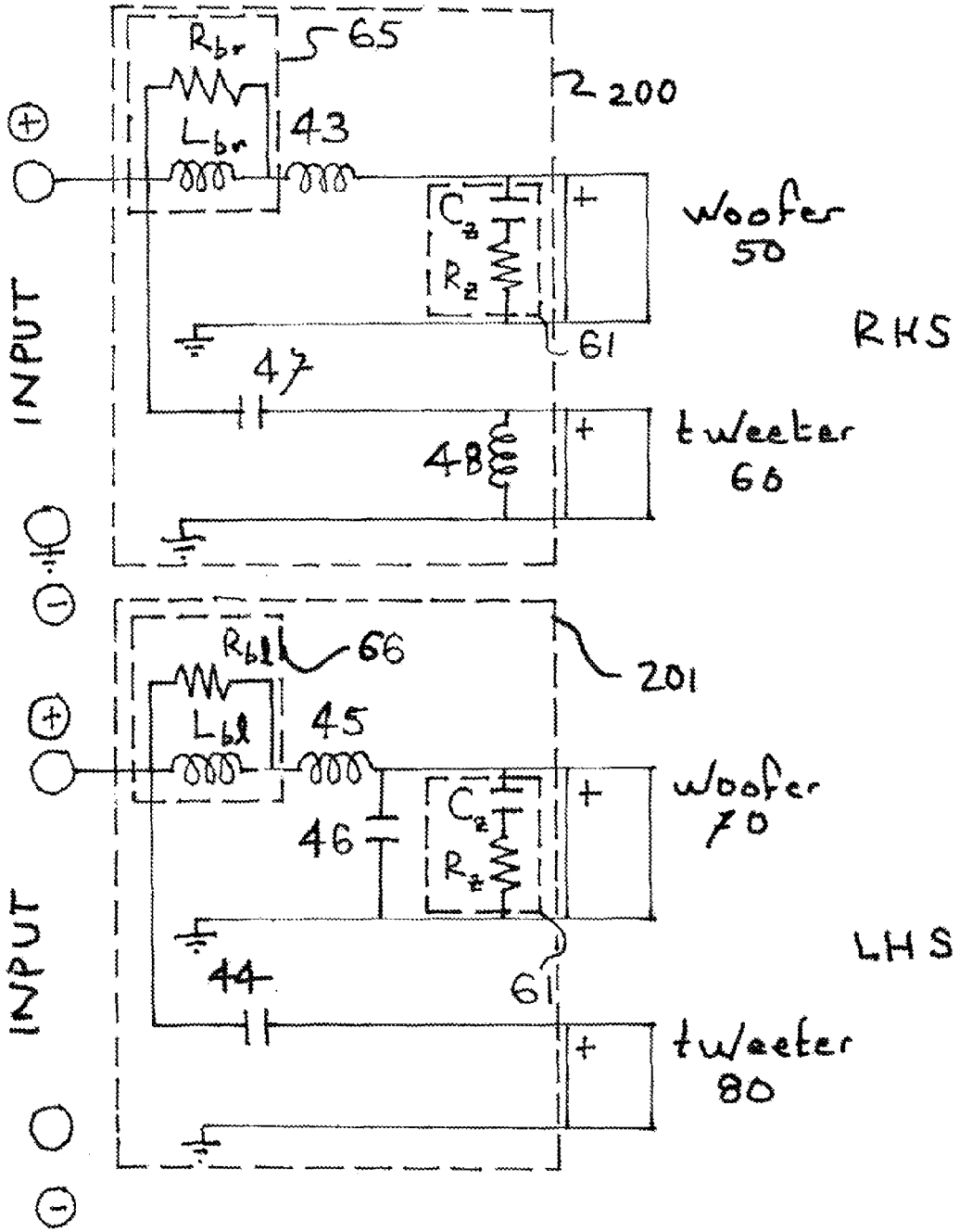
FIG. 12 shows the effective third-order crossover circuit for a two-way loudspeaker system, with RL attenuation and Zobel circuits applied to the woofer, in accordance with the sixth alternative embodiment of the present invention.

The sixth alternative embodiment of the present invention applies an RL circuit to diminish the baffle step response of the woofer (FIG. 12). The frequency for the baffle step depends on the width of the loudspeaker enclosure and is calculated conventionally. At $\nu_b$, the woofer response increases up to 6 dB, to bloat reproduction somewhat. The RL circuit 65 that typically implements baffle-step correction (BSC) consists of an inductor and resistor connected in parallel and is typically applied in series to the woofer before any other crossover elements. The value of the BSC inductor is given by the value of inductor set for one-third of the baffle-step frequency, using the Butterworth equation for a $1^{st}$ order electrical low-pass filter. This filter rolls off high frequencies at 6 dB/octave so that the value of the BSC resistor is given by whatever slope one chooses between 0-6 dB/octave to correct the baffle step. Baffle-step correction is particularly useful for higher crossover orders, a characteristic used to distinguish 65 applied to 50, which consists of BSC inductor $L_{br}$ and BSC resistor $R_{br}$, from 66 applied to 70, which consists of $L_{bl}$ and $R_{bl}$. Low-pass filters with different slopes are often applied to 50 and 70 in a given embodiment of the present art so that the inductor and resistor in 65 and 66 must be selected to optimize frequency response in a given loudspeaker. Baffle-step correction can also be implemented with the shunt C in higher order electrical filters applied to the woofer, applying the Thevenin equivalence (not shown). The shunt capacitor would thus be tuned to $\nu_b/3$, using eq. (3). For example, one would omit 66 from FIG. 12, but would add $R_{bl}$ in series with 46, choosing the value of the attenuating resistor $R_{bl}$ to manifest the BSC slope one has selected. One would tune 46 to $\nu_b/3$ with eq. (3).

Figure 13:
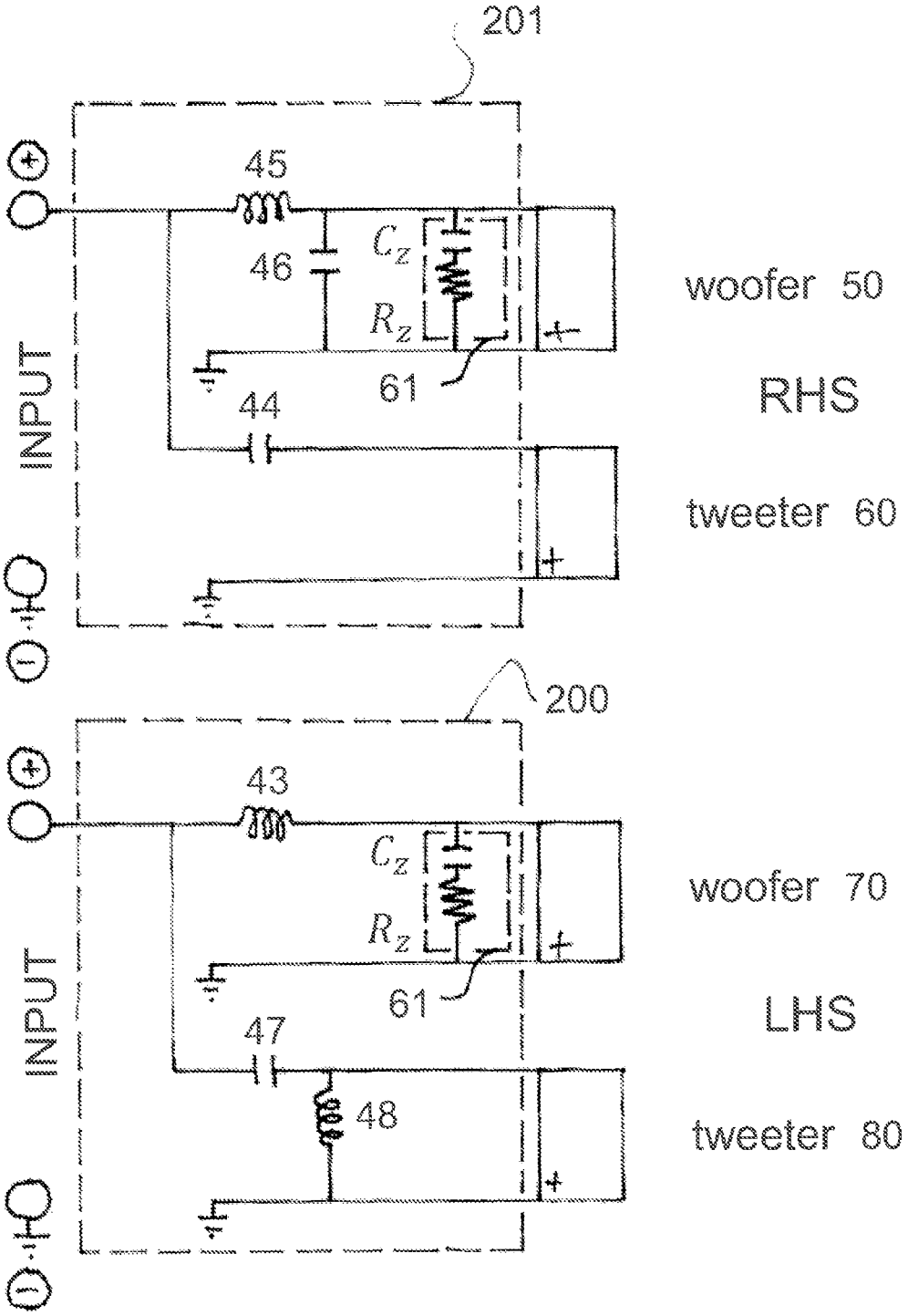
FIG. 13 shows an equivalent effective third-order crossover circuit for a two-way loudspeaker system, with a Zobel circuit applied to the woofer, in accordance with the seventh alternative embodiment of the present invention. Note that the handedness of the electrical crossover circuits has been switched compared to FIGS. 6-12 because the negative terminal of the tweeter is connected to the positive terminal of the power supply.

The seventh alternative embodiment of the present invention reverses the tweeter connections so that the positive terminal of the power supply is connected to the negative terminal of the tweeter to change the handedness so that the asymmetric effective third-order crossover is now applied to the loudspeaker system for the right channel and the symmetric effective third-order crossover to the loudspeaker system for the left channel (FIG. 13). For example, now a first series inductor 45 is connected with RHS woofer 50, which also has a first parallel capacitor 46 ordinarily connected, and a first series capacitor 44 is connected to tweeter 60. Accordingly the right-hand loudspeaker has a $2^{nd}$ order filter applied to the woofer, but a $1^{st}$ order filter applied to the tweeter to fashion an asymmetric effective third-order crossover for a two-way loudspeaker 201. A series circuit of $C_z$ and $R_z$ forms 61, which is applied in parallel to both woofers for impedance correction.

The LHS two-way loudspeaker now has a first series inductor 43 connected to woofer 70 and a first series capacitor 47 is connected to tweeter 80, which also has a first parallel inductor 48 connected. This constitutes a symmetric effective third-order crossover for a two-way loudspeaker 200: namely, a $1^{st}$ order filter has been applied to the woofer, but a $2^{nd}$ order filter has been applied to the tweeter. The circuit shortcuts and auxiliary circuits applied to previous embodiments can be adapted and applied to the seventh alternative embodiment.

Figure 14:
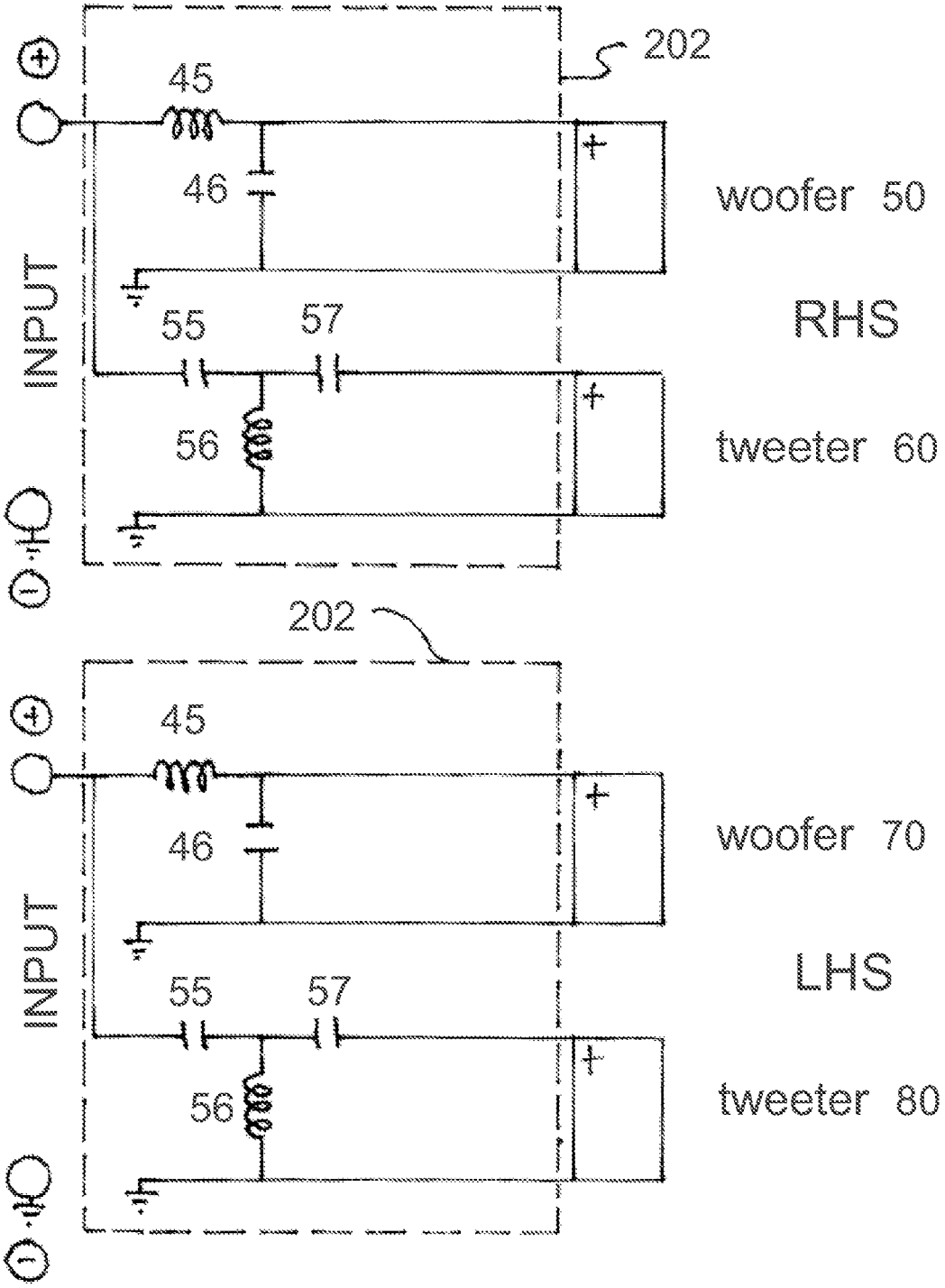
Prior Art Fig. 14
FIG. 14 shows an effective fourth-order crossover circuit for a two-way loudspeaker system in accordance with the prior art.
Figure 15:
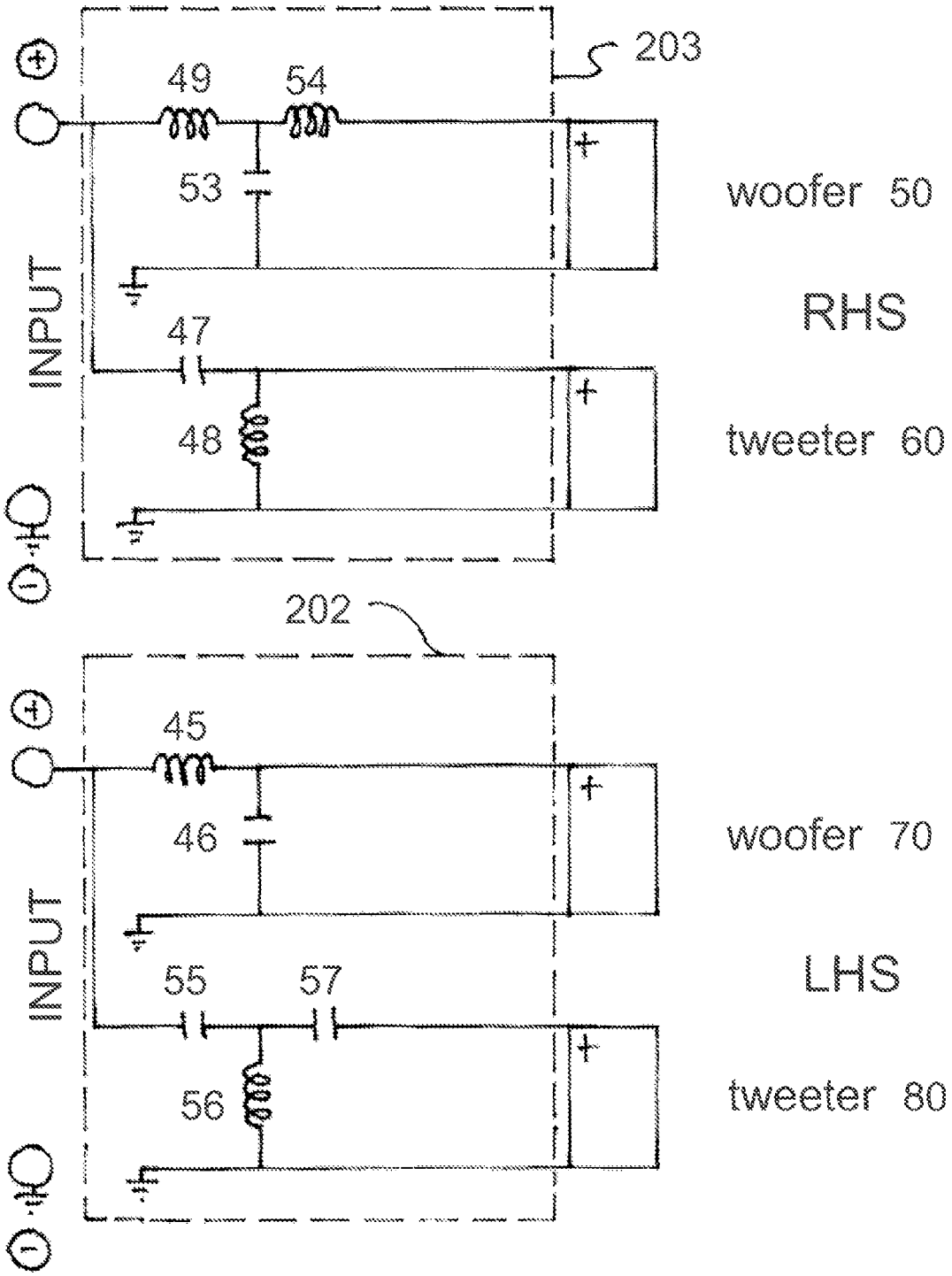
FIG. 15 shows the effective fourth-order crossover circuit for a two-way loudspeaker system, in accordance with the eighth alternative embodiment of the present invention. Note that the handedness of the electrical crossover circuits has been switched compared to FIGS. 7-12 because the crossover is even-ordered.

The handedness changes when the effective crossover orders are even for phase unification. FIG. 14 provides the schematic for an effective fourth-order crossover in the prior art, which applies a $2^{nd}$ order filter to the woofer, but a $3^{rd}$ order filter to the tweeter to constitute a symmetric effective fourth-order crossover for a two-way loudspeaker 202. Accordingly the first inductor connected in series to 50 is 45 and the first capacitor connected in series to 60 is 55. The first capacitor connected in parallel to 50 is 46, the first inductor connected in parallel to 60 is 56 and the second capacitor connected in series to 60 is 57 in 202. In FIG. 14, the crossovers for the RHS and LHS loudspeakers are the same. FIG. 15 provides the schematics for a phase-unified effective fourth-order crossover and the eighth alternative embodiment of the present invention. Therefore the first inductor connected in series to 50 is 49 and the first capacitor connected in series to 60 is 47. The first capacitor connected in parallel to 50 is 53, the second inductor connected in series to 50 is 54 and the first inductor connected in parallel to 60 is 48. This constitutes an asymmetric effective fourth-order crossover for a two-way loudspeaker 203: namely, a $3^{rd}$ order filter has been applied to the woofer, but a $2^{nd}$ order filter has been applied to the tweeter. In addition, the first inductor connected in series to 70 is 45 and the first capacitor connected in series to 80 is 55. The first capacitor connected in parallel to 70 is 46, the first inductor connected in parallel to 80 is 56 and the second capacitor connected in series to 80 is 57 in a symmetric effective fourth-order crossover for a two-way loudspeaker 202. Capacitor and inductor values are calculated according to the conventional equations for designing $2^{nd}$ and $3^{rd}$ order electrical filters (FIGS. 2 and 3 respectively), e.g. Bessel and Butterworth. Again other filter equations can be used to either increase damping (e.g. Linkwitz-Riley) or decrease damping (e.g. Chebychev), as the user deems fit.

Figure 16:
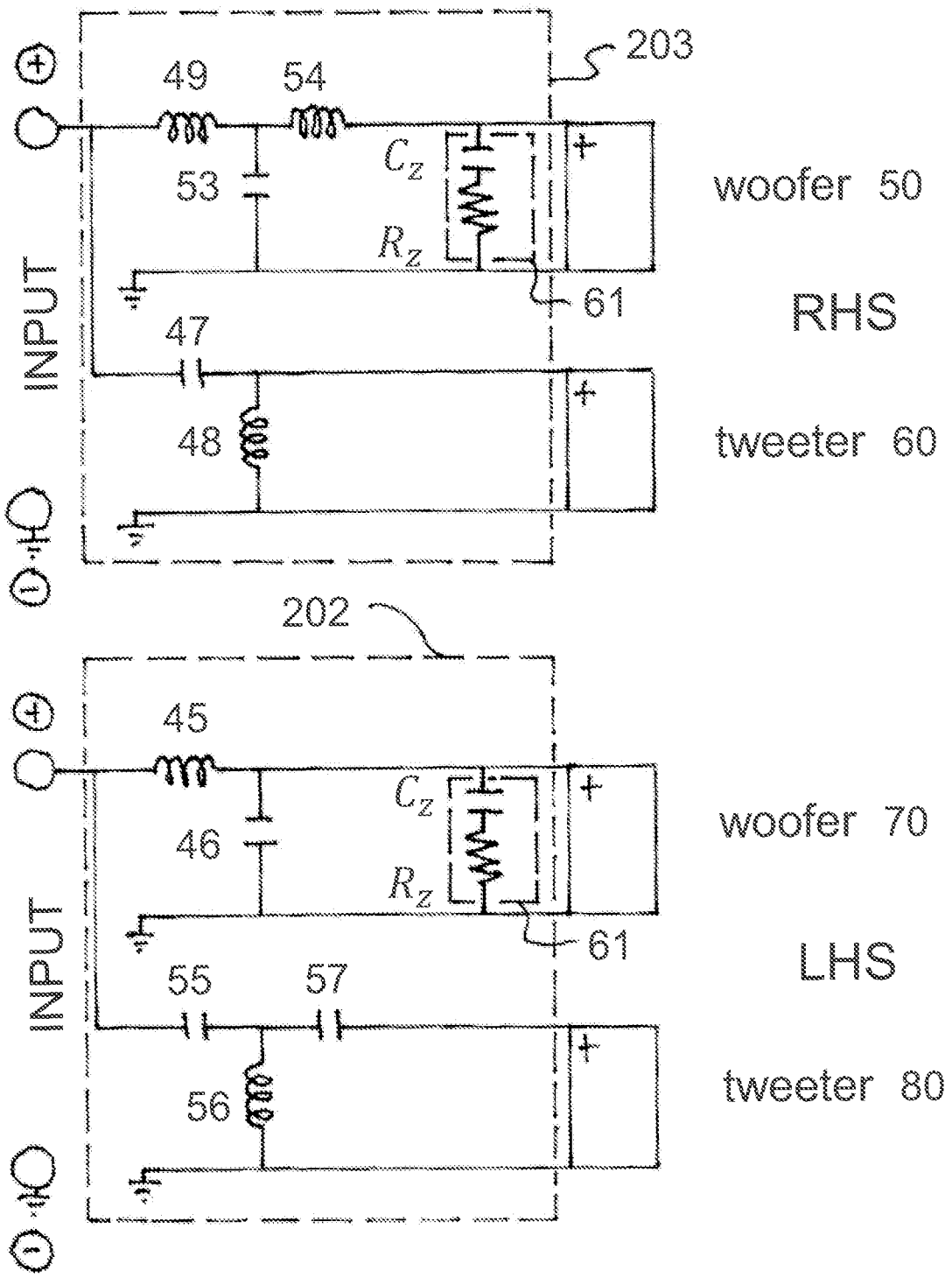
FIG. 16 shows the effective fourth-order crossover circuit for a two-way loudspeaker system, with a Zobel circuit applied to the woofer, in accordance with the ninth alternative embodiment of the present invention.

FIG. 16 portrays the ninth alternative embodiment of the present invention, in which a Zobel circuit 61 is applied to each woofer in a phase-unified loudspeaker system applying an effective fourth-order crossover. The circuit shortcuts and auxiliary circuits applied to previous embodiments can be adapted and applied to the ninth or tenth alternative embodiments, including changing tweeter polarity.

Figure 17:
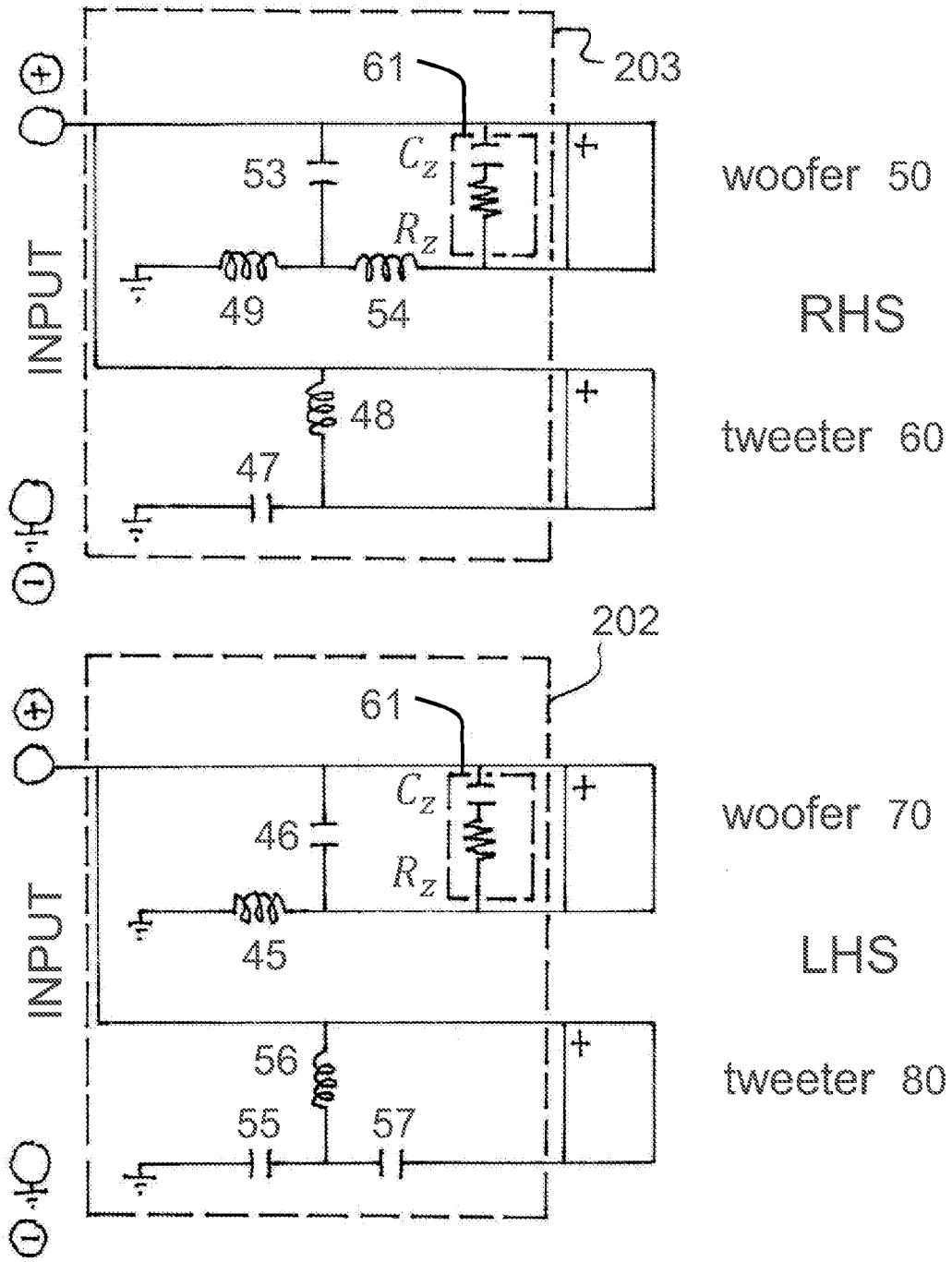
FIG. 17 shows the effective fourth-order crossover circuit for a two-way loudspeaker system, with a Zobel circuit applied to the woofer. Any series C or L is connected to the negative terminal of any driver, in accordance with the tenth alternative embodiment of the present invention.

In the circuit schematics provided thus far, crossover elements connected in series to drivers are ultimately connected to the positive terminal of the amplifier, in accordance with convention, although it is understood that there are phase-unification protocols for crossover elements connected in series to drivers, but connected to the negative terminal of the amplifier. In particular, the handedness rules for a given effective crossover order remain the same to phase-unify reproduction, whether crossover elements connected in series to drivers are connected to the positive or negative terminal of the amplifier. The tenth embodiment in FIG. 17 demonstrates this principle. In FIG. 17, any series C or L is connected to the negative terminal of any driver. Accordingly 49 and 54 are appropriately connected to the negative terminal of 50, 47 to the negative terminal of 60, 45 to the negative terminal of 70 and 55 and 57 are appropriately connected to the negative terminal of 80.

Figure 18:
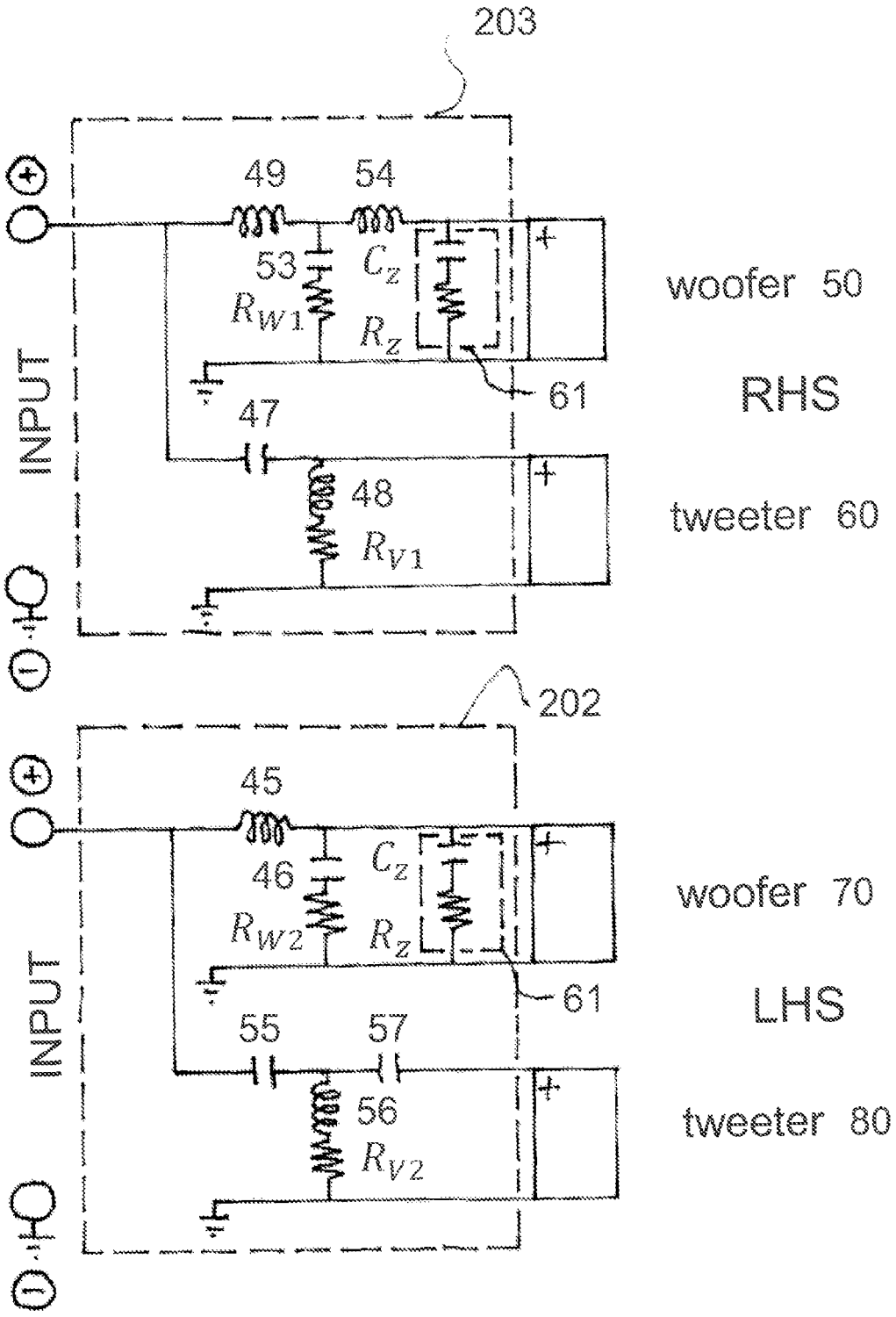
FIG. 18 shows the effective fourth-order crossover circuit for a two-way loudspeaker system, with a Zobel circuit applied to the woofer. Any shunt C or L is connected to an attenuating resistor before being placed parallel to any driver, in accordance with the eleventh alternative embodiment of the present invention.

FIG. 18 provides the eleventh alternative embodiment of the present invention, which uses attenuating resistors, a concept introduced for notch filters or baffle-step correction, to reduce the amount of phase unification nearly continuously. Attenuating resistors are accordingly connected in series to the reactive shunt elements connected in parallel to each driver in the electrical filters applied in FIG. 16. Resistor $R_{w1}$ is thus connected in series to 53, with this RC circuit connected in parallel to 50 as shown in FIG. 18. Furthermore resistor $R_{v1}$ is thus connected in series to 48, with this RL circuit connected in parallel to 60 for the RHS loudspeaker as shown in FIG. 18. One sets $R_{w1}$ equal to the impedance of 50 at $\nu_f$ to attenuate the slope of this RC circuit connected in parallel to 50 from 6 to 3 dB/octave. Similarly one sets $R_{v1}$ equal to the impedance of 60 at $\nu_f$ to attenuate the slope of this RL shunt connected to 60 from 6 to 3 dB/octave. In addition, resistor $R_{w2}$ is thus connected in series to 46, with this RC circuit connected in parallel to 70 for the LHS loudspeaker as shown in FIG. 18. Resistor $R_{v2}$, is also connected in series to 56, with this RL circuit connected in parallel to 80. These concepts can be generalized to apply attenuating resistors in parallel to the reactive series elements connected in series applied to each driver in the electrical filters in FIG. 16, but are not shown. The same woofer is used for 50 and 70; ordinarily the two woofers have the same impedance and $R_{w1}$ equals $R_{w2}$. The same tweeter is used for 60 and 80; ordinarily the two tweeters have the same impedance and $R_{v1}$ equals $R_{v2}$. In the prior art, the value of attenuating resistors is usually limited to tailor the slopes of electrical filters merely 1 or 2 dB/octave. The relationship of $R_{w1}$ to the impedance of 50 should equal the relationship of $R_{v1}$ to the impedance of 60 to attenuate phase unification smoothly. Similar relationships should hold between attenuating resistors connected in parallel to the reactive series elements connected in series applied to a given driver. A reduction of phase unification is not recommended, but is possible in the present art.

Figure 19:
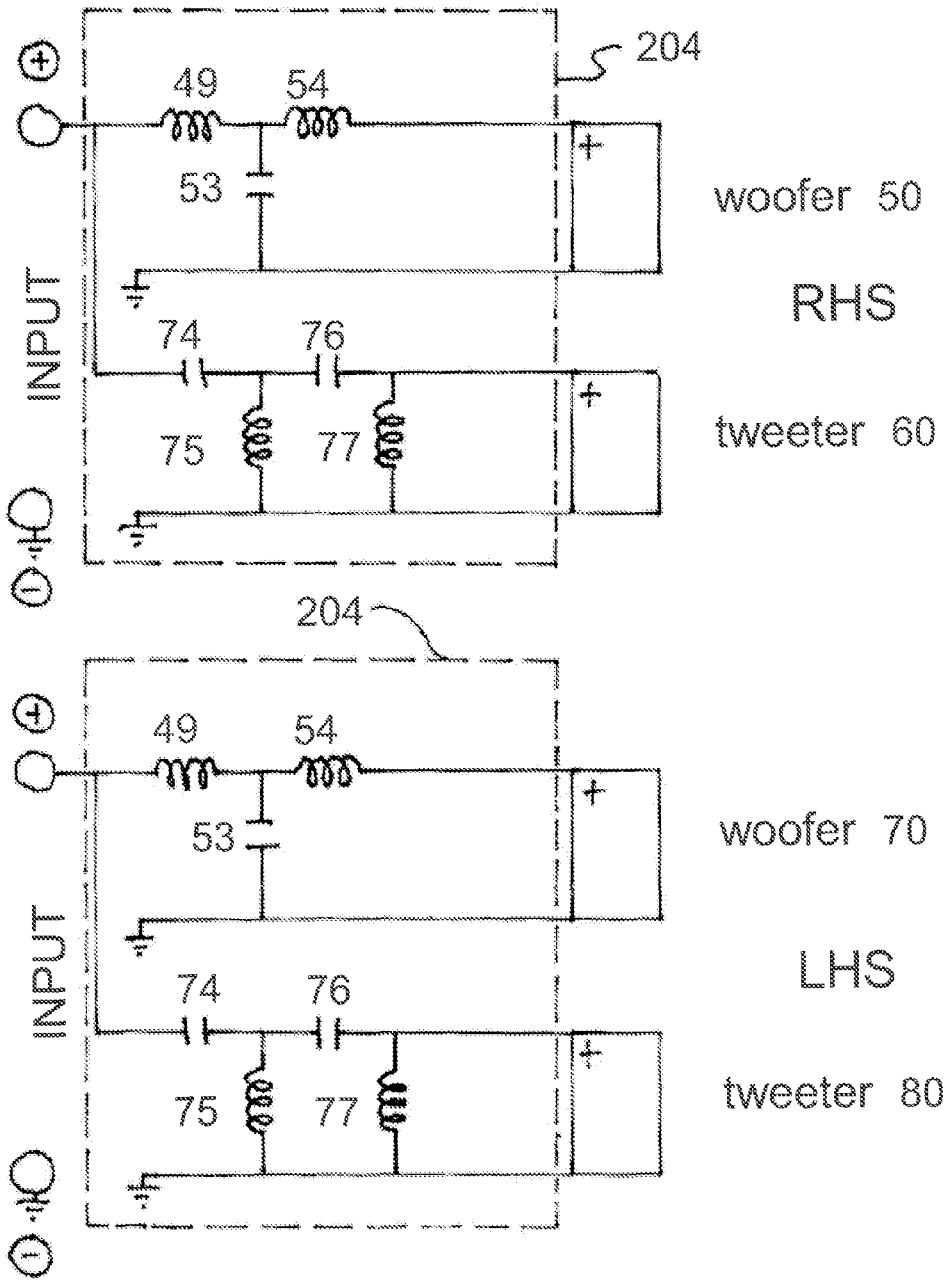
Prior Art Fig. 19
FIG. 19 shows an effective fifth-order crossover circuit for a two-way loudspeaker system in accordance with the prior art.
Figure 20:
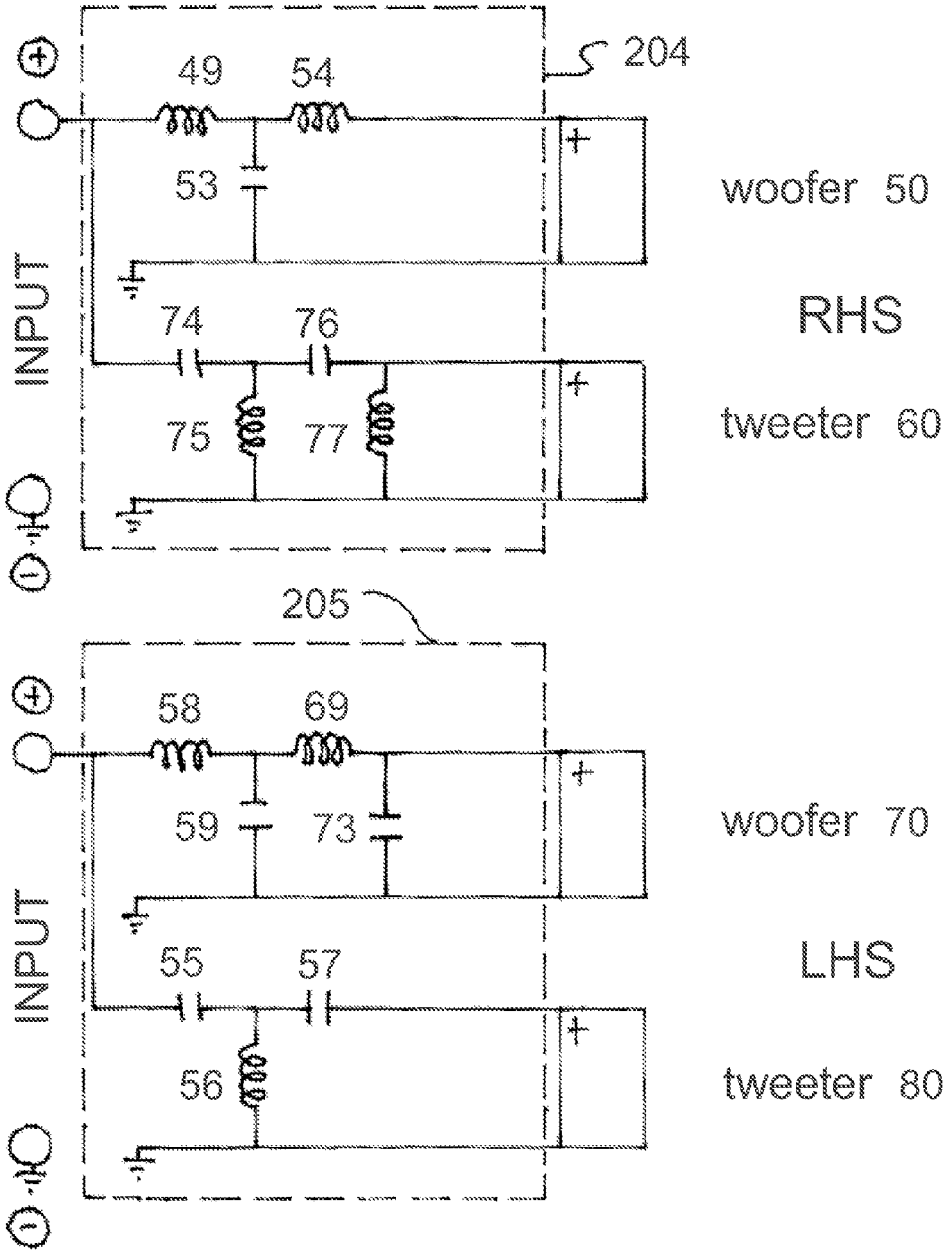
FIG. 20 shows the effective fifth-order crossover circuit for a two-way loudspeaker system, in accordance with the twelfth alternative embodiment of the present invention.
Figure 21:
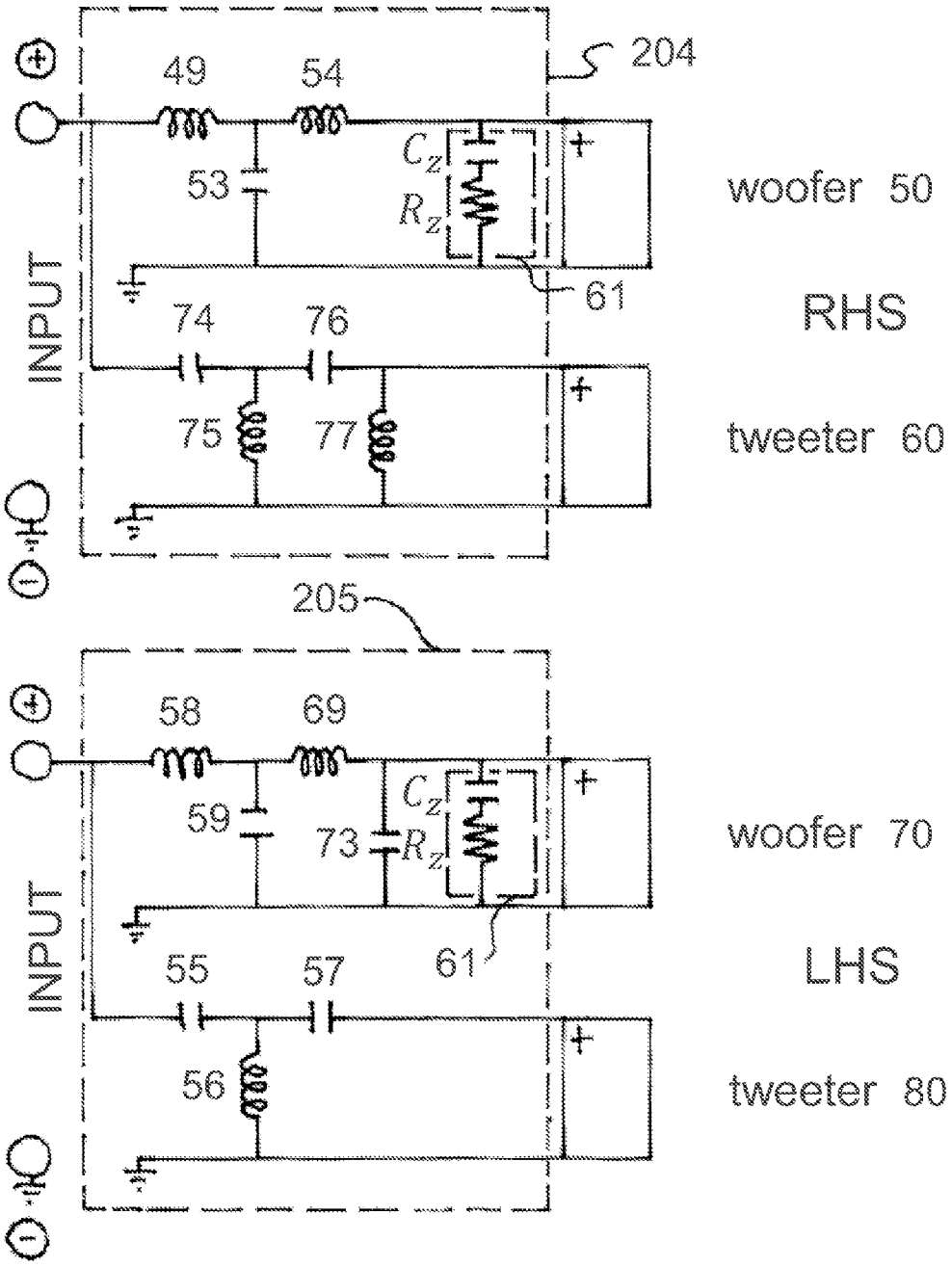
FIG. 21 shows an equivalent effective fifth-order crossover circuit for a two-way loudspeaker system, with a Zobel circuit applied to the woofer, in accordance with an the thirteenth alternative embodiment of the present invention.

The handedness for odd effective crossover orders stays the same to phase-unify loudspeaker reproduction. Accordingly the effective fifth-order crossover on the right-hand loudspeaker remains symmetric, but the effective fifth-order crossover on the left-hand loudspeaker is rendered asymmetric, as described (FIG. 20). FIG. 19 depicts the prior art, wherein an inductor 49 is connected in series with woofer 50, with a capacitor 53 connected in parallel, to be followed by another inductor 54 in series with woofer 50. A capacitor 74 is connected in series with tweeter 60, which has an inductor 75 connected in parallel, followed by another capacitor 76 connected in series with tweeter 60, which is followed by another inductor 77 in series with tweeter 60. This constitutes a symmetric effective fifth-order crossover for a two-way loudspeaker 204: namely, a $3^{rd}$ order filter has been applied to the woofer, but a $4^{th}$ order filter has been applied to the tweeter. To repeat, 49 is the first inductor connected in series, 53 the first capacitor connected in parallel and 54 the second inductor connected in series to 50. To 60, 74 is the first capacitor connected in series, 75 the first inductor connected in parallel, 76 the second capacitor connected in series and 77 the second inductor connected in parallel in a symmetric effective fifth-order crossover for a two-way loudspeaker 204.

A phase-unified effective fifth-order crossover exemplifies the twelfth alternative embodiment of the present invention. The crossover network for the RHS channel is symmetric and is the same as the network that FIG. 19 describes. However, the crossover network for the LHS channel is asymmetric. FIG. 20 consequently describes an inductor 58 connected in series with woofer 70, which has a capacitor 59 connected in parallel, followed by another inductor 69 connected in series to 70, in turn followed by another capacitor 73 connected in parallel. A capacitor 55 is connected in series with tweeter 80, which also has an inductor 56 connected in parallel, followed by another capacitor 57 connected in series with tweeter 80. Accordingly the left-hand loudspeaker has a $4^{th}$ order filter applied to the woofer, but a $3^{rd}$ order filter applied to the tweeter. To repeat, 58 is the first inductor connected in series, 59 the first capacitor connected in parallel, 69 the second inductor connected in series and 73 the second capacitor connected in parallel to 70. To 80, 55 is the first capacitor connected in series, 56 the first inductor connected in parallel and 57 the second capacitor connected in series in an asymmetric effective fifth-order crossover for a two-way loudspeaker 205.

The application of woofer Zobels often facilitates phase-unification (FIG. 21) and comprises the thirteenth alternative embodiment of the present invention. The woofer Zobels are unneeded when the Zobel and shunt capacitors are similar in value, as previously described. The baffle step can be corrected by suitably increasing the value of the $1^{st}$ inductor in series with each woofer, attenuating the roll off slope as previously described. Capacitor and inductor values are calculated according to the conventional equations for designing $3^{rd}$ and $4^{th}$ order electrical filters (FIGS. 3 and 4 respectively), e.g. Bessel and Butterworth. The circuit shortcuts and auxiliary circuits applied to previous embodiments can be adapted and applied to the eleventh, twelfth or thirteenth alternative embodiments, including changing tweeter polarity. Thevenin equivalences apply.

An effective second-order version of the present art is available (not shown), but has very limited applications. In its sparest form, this alternative embodiment has a simple crossover for either the RHS or LHS two-way loudspeaker, here depicted when the negative terminal of the tweeter is connected to the negative terminal of the power supply for each channel. For example, eq. (3) determines the value of a first capacitor connected in series to 80 in the LHS loudspeaker to form a symmetric effective second-order crossover network: namely, no filter has been applied to the woofer, but a $1^{st}$ order filter has been applied to the tweeter. In addition, eq. (4) determines the value of a first inductor connected in series to 50 in the RHS loudspeaker to form an asymmetric effective second-order crossover network: namely, a $1^{st}$ order filter has been applied to the woofer, but no filter has been applied to the tweeter. The asymmetric effective second-order crossover network reveals one of the major limitations on this alternative embodiment. Unfiltered tweeters used in high-fidelity loudspeakers, by and large, have severely limited power-handling, a major rationale for tweeter filters. Outstanding power-handling for an unfiltered tweeter is 10 W. However high-fidelity loudspeakers can handle upwards of 200 W depending on the application so that this embodiment ordinarily cannot play very loud.

Other limitations on this embodiment include severe restrictions on woofer and tweeter properties. For instance, this alternative embodiment uses filters to determine the rolloff slope, not $\nu_x$. Accordingly the natural rolloff of the woofer and tweeter selected to implement this embodiment typically need to occur at a frequency close to $\nu_x$ to provide flat frequency response and accurate reproduction. Auxiliary circuits or Thevenin equivalences can be used with this alternative embodiment to form more alternative embodiments. Midranges and other drivers can be incorporated to form N-way loudspeakers and develop still more alternative embodiments.

A loudspeaker designer can nonetheless introduce lobing into the VPR of a loudspeaker with the improper application of auxiliary circuits into the crossover. Care must therefore be taken to diminish such lobing. Accordingly it is recommended that if a given auxiliary circuit, e.g. a notch filter, is applied to a RHS driver, then the same auxiliary circuit is applied to the same LHS driver. Possible exceptions include Zobels, twister and occasionally BSC circuits. For instance, if the shunt capacitor is nearly equal to $C_z$, the Zobel can be eliminated as aforementioned. If a twister circuit is applied to a given $\nu_x$, more care is demanded that this $\nu_x$ for the RHS and LHS is nearly equal.

Three-Way to N-Way Phase-Unified Loudspeakers with Passive Crossovers

Figure 22:
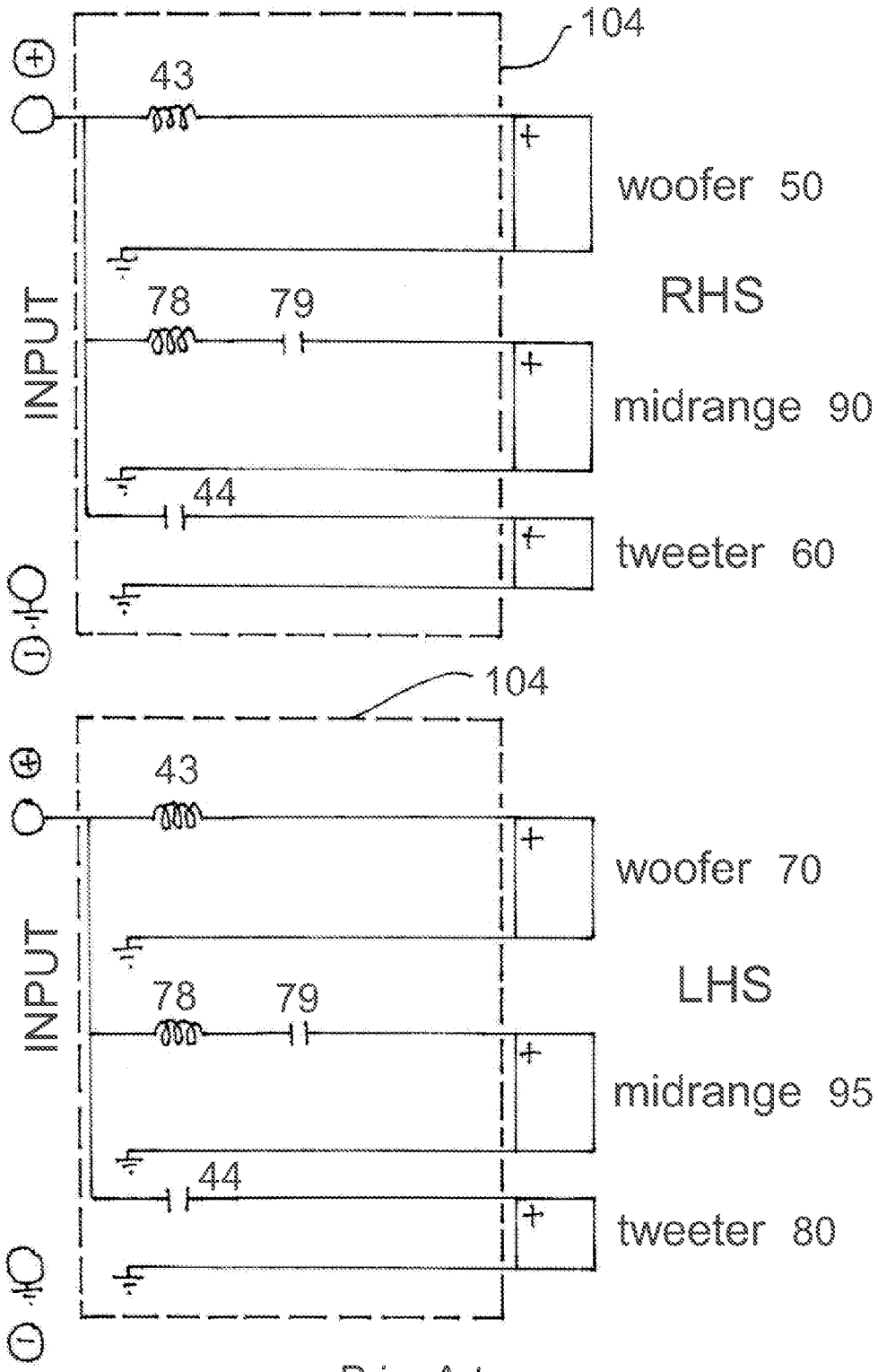
Prior Art Fig. 22
FIG. 22 shows a $1^{st}$ order crossover electrical circuit for a three-way loudspeaker system in accordance with the prior art.
Figure 23:
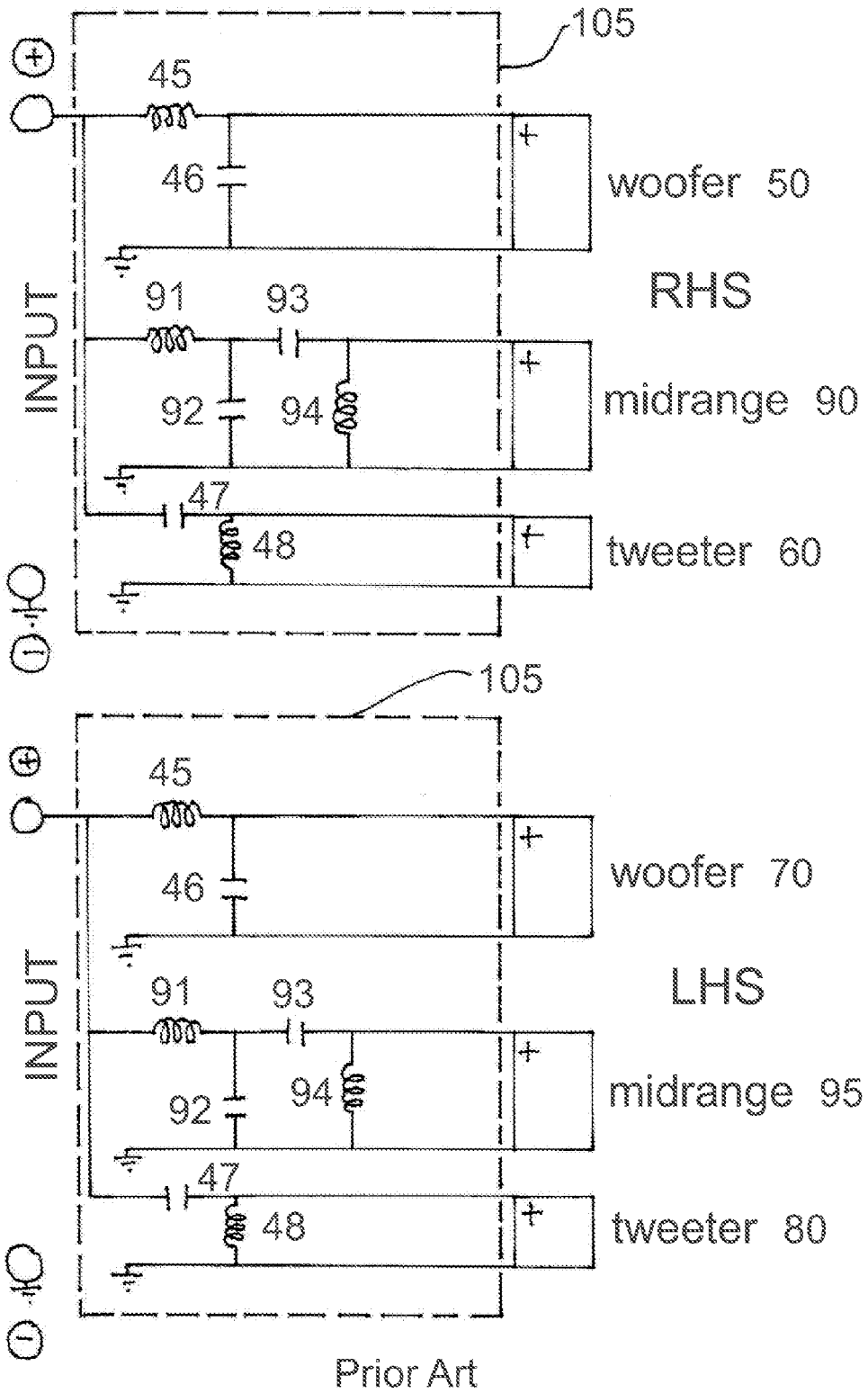
Prior Art Fig. 23
FIG. 23 shows a $2^{nd}$ order crossover electrical circuit for a three-way loudspeaker system in accordance with the prior art.

FIGS. 22 and 23 depict $1^{st}$ and $2^{nd}$ order electrical crossover networks respectively for three-way loudspeakers in the prior art. In three-ways or loudspeakers with an even higher number of drivers, unfiltered midranges typically rolloff high frequencies at 12 dB/octave, but typically rolloff low frequencies at 6 dB/octave. These are the rolloff characteristics of any driver to which separate filters for high and low frequencies respectively are applied. In FIG. 22, the first inductor connected in series to 50 is 43 and the first capacitor connected in series to 60 is 44 in a $1^{st}$ order electrical crossover for a three-way loudspeaker 104. In addition, the first inductor connected in series to midrange 90 is 78 and the first capacitor connected in series to 90 is 79 to apply a bandpass filter to 90. The RHS crossover circuit is the same as the LHS crossover circuit. In FIG. 23, the first inductor connected in series to 50 is 45 and the first capacitor connected in parallel to 50 is 46. The first inductor connected in series to midrange 90 is 91 and the first capacitor connected in parallel to 90 is 92. The first capacitor connected in series to 90 is 93 and the first inductor connected in parallel to 90 is 94. The first capacitor connected in series to 60 is 47 and the first inductor connected in parallel to 60 is 48 all in a $2^{nd}$ order electrical crossover for a three-way loudspeaker 105. In FIG. 23, the RHS crossover circuit is also the same as the LHS crossover circuit.

Figure 24:
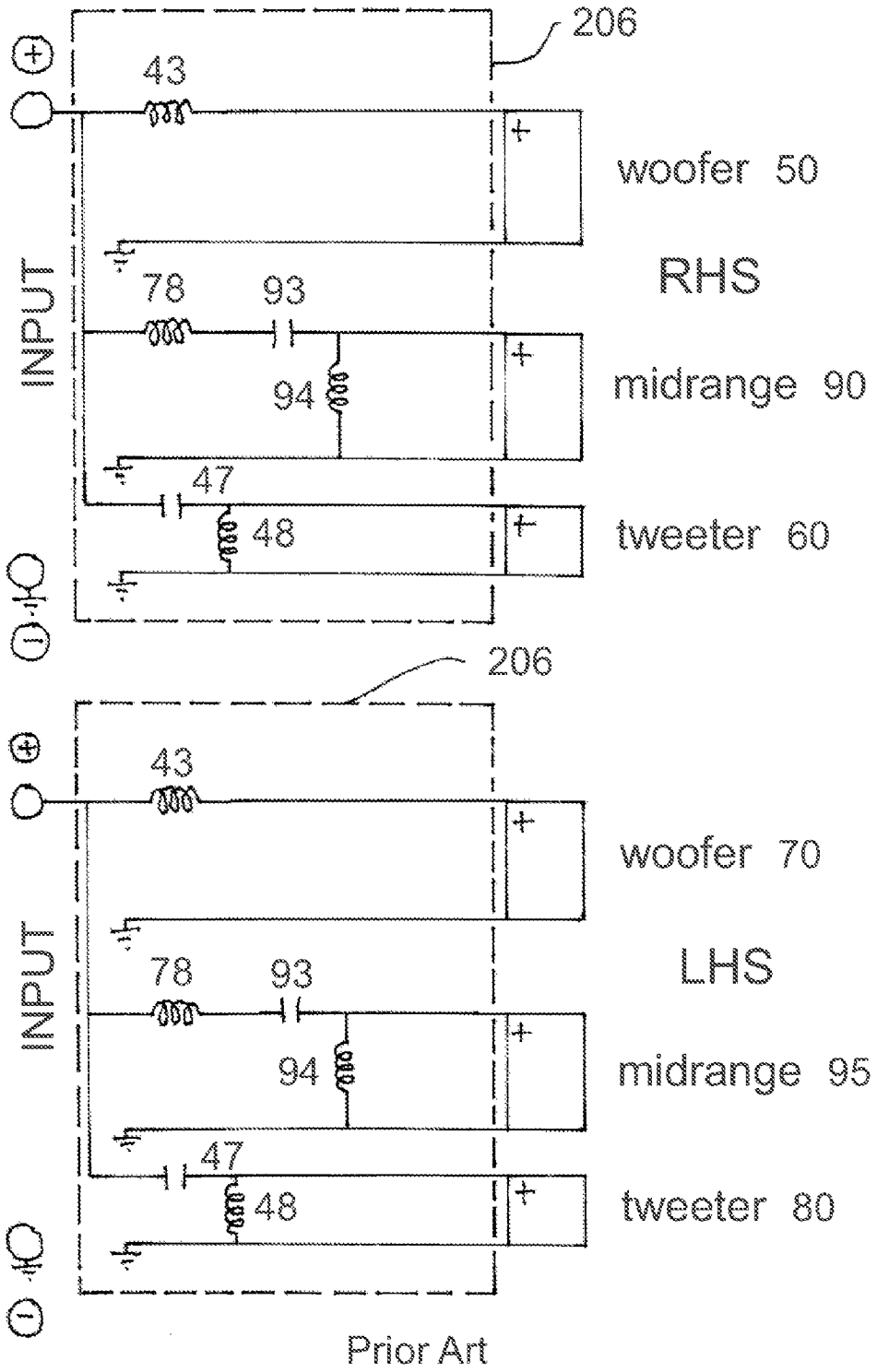
Prior Art Fig. 24
FIG. 24 shows the effective third-order crossover circuit for a three-way loudspeaker system, in accordance with the prior art.

FIG. 24 depicts the effective third-order crossover network for three-way loudspeakers according to the prior art. Accordingly an inductor 43 is connected in series with woofer 50; an inductor 78 and a capacitor 93 are connected in series with midrange 90, which also has an inductor 94 connected in parallel; and a capacitor 47 is connected in series with tweeter 60, which also has an inductor 48 connected in parallel with it. This constitutes a symmetric effective third-order crossover for a three-way loudspeaker 206: namely, a $1^{st}$ order filter has been applied to the woofer, but a $2^{nd}$ order filter has been applied to the tweeter. In addition, a $1^{st}$ order filter has been applied to the midrange to rolloff the high frequencies, and a $2^{nd}$ order filter has been applied to the midrange to attenuate the low frequencies. To repeat, FIG. 22 therefore shows a first series inductor 43 connected to woofer 50. The first inductor connected in series to midrange 90 is 78, the first capacitor connected in series to 90 is 93 and the first inductor connected in parallel to 90 is 94. To complete 206, the first capacitor connected in series to tweeter 60 is 47 and the first inductor connected in parallel to 60 is 48. The RHS crossover circuit is the same as the LHS crossover circuit.

Figure 25:
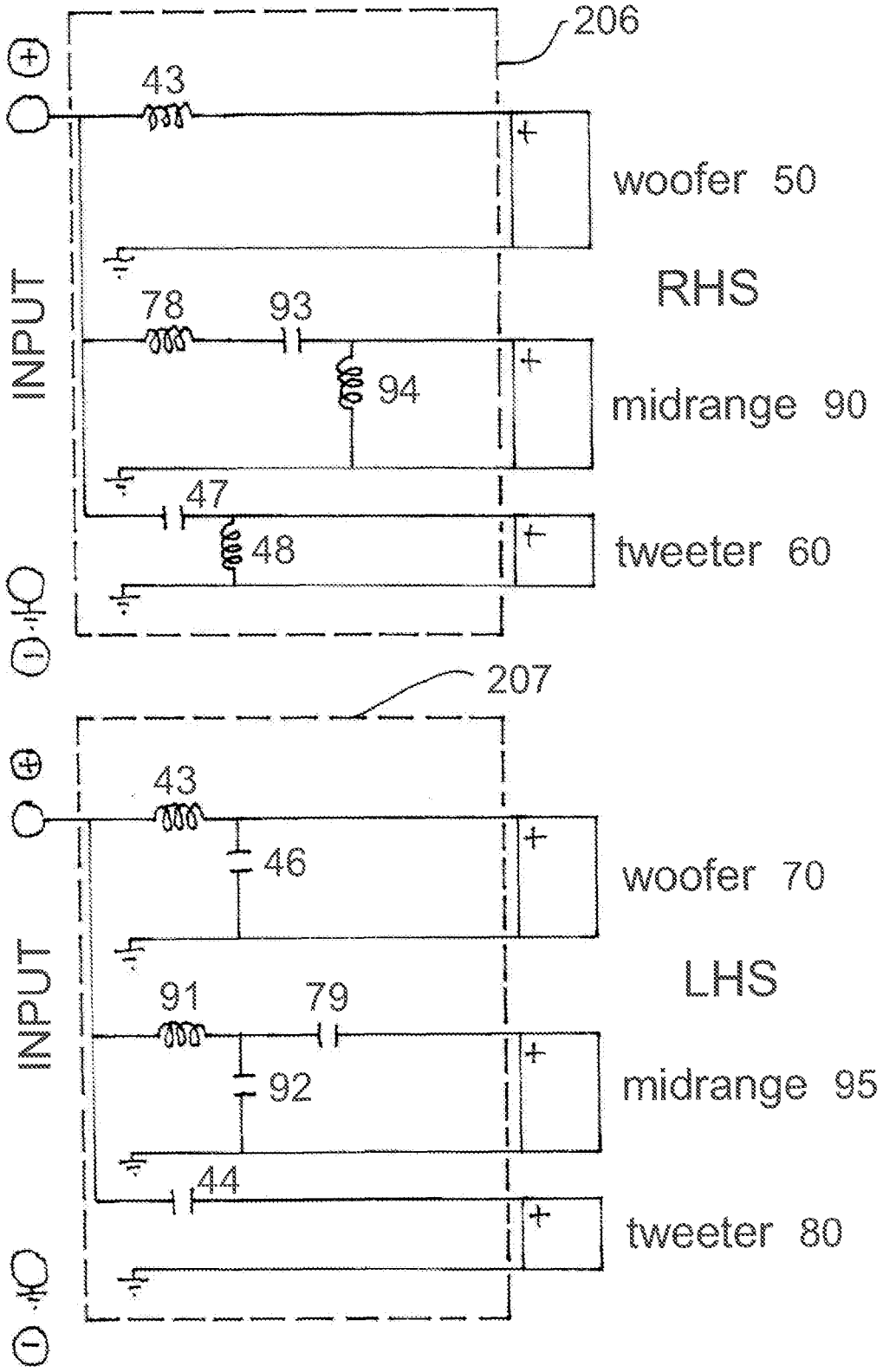
FIG. 25 shows the effective third-order crossover circuit for a three-way loudspeaker system, in accordance with the fourteenth alternative embodiment of the present invention.

FIG. 25 depicts a phase-unified effective third-order crossover network for three-way loudspeakers according to the fourteenth alternative embodiment of the present invention. The right channel has the same crossover circuit as FIG. 24, but the crossover circuit for the left channel differs. As a consequence, a first series inductor 45 is connected to woofer 70 and a first parallel capacitor 46 is connected. The first inductor connected in series to midrange 95 is 91, the first capacitor connected in series to 95 is 79 and the first capacitor connected in parallel to 95 is 92. The first capacitor connected in series to tweeter 80 is 44. This constitutes an asymmetric effective third-order crossover for a three-way loudspeaker 207. A $2^{nd}$ order filter has been applied to the woofer, but a $1^{st}$ order filter has been applied to the tweeter. In addition, a $2^{nd}$ order filter has been applied to the midrange to rolloff the high frequencies, and a $1^{st}$ order filter has been applied to the midrange to attenuate the low frequencies. For the RHS loudspeaker, FIG. 25 shows a first series inductor 43 connected to woofer 50. The first inductor connected in series to 90 is 78, the first capacitor connected in series to 90 is 93 and the first inductor connected in parallel to 90 is 94. To complete the symmetric effective third-order crossover for a three-way loudspeaker 206, the first capacitor connected in series to 60 is 47 and the first inductor connected in parallel to 60 is 48.

Figure 26:
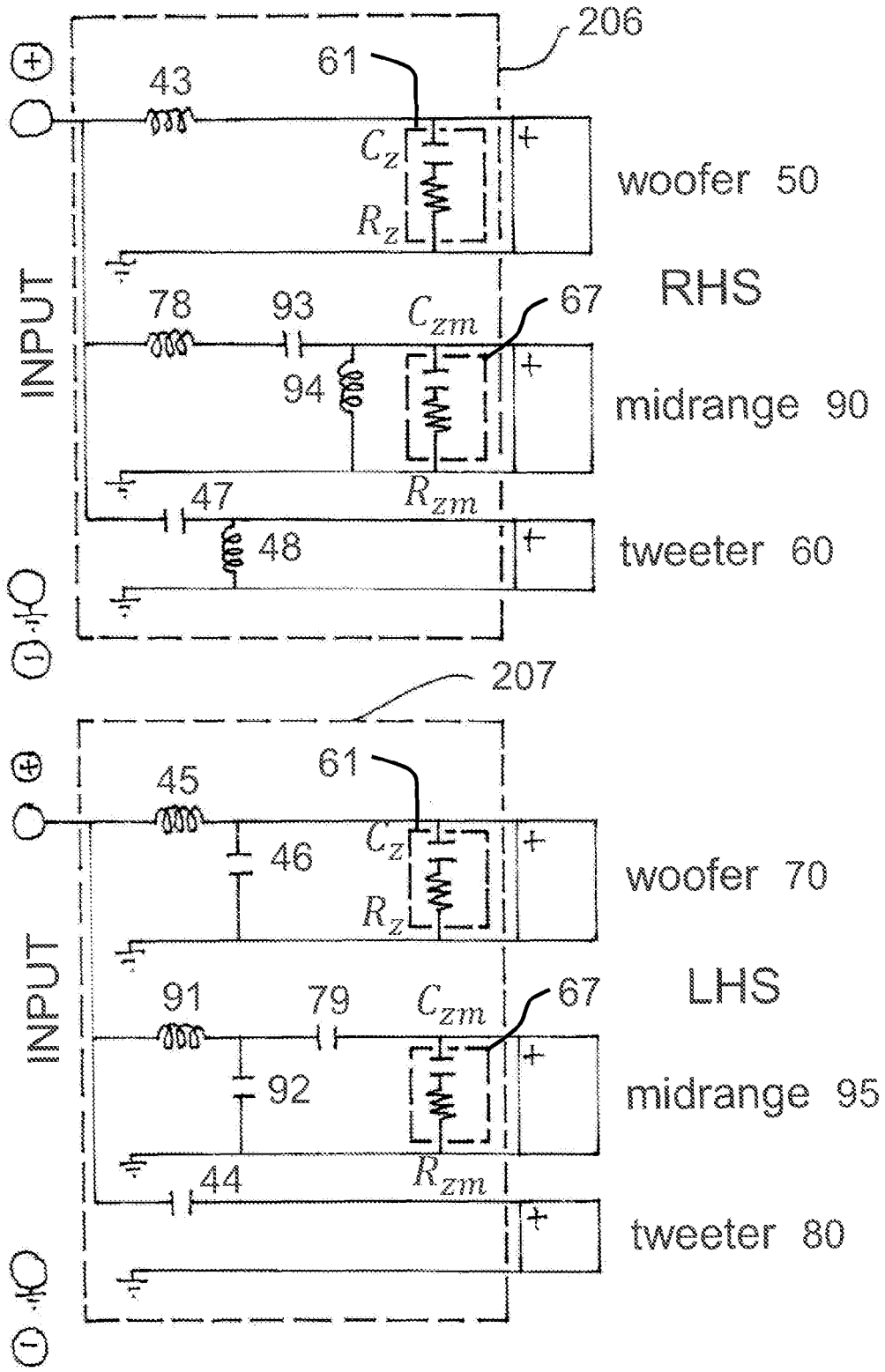
FIG. 26 shows the effective third-order crossover circuit for a three-way loudspeaker system, with a Zobel circuit applied to the woofer and one applied to the midrange, in accordance with the fifteenth alternative embodiment of the present invention.

Applying Zobel circuits to the woofers and midranges often improves the efficacy of phase-unification and furnishes the fifteenth alternative embodiment of the present invention (FIG. 26). The voice coil inductance and DC resistance of the midrange differ from those of the woofer such that the values of the capacitor $C_{zm}$ and resistor $R_{zm}$ that form the midrange Zobel circuit 67 typically differ from $C_z$ and $R_z$. The capacitor $C_{zm}$ and resistor $R_{zm}$ are connected in series to form 67, which is connected in parallel with midrange 90 and similarly connected to midrange 95.

Figure 27:
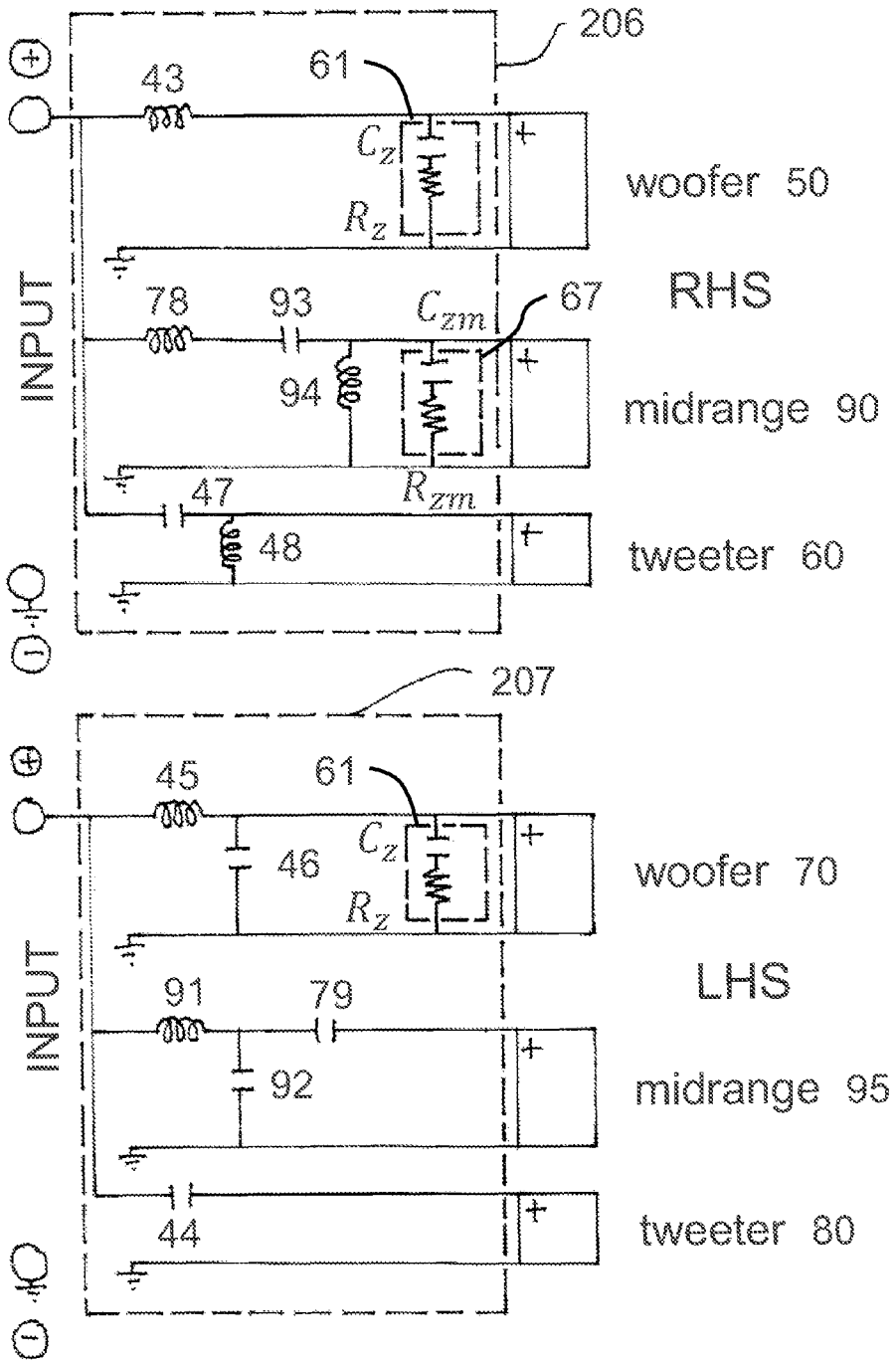
FIG. 27 shows the effective third-order crossover circuit for a three-way loudspeaker system, with a Zobel circuit applied to the woofer, one applied to the midrange and because the Zobel capacitor is redundant with the shunt C, the former omitted on the LHS midrange, in accordance with the sixteenth alternative embodiment of the present invention.
Figure 28:
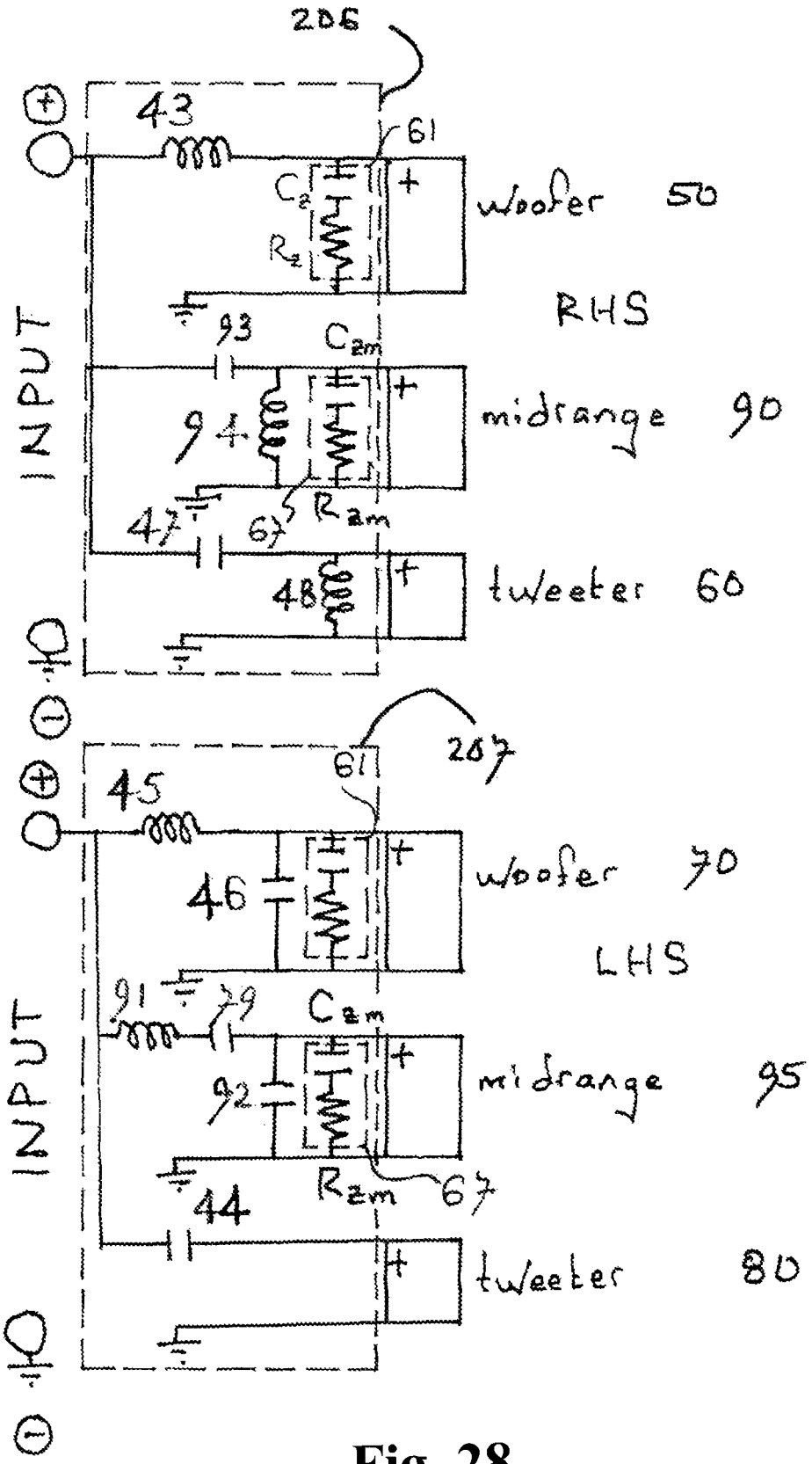
FIG. 28 shows the effective third-order crossover circuit for a three-way loudspeaker system, with a Zobel circuit applied to the woofer, one applied to the midrange and because it is redundant with the Zobel capacitor, the series L omitted on the RHS midrange, in accordance with the seventeenth alternative embodiment of the present invention.

FIG. 27 shows that if the Zobel and shunt capacitors for the LHS midrange are similar in value, the Zobel can be omitted, to provide the sixteenth alternative embodiment of the present invention. The seventeenth alternative embodiment of the present invention also includes a circuit shortcut, and FIG. 28 shows that if the Zobel capacitor and series inductor for the RHS midrange are tuned to a similar frequency, the series inductor can often be omitted. The circuit shortcuts and auxiliary circuits applied to previous embodiments can be adapted and applied to the fifteenth, sixteenth or seventeenth alternative embodiments to develop more alternative embodiments, including changing tweeter polarity. Thevenin equivalences apply. The previous ideas and figures should also enable one to develop and modify effective third-, fourth-, fifth-, sixth-, etc. order crossover networks for two-, three-, fourth-, fifth-, etc. way loudspeakers in accordance with previous embodiments of the present invention.

Figure 29:
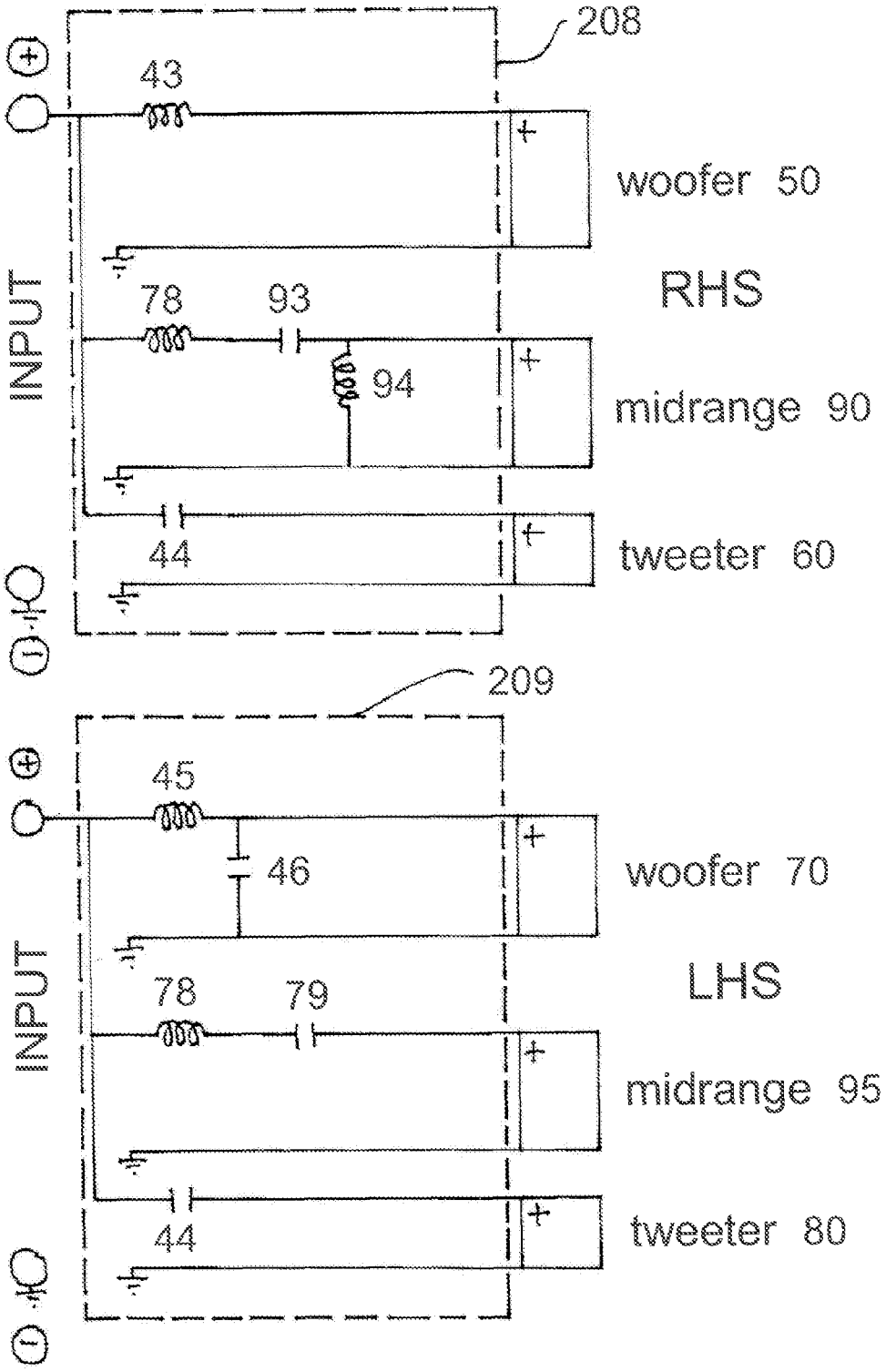
FIG. 29 shows the effective third-order crossover circuit for a three-way loudspeaker system, with the crossover between the woofer and midrange in accordance with present invention to constitute the eighteenth alternative embodiment thereof. The crossover between either midrange and tweeter is in accordance with prior art, here $1^{st}$ order electrical for the sake of simplicity.
Figure 30:
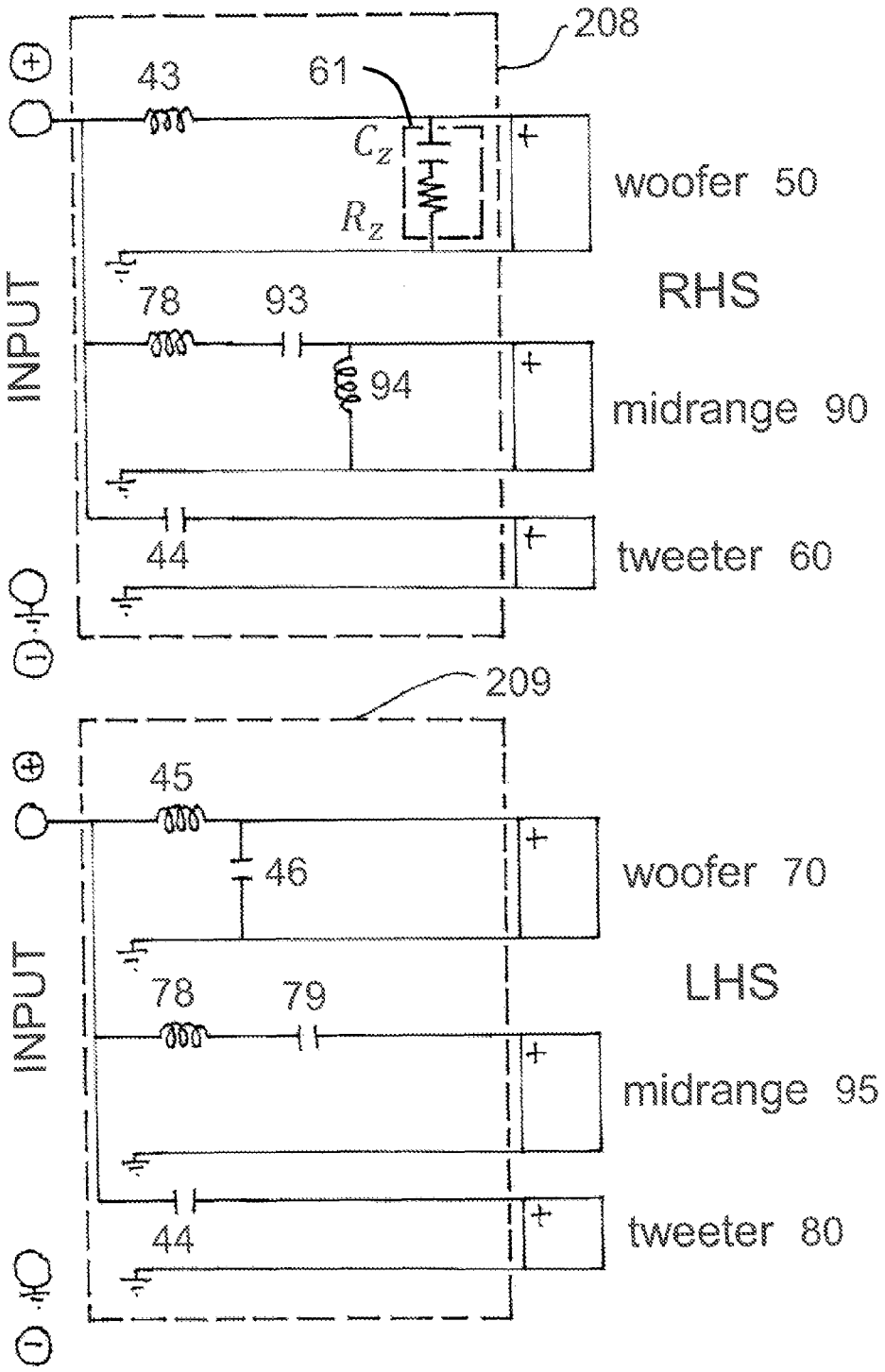
FIG. 30 shows the effective third-order crossover circuit for a three-way loudspeaker system, with the crossover between the woofer and midrange in accordance with present invention to constitute the nineteenth alternative embodiment thereof. A Zobel circuit is applied to the woofer and because the Zobel capacitor is redundant with the shunt C, the Zobel capacitor is omitted on the LHS woofer. The crossover between either midrange and tweeter is in accordance with prior art, here $1^{st}$ order electrical for the sake of simplicity.
Figure 31:
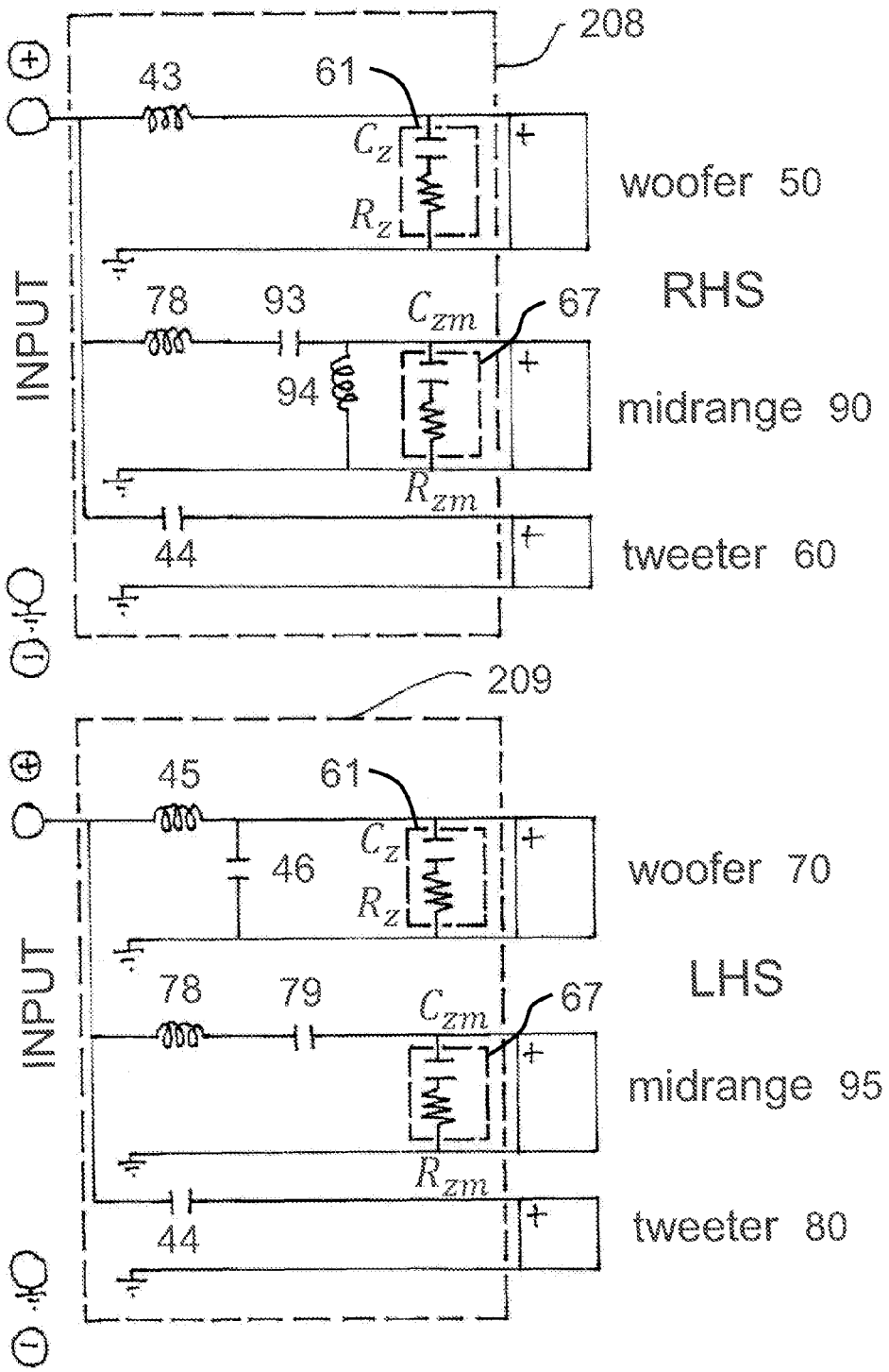
FIG. 31 shows the effective third-order crossover circuit for a three-way loudspeaker system, with the crossover between the midrange and tweeter in accordance with present invention to constitute the twentieth alternative embodiment thereof. Zobel circuits are applied to the midrange and woofer. The crossover between either midrange and tweeter is in accordance with prior art, here $1^{st}$ order electrical for the sake of simplicity.

Sometimes the present art need only be applied to one crossover frequency in a loudspeaker system with more than two drivers to improve reproduction considerably. FIGS. 29-31 demonstrate this concept in a three-way system. In FIG. 29, the woofer to midrange filters are phase-unified, but the midrange to tweeter filters are not, to form the eighteenth alternative embodiment of the present invention. For the RHS loudspeaker, accordingly a first series inductor 43 is connected to woofer 50. The first inductor connected in series to 90 is 78, the first capacitor connected in series to 90 is 93 and the first inductor connected in parallel to 90 is 94. The first capacitor connected in series to 60 is 44 all to form a symmetric effective third-order crossover between two drivers 208 in a three-way loudspeaker. The notation 208 is used to distinguish FIGS. 29-31 from 200 which only depicts a two-way loudspeaker. Similarly the notation 209 is used to distinguish FIGS. 29-31 from 201. In the left channel, the first series inductor connected to woofer 70 is 45 and the first capacitor connected in parallel to 70 is 46. The first inductor connected in series to 95 is 78 and the first capacitor connected in series to 95 is 79. The first capacitor connected in series to 80 is 44 all to form an asymmetric effective third-order crossover between two drivers 209 in a three-way loudspeaker. Accordingly the crossover frequency between the woofer and midrange in FIG. 29 can also be called the "phase-unification frequency". First order electrical filters are recommended for crossover frequencies other than the phase-unification frequency to minimize untoward phase effects. First order electrical filters are applied between the midrange and tweeter in FIGS. 29-31. Though $1^{st}$ order electrical filters are not necessary, they can diminish the lobing encountered with even order crossovers.

FIGS. 30 and 31 implement the aforementioned impedance-compensation circuits and combinations with this simplification to provide additional alternative embodiments of the present invention. For instance, the nineteenth alternative embodiment applies 61 to the RHS woofer, but not to the LHS woofer, which omits 61 because the shunt and Zobel capacitors are similar in value (FIG. 30). In addition, the twentieth alternative embodiment applies 67 to each midrange (FIG. 31). The aforementioned shortcuts and auxiliary circuits can be applied to the nineteenth and twentieth alternative embodiments to develop still more alternative embodiments. Phase-unification of merely one crossover frequency among multiple crossover frequencies is made more effective when the present art is applied to a crossover frequency in the range of about 500 to 2000 Hz, as expected because these are the frequencies wherein the baffle step typically develops. At lower frequencies, loudspeaker output is essentially omnidirectional. However, when the baffle step starts, loudspeaker output becomes confined to the hemisphere in front of the loudspeaker and manifests lobing behavior. This principle can be extended to loudspeakers with higher crossover orders, three or more drivers, and greater than one phase-unification frequency.

Drivers performing at the frequency extremes of the audio spectrum exhibit nearly ideal polar response in a loudspeaker system. Thus the present invention improves reproduction when only applied to one crossover point in a loudspeaker system with more than two drivers. The baffle step introduces significant lobing into the polar response of a driver manifesting the baffle step. However, in a loudspeaker, the woofer has nearly perfect polar response well below the baffle step and the tweeter has nearly perfect polar response for the uppermost two octaves, far removed from the baffle step. Accordingly an N-way loudspeaker with $\nu_f$ for the woofer or tweeter well-removed from $\nu_b$ would nonetheless phase-unify reproduction as long as phase-unification technology is applied to the $\nu_x$ nearest to $\nu_b$.

Different effective crossover orders will phase-unify to some extent if the orders are both odd or both even. Furthermore this relationship can hold even if the right-hand side and left-hand side loudspeakers have different numbers of drivers. For instance, an effective fifth-order two-way RHS system (RHS from FIG. 21) will phase-unify to some extent with an effective third-order three-way LHS system (LHS from FIG. 26). In fact, an effective fifth-order two-way RHS system (RHS from FIG. 21) will phase-unify to some extent with an effective third-order three-way LHS system with only the midrange-woofer crossover configured according to the present art (LHS from FIG. 30). Effective fourth-, fifth-, sixth-, etc. order three-way systems can be designed accordingly as well as fourth-, fifth-, sixth-, etc. way versions of the aforementioned systems to produce still additional alternative embodiments, particularly considering the addition of auxiliary circuits and the incorporation of circuit shortcuts.

2.5-Way to N.5-Way Phase-Unified Loudspeakers with Passive Crossovers

Figure 32:
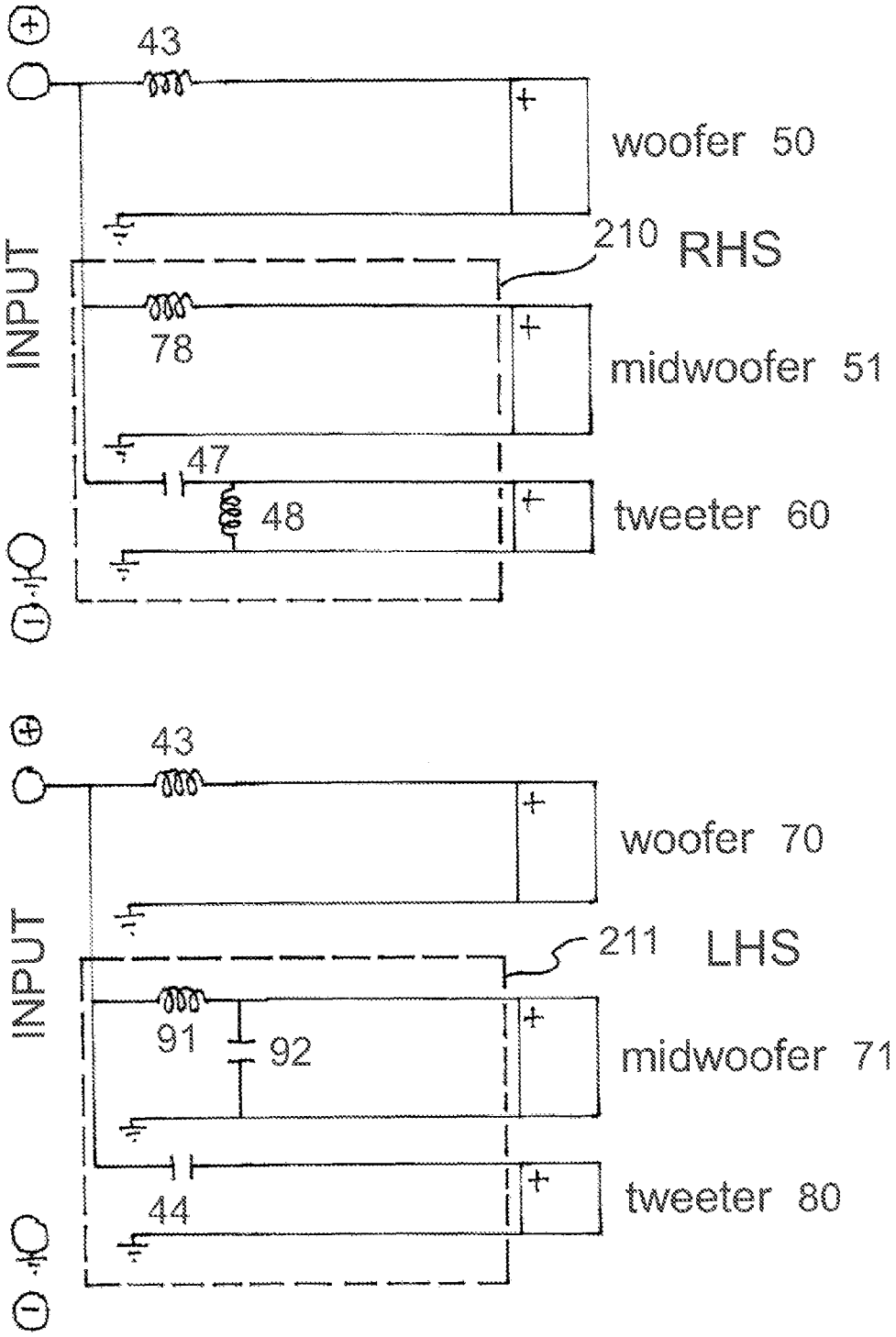
FIG. 32 shows the effective third-order crossover circuit for a 2.5-way loudspeaker system, in accordance with the twenty-first alternative embodiment of the present invention.
Figure 33:
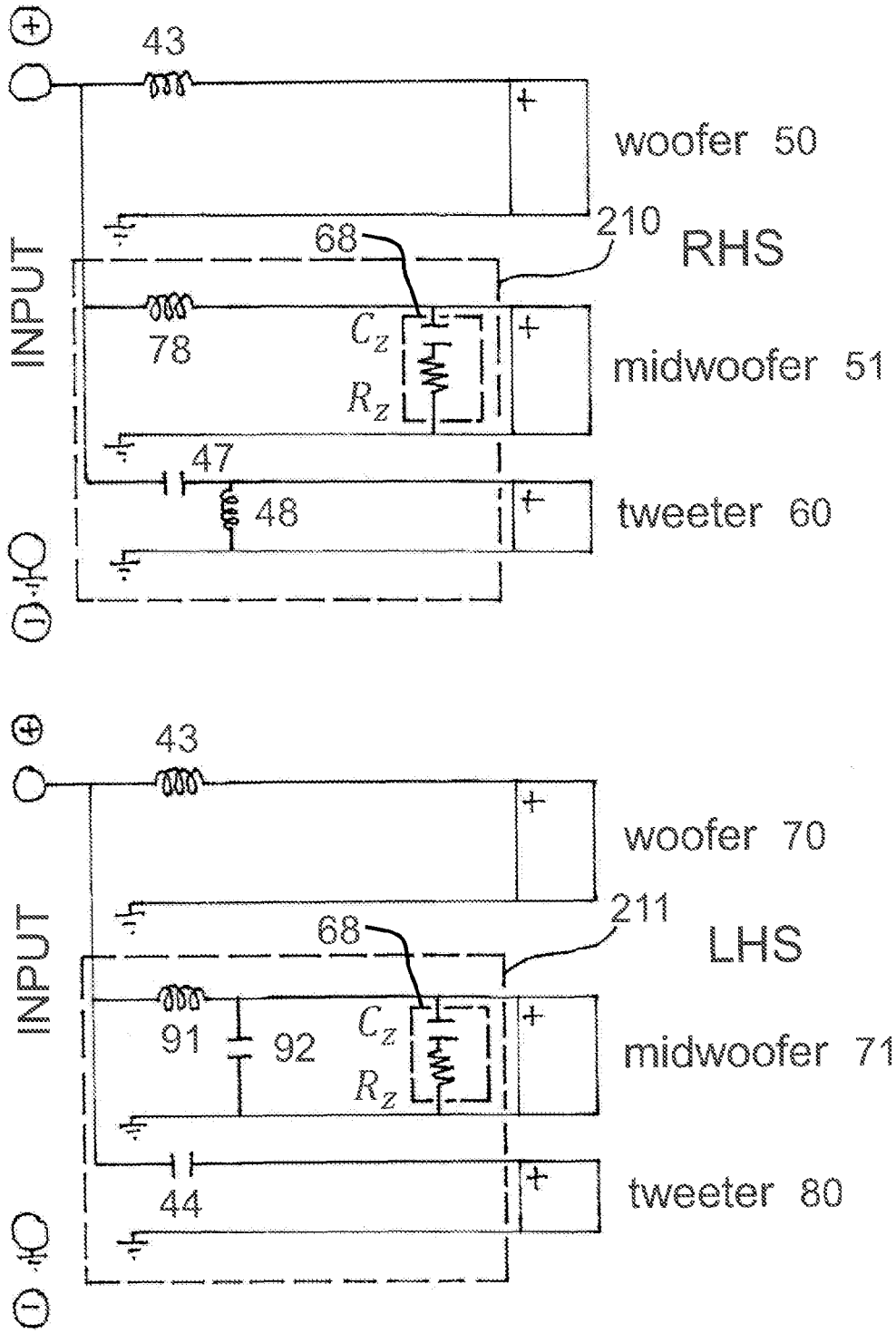
FIG. 33 shows the effective third-order crossover circuit for a 2.5-way loudspeaker system, with a Zobel circuit applied to the midwoofer, in accordance with the twenty-second alternative embodiment of the present invention.

FIG. 32 shows the circuit schematic for the twenty-first alternative embodiment of the present invention: namely, the phase-unified effective third-order crossover for a 2.5-way loudspeaker system. Thus the 2.5-way loudspeaker for the right channel has a woofer 50, midwoofer 51 and tweeter 60 connected in parallel and the 2.5-way loudspeaker for the left channel has a woofer 70, midwoofer 71 and tweeter 80, also connected in parallel. The woofer and midwoofer are typically the same drivers. However, in a 2.5-way, the tweeter is ordinarily crossed over to the midwoofer, with the woofer rolled off at a lower frequency to provide bass boost and to correct for the baffle step. Accordingly in the twenty-first alternative embodiment of the present invention, woofer notation is used for the low-pass filter on woofers, but midrange notation is used for the low-pass filter on midwoofers. For the RHS loudspeaker, accordingly the first series inductor 43 is connected to woofer 50. The first inductor connected in series to midwoofer 51 is 78. The first capacitor connected in series to 60 is 47 and the first inductor connected in parallel to 60 is 48. This constitutes a symmetric effective third-order crossover between the midwoofer and tweeter 210 in a 2.5-way loudspeaker in accordance with the prior art: namely, a $1^{st}$ order filter has been applied to the midwoofer, but a $2^{nd}$ order filter has been applied to the tweeter. Furthermore the first series inductor 43 is connected to woofer 70. The first inductor connected in series to midwoofer 71 is 91 and the first capacitor connected in parallel to 71 is 92. The first capacitor connected in series to 80 is 44. This constitutes an asymmetric effective third-order crossover between the midwoofer and tweeter 211 in a 2.5-way loudspeaker. A $2^{nd}$ order filter has been applied to the left-hand midwoofer, but a $1^{st}$ order filter has been applied to the left-hand tweeter. Capacitor and inductor values are calculated as given by eqs. (3)-(6). The woofer crossover frequency is about 2.5 octaves below the baffle step frequency if a $1^{st}$ order filter is used as shown in FIGS. 32 and 33. Different crossover orders can be selected for the midwoofer so that different crossover orders and frequencies are more suitable for the woofer. For example, the woofer crossover frequency is about 1.5 octaves below $\nu_b$ if a $2^{nd}$ order electrical filter is used. In short, one applies a filter to each woofer so that the output of the woofer for a given channel is about 12 dB below the output of the midwoofer for that channel at the phase-unification frequency. Circuit shortcuts and auxiliary circuits can be applied to the twenty-first and -second alternative embodiments of the present invention for 2.5-way systems as previously demonstrated to develop more alternative embodiments; this includes Thevenin equivalences and changing tweeter polarity. For example, Zobels can be applied to all drivers although a Zobel circuit on the midwoofer 68 is often all that is needed to form the twenty-second alternative embodiment of the present invention (FIG. 33). Here the Zobel circuit applied to the midwoofer is enumerated 68 for purposes and clarification although this Zobel is the same as 61.

The concept of the 2.5-way loudspeaker can be extended to other designs. For instance, 2.5-way loudspeakers can have instead two tweeters and one woofer. One of the tweeters is mounted on the front baffle like the woofer in this design, which is typically realized by mounting the second tweeter on the rear baffle. The second tweeter is called "rear-firing" and has an output reflected off of the wall behind the loudspeaker forward to improve the overall dispersion of the loudspeaker. Aforementioned concepts for 2.5-way loudspeakers can be adapted to rear-firing 2.5-way loudspeakers. For example, the filter frequency for the woofer in the former is significantly lower than the filter frequency for the midwoofer. The woofer does not experience the baffle step and thus fails to influence phase-unification. In comparison, the filter frequency for the rear-firing tweeter is typically significantly higher than the filter frequency for the tweeter mounted on the front baffle. The rear-firing tweeter thus fails to influence phase-unification.

Rear-firing 2.5-way loudspeakers improve dispersion because driver output becomes increasingly directional with frequency though modern tweeters often display good dispersion. Accordingly the dispersion of modern tweeters can need augmentation in merely the highest two audible octaves: namely 5000 Hz and above. The filter frequency for the rear-firing tweeter is consequently typically 5000 Hz and above, considerably higher than $\nu_b$. These relationships imply that phase-unifying a 3-way loudspeaker at merely one $\nu_x$ furnishes the concepts needed to phase-unify a 2.5-way loudspeaker with a rear-firing tweeter. In the latter, one merely phase-unifies the crossover between the tweeter and woofer mounted on the front baffle.

Effective fourth-, fifth-, sixth-, etc. order 2.5-way loudspeakers can be designed accordingly as well as 3.5-, 4.5-, 5.5-, etc.-way loudspeakers to produce still additional alternative embodiments. Note that a number of permutations are available for each d'Appolito configuration above a 2.5-way and the present art can be adapted to these permutations. For instance, a 3.5-way loudspeaker has at least three permutations. In one, the midwoofer and woofer are above and below the tweeter and midrange to form a WTMW configuration. In another permutation, the midwoofer and a midrange are above the tweeter, and the woofer and a midrange are below the tweeter to form a WMTMW configuration. In still another permutation, a midrange is above the tweeter, and the woofer and a midrange are below the tweeter to form a MTMW configuration. A given permutation is typically selected to optimize lobing structure within the constraints of the d'Appolito configuration and conventional crossovers, a process depending on crossover frequencies, cabinet geometry, dimensions and the like. The midrange can manifest the baffle step rather than the woofer or midwoofer, which is more typical. Accordingly an example of this process is a loudspeaker design where the bandpass for the midrange is 200 to 2000 Hz, and the midrange manifests the baffle step.

Two-Way Phase-Unified Loudspeakers with Active or Digital Crossovers or with Combinations Thereof with Passive Crossovers Active crossover circuits ordinarily contain more elements than their passive counterparts. In the figures that follow, the optional equalization or delay circuit often found between the power amp and the actual filter in active crossover circuits is omitted for clarity. Similarly omitted are the power amp and gain/sensitivity control matching. Furthermore FIGS. 34-37 use a rectangle to depict a resistor rather than the more conventional symbol used in previous figures. The Butterworth equation to determine $R_k$ and $C_k$, respectively the values of the $k^{th}$ resistor and capacitor used in the high-pass filter of a $2^{nd}$ order electrical active crossover is $$C_k=1/(2\pi R_k \nu_f \sqrt{2}) \quad (7)$$

Figure 34:
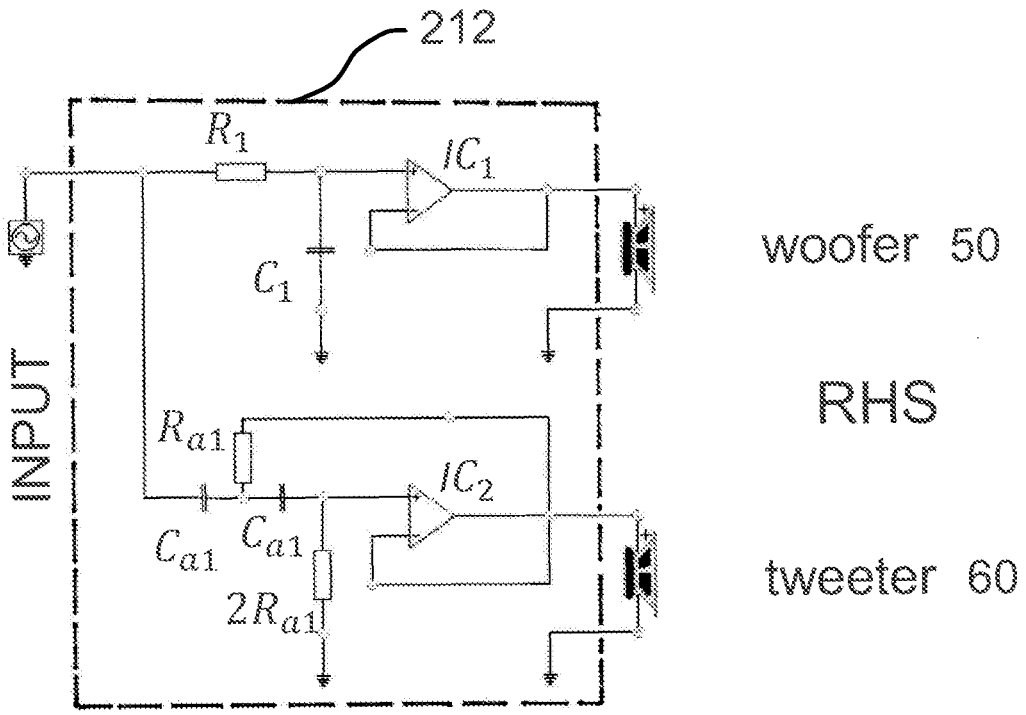
Prior Art Fig. 34
FIG. 34 shows an effective third-order crossover rendered with an active circuit according to the prior art.
Figure 34:
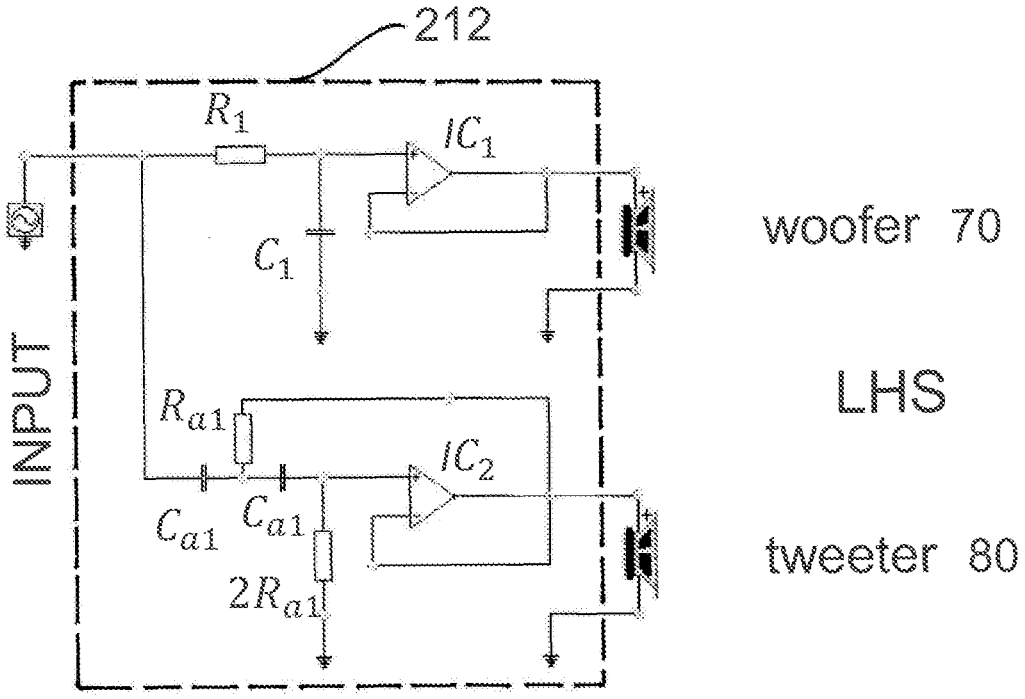
Prior Art Fig. 34
Figure 35:
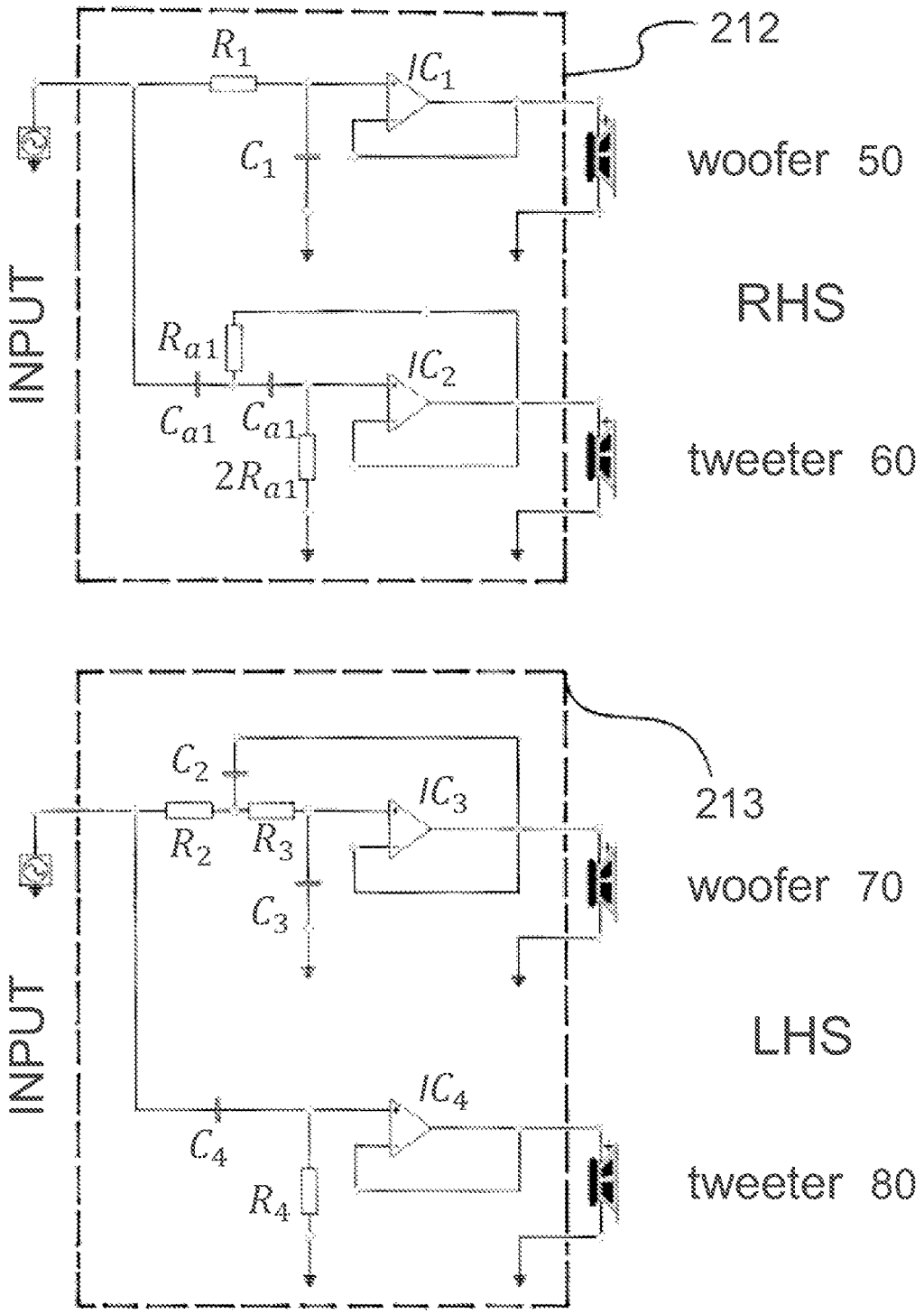
FIG. 35 shows an effective third-order crossover rendered with an active circuit according to the twenty-third alternative embodiment of the present invention.
Figure 36:
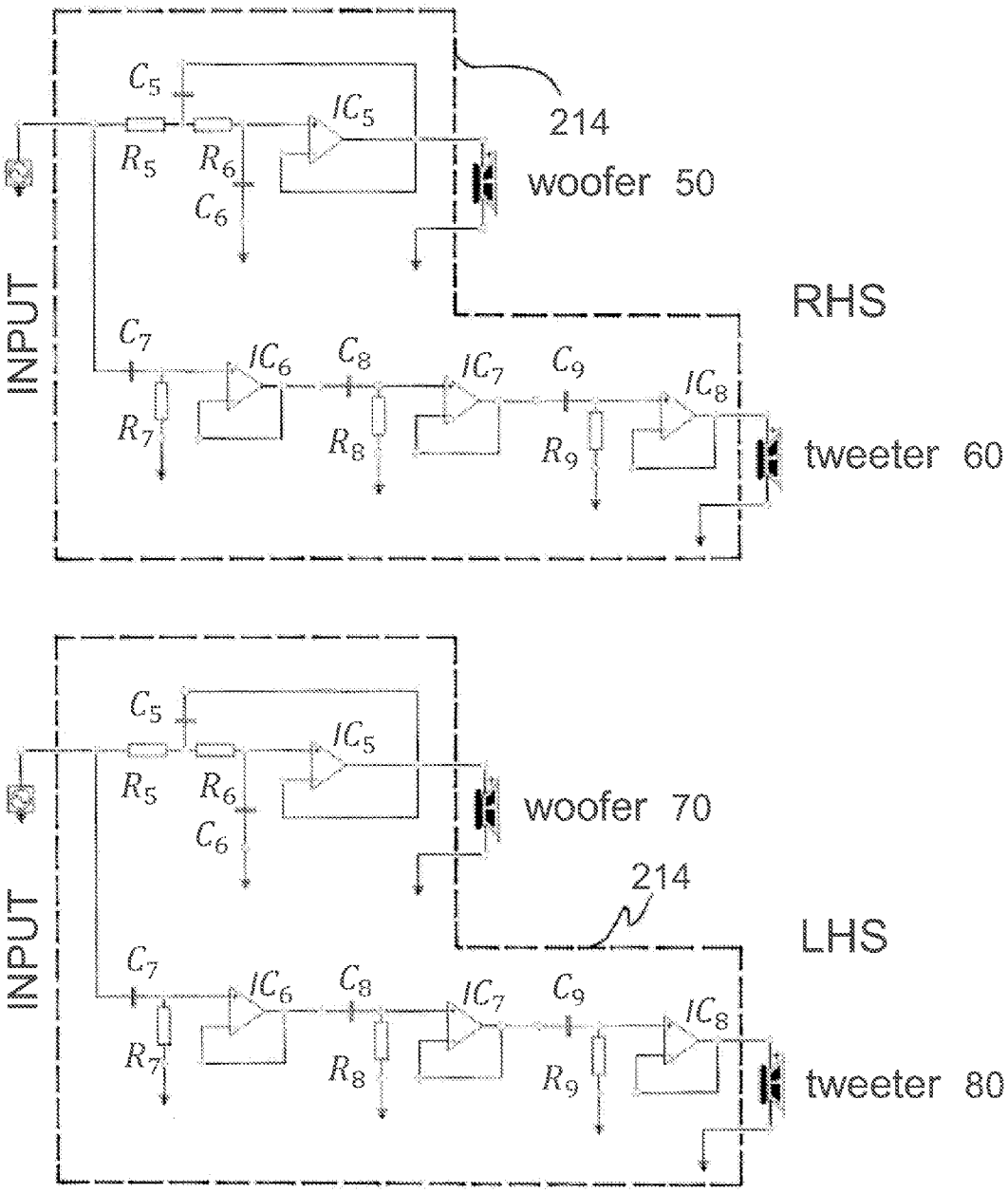
Prior Art Fig. 36
FIG. 36 shows an effective fourth-order crossover rendered with an active circuit according to the prior art.
Figure 37:
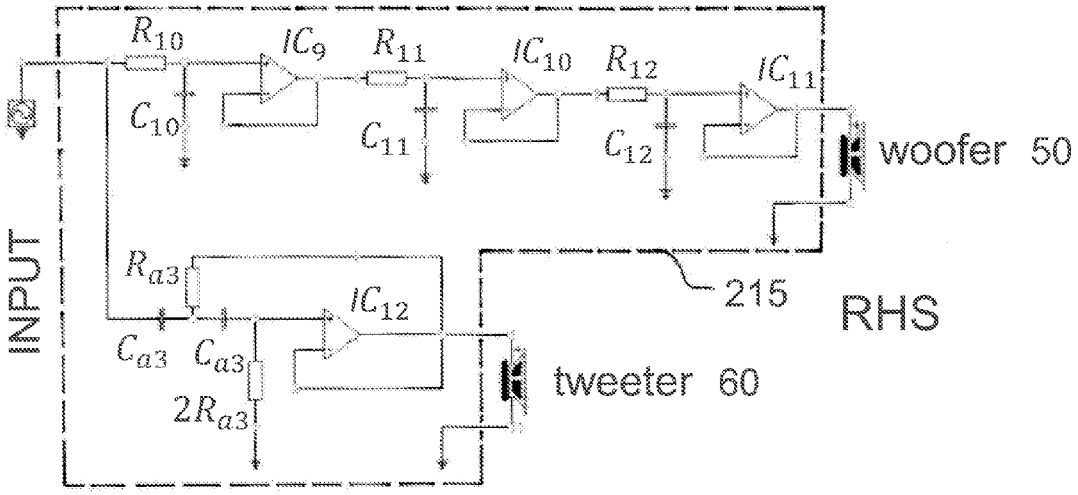
FIG. 37 shows an effective fourth-order crossover rendered with an active circuit according to the twenty-fourth alternative embodiment of the present invention.
Figure 37:
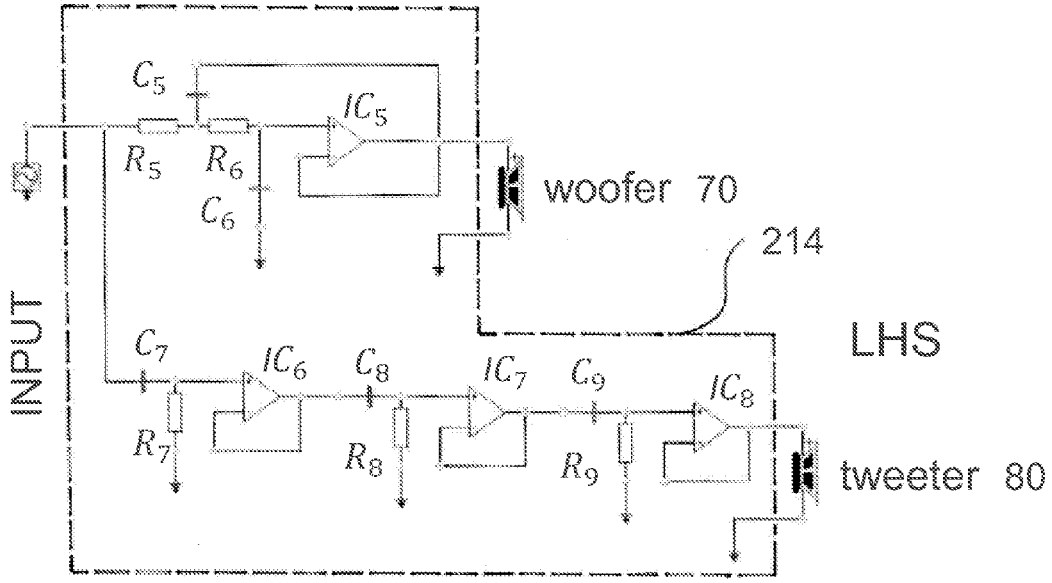

FIGS. 34, 35 and 37 do not use this high-pass filter, but instead a Linkwitz-Riley high-pass filter which increases the damping. The values of the capacitors and resistors used in FIGS. 34-37 can be varied to vary $\nu_f$ and in addition, the amount of damping. Inasmuch as passive $1^{st}$, $2^{nd}$ and $3^{rd}$ order electrical crossovers in the prior art have been previously demonstrated in FIGS. 1-3 respectively, a detailed description of active crossovers in the prior art will skip ahead to depict effective third- and fourth-order crossovers in both the prior and present arts. FIG. 34 shows a symmetric active effective third-order crossover according to the prior art 212. A $1^{st}$ order filter is applied to the woofer, but a $2^{nd}$ order filter is applied to the tweeter. Accordingly an active $1^{st}$ order electrical low-pass filter is connected in series to woofer 50. To complete the RHS crossover, the Sallen-Key configuration, popular for over 50 years, implements the active $2^{nd}$ order electrical filter. A high-pass filter in the Sallen-Key configuration is connected in series to tweeter 60. If both resistors in this configuration are equal, the configuration forms the Butterworth high-pass filter that eq. (7) depicts. The crossover circuits for the right and left channels are the same in FIG. 34.

FIG. 35 shows an active effective third-order crossover that renders the twenty-third alternative embodiment of the present invention. Accordingly the crossover circuit for the RHS channel is an active symmetric effective third-order crossover for a two-way loudspeaker 212 and the same as FIG. 34. The active asymmetric effective third-order crossover for a two-way loudspeaker 213 differs and is used in the LHS channel. A $2^{nd}$ order filter is thus applied to the LHS woofer, but a $1^{st}$ order filter is applied to the LHS tweeter. For instance, a low-pass filter in the Sallen-Key configuration is connected in series to woofer 70. In addition, an active $1^{st}$ order electrical high-pass filter is connected in series to tweeter 80.

The Butterworth equations used for $1^{st}$ order filters determine the values of crossover components $R_1$, $C_1$, $R_4$ and $C_4$, after a crossover frequency is selected. Sequential sections can thus be added to increase the order of active crossover networks. For example, sequential $2^{nd}$ order Sallen-Key low- or high-pass filters can be connected in series to form still higher even-ordered electrical low- or high-pass filters respectively. This is not demonstrated here, where the $1^{st}$ order high-pass filter used on tweeter 80 in FIG. 35 is connected sequentially thrice to form the $3^{rd}$ order high-pass filter on tweeters 60 and 80 in FIG. 36, which depicts an active symmetric effective fourth-order crossover for a two-way loudspeaker in the prior art 214. A $2^{nd}$ order filter is applied to the woofer, but a $3^{rd}$ order filter is applied to the tweeter. A low-pass filter in the Sallen-Key configuration is connected in series to woofers 50 and 70 to complete this crossover.

FIG. 37 shows an effective fourth-order crossover rendered with an active circuit according to form the twenty-fourth alternative embodiment of the present invention. The RHS channel differs from FIG. 36 so that the $1^{st}$ order filter connected to woofer 50 in FIG. 34 is connected sequentially thrice to form the $3^{rd}$ order filter connected in series to woofer 50 in FIG. 37. To complete the RHS crossover, a high-pass filter in the Sallen-Key configuration is connected in series to tweeter 60. Accordingly an active asymmetric effective fourth-order crossover for a two-way loudspeaker 215 is formed. A $3^{rd}$ order filter is applied to the woofer, but a $2^{nd}$ order filter is applied to the tweeter. The crossover circuit for the LHS channel is an active symmetric effective fourth-order crossover for a two-way loudspeaker 214 and the same as FIG. 36.

Active crossover networks lack many of the problems with driver reactivity, including tweeter ringing and unsteady woofer impedance, that their passive counterparts have. Active crossover networks nonetheless manipulate phase, time delay, resonance and crossover shaping, contouring and equalization in an easier manner than their passive counterparts. Zobel circuits can be implemented with a $$R-j/(\omega C)$$

active equivalent circuit in the twenty-third and twenty-fourth alternative embodiments of the present invention. High- and low-frequency equalization circuits can also be connected to an op amp to tailor driver response. Active crossovers can also implement more sophisticated designs like Cauer elliptic filters. Furthermore the circuit shortcuts and auxiliary filters applied to previous embodiments can be adapted and applied to the twenty-third and twenty-fourth alternative embodiments to develop more alternative embodiments, including changing tweeter polarity. These principles can be extended to loudspeakers with higher active crossover orders, two or more drivers, and greater than one phase unification frequency.

Aforementioned passive electronic and active electronic crossovers in the present art can be combined to form parallel phase-unified loudspeakers with composite crossovers. To form still more composite crossovers in the present art, crossovers consisting of passive and active components can be combined with digital signal processing (DSP) or any type of DSP circuitry therewith. DSP can be used to implement any crossovers with slopes corresponding to the prior or present art. DSP can also be used to implement crossovers with slopes of 84 dB/octave or even higher.

Vertical Polar Responses of Two-Way Phase-Unified Loudspeakers

Figure 38:
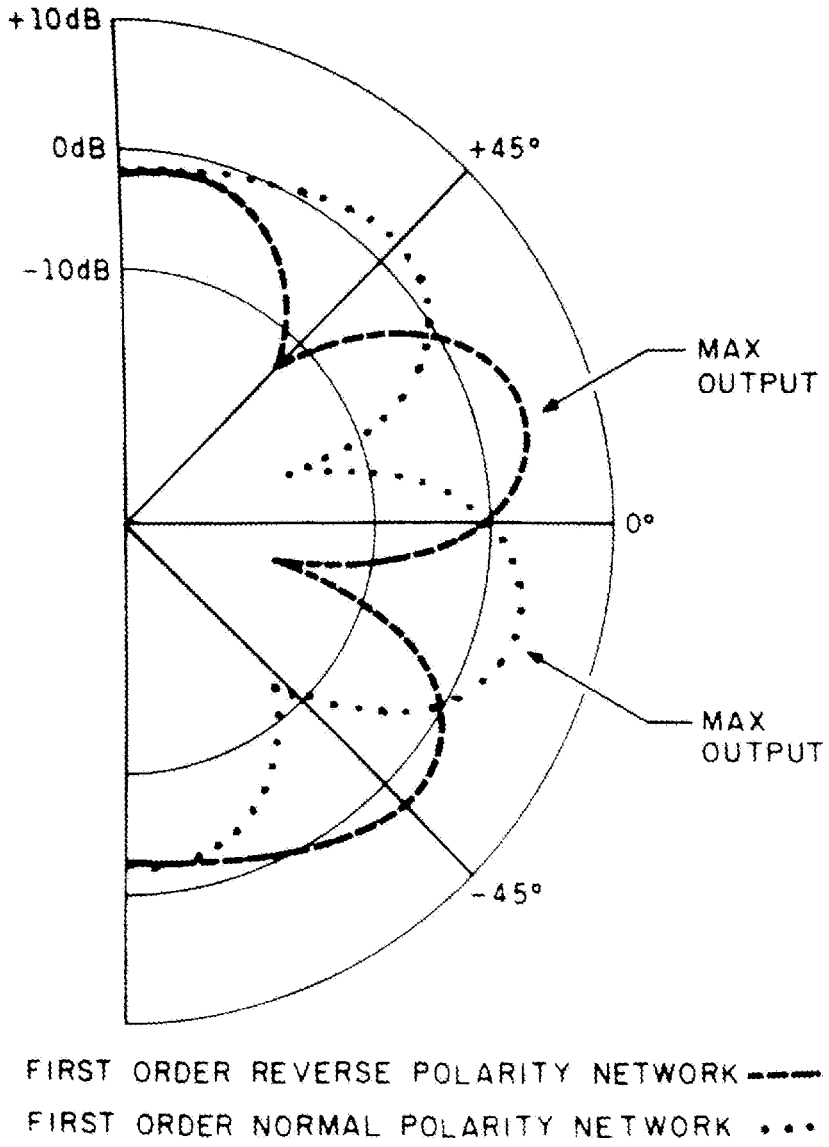
FIG. 38 shows the vertical polar response for a two-way loudspeaker with a $1^{st}$ order electrical crossover and either normal or reverse polarity (reproduced from prior art, *Loudspeaker Design Cookbook,* 2006)
Figure 39:
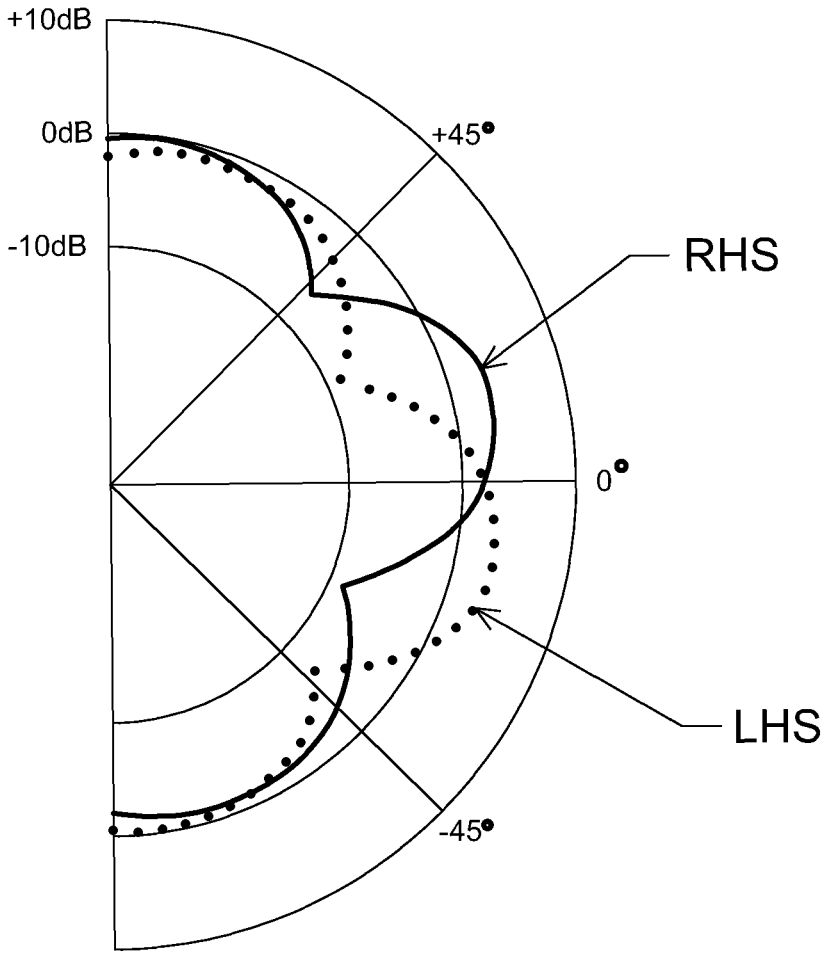
FIG. 39 shows the vertical polar responses at $\nu_b$ for a two-way loudspeaker system with an effective third-order crossover according to the present invention. The RHS crossover is symmetric (solid line), but the LHS crossover is asymmetric (dotted line)
Figure 40:
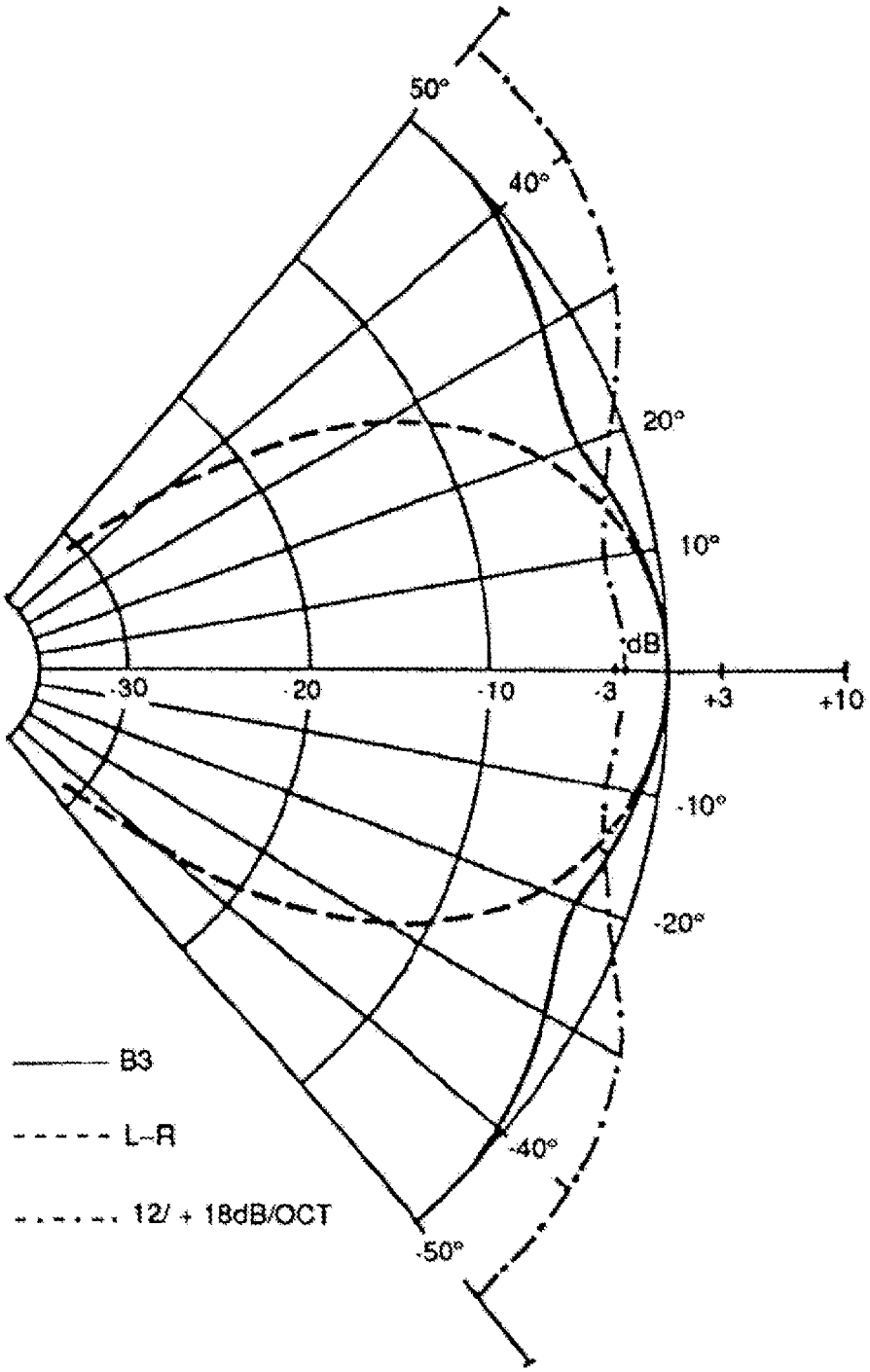
Prior Art Fig. 40
FIG. 40 shows the vertical polar responses about the tweeter at 2000 Hz in a 2.5-way loudspeaker using the d'Appolito configuration, but various crossovers (reproduced from prior art, *High Performance Loudspeakers,* 2005)

FIGS. 38-42 show vertical polar responses for the prior and present art to distinguish the acoustics of the latter. These figures basically depict the vertical cross-section of a given loudspeaker's response into the hemisphere in front of the loudspeaker. The figures provide output levels from a given loudspeaker, ranging from −10 dB to +10 dB. The vertical cross-section of the hemisphere in front of a given loudspeaker forms a semicircle as all but FIG. 40 show, and the angles are enumerated from −90 degrees to +90 degrees to facilitate appraising the tilt in the VPR. The loudspeaker in these figures points to the right with the tweeter towards the top of the front baffle and the woofer towards the bottom. A driver, often a woofer, operating well below $\nu_b$ would exhibit outstanding vertical polar response, which would approximate a semicircle along the 0 dB level if centered at the woofer in FIGS. 38-42. The main divergence from outstanding VPR is lobing, behavior where the VPR fluctuates between levels above and below 0 dB due to the interference between drivers. The greater the VPR extrema, the greater the lobing.

The present art will be depicted with the negative terminal of the tweeter connected to the negative terminal of the power supply for this discussion. To resume, a two-way with a $1^{st}$ order electrical crossover in the prior art has a downward tilt in its vertical polar response, but reversing tweeter polarity tilts the response upward (FIG. 38). An analysis of an effective third-order crossover in the present art reveals the RHS channel for a two-way has a symmetric crossover and displays a vertical polar response near $\nu_b$ that tilts slightly upward (FIG. 39). This crossover applies a slope of 18 dB/octave to each driver, a slope reflective of a $3^{rd}$ order crossover, an odd order. Of the two RHS drivers, the woofer displays the lower VPR output. The LHS channel for this loudspeaker system has an asymmetric effective third-order crossover in the present art and displays a vertical polar response that tilts slightly, albeit downward. In contrast, this crossover applies a slope of 12 dB/octave to the tweeter, but of 24 dB/octave to the woofer, slopes reflective of respective $2^{nd}$ and $4^{th}$ order electrical crossovers, even orders. Of the two LHS drivers in this loudspeaker with an asymmetric effective third-order crossover, the tweeter displays the lower VPR output. The polar responses of the two channels fit together to phase-unify reproduction, facilitated by the effective crossover orders modifying lobe structures as shown. When the lobe amplitude in the RHS VPR increases, the lobe amplitude in the LHS VPR typically decreases and vice-versa. The application of attenuating resistors (VPRs not shown) to the loudspeakers depicted in FIG. 39 would cause the upward tilt of the RHS VPR to decrease while the downward tilt of the LHS VPR would also begin to decrease by nearly the same amount, depending on how much attenuation in phase unification is desired. As the tilts in the RHS and LHS VPR become similar, phase unification is attenuated.

The symmetric and asymmetric effective crossovers in the present art induce substantial output in between two individual loudspeakers as a basis to phase-unify. The vertical polar responses for other effective crossover orders in the present art are described in a related manner. For instance, symmetric odd effective crossover orders retain their upward tilt although the lobe structure changes as the crossover order changes.

FIG. 40 shows the vertical polar responses about the central tweeter in a 2.5 way using the d'Appolito configuration. The vertical polar responses differ depending on the crossover used. For instance, a $4^{th}$ order electrical Linkwitz-Riley crossover (L-R) produces significant lobing. This undesirable behavior is ameliorated using a $3^{rd}$ order electrical crossover Butterworth (B3), the crossover type conventionally used with the d'Appolito configuration. Altering the crossover to symmetric effective fourth-order (12/+18 dB/OCT) alters the lobe structure even further. In particular, this lobe structure proliferates between a pair of loudspeakers compared to the lobe structure directly in front of the loudspeakers. The symmetric and asymmetric effective crossovers in the present art induce substantial output in between two individual loudspeakers as a basis to phase-unify.

Figure 41:
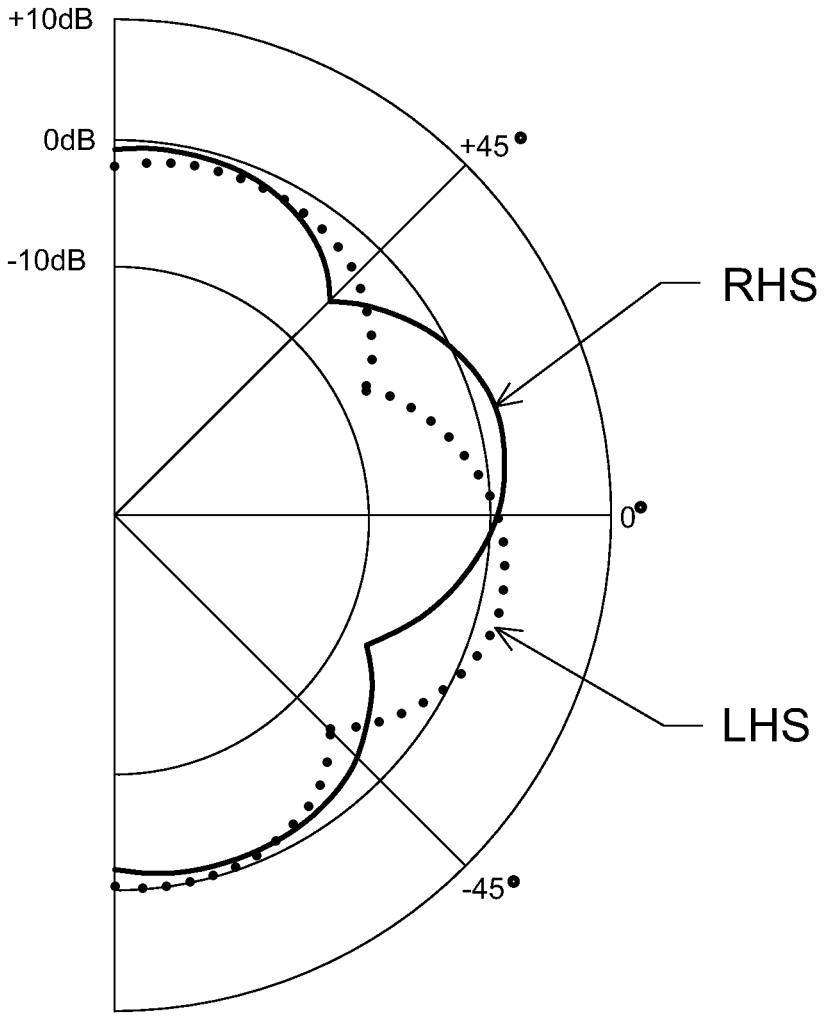
FIG. 41 shows the vertical polar responses at $\nu_b$ for a two-way loudspeaker system with an effective fifth-order crossover according to the present invention. The RHS crossover is symmetric (solid line), but the LHS crossover is asymmetric (dotted line)

The vertical polar responses for other effective crossover orders in the present art are described in a related manner. For instance, odd electrical crossover orders retain their tilt as the crossover order changes. Accordingly the RHS channel for a 2-way has a symmetric effective fifth-order crossover in the present art and displays a vertical polar response at $\nu_b$ that tilts upward (FIG. 41). The LHS channel for this loudspeaker system has an asymmetric effective fifth-order crossover and displays a vertical polar response that tilts slightly downward.

The modified lobe structure in the present art enables different odd effective orders with different numbers of drivers to phase-unify with each other to some extent because the VPR in the RHS channel will tilt upward slightly and the VPR in the LHS channel will tilt downward slightly so that complimentary substantial output in between two individual loudspeakers is achieved. A similar principle applies to loudspeakers with different even effective orders and different numbers of drivers. Note that increasing the crossover order decreases lobing.

Figure 42:
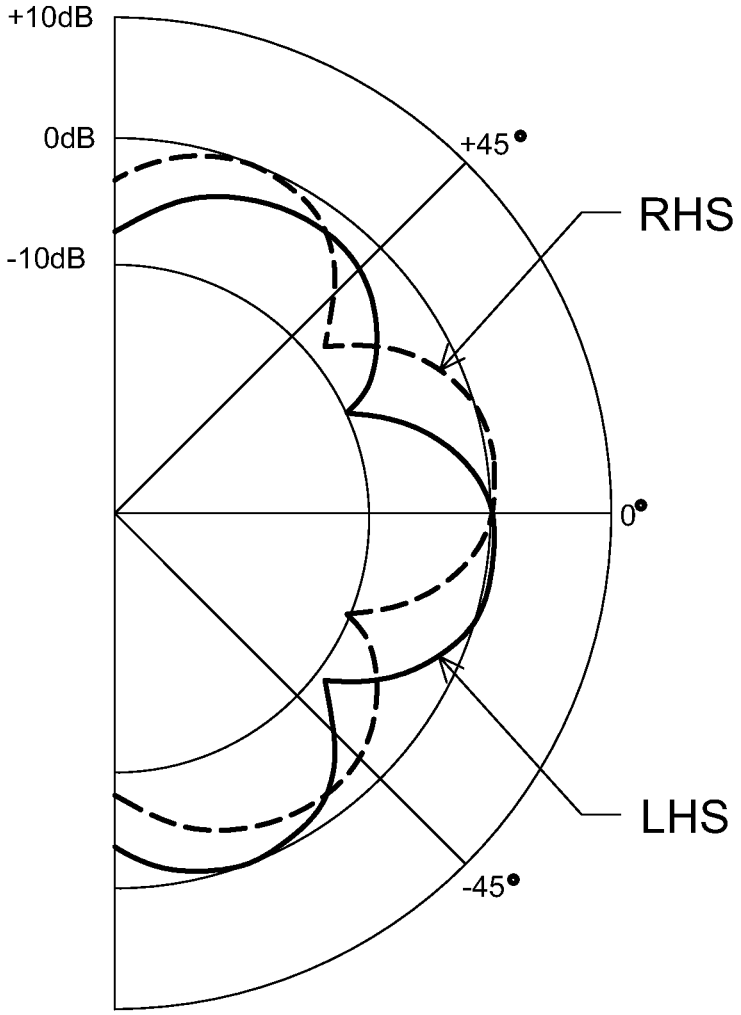
FIG. 42 shows the vertical polar responses at $\nu_b$ for a two-way loudspeaker system with an effective fourth-order crossover according to the present invention. The RHS crossover is asymmetric (dashed line), but the LHS crossover is symmetric (solid line).

The vertical polar responses for symmetric even effective crossover orders in the present art tilt downward. The vertical polar responses for the latter loudspeaker systems nonetheless modify their lobe structures to generate phase-unification. FIG. 42 demonstrates this for an effective fourth-order two-way loudspeaker system according to the present art. Accordingly the LHS channel for this loudspeaker system has a symmetric effective fourth-order crossover and displays a vertical polar response near $\nu_b$ that tilts slightly downward. This crossover applies a slope of 24 dB/octave to each driver, a slope reflective of a $4^{th}$ order crossover, an even order. Of the two LHS drivers in this loudspeaker with a symmetric effective fourth-order crossover, the tweeter displays the lower VPR output. The RHS channel for a two-way has an asymmetric effective fourth-order crossover in the present art and displays a vertical polar response that tilts slightly upward. Of the two RHS drivers in this 2-way loudspeaker, the woofer displays the lower VPR output.

Shifting the effective order in the present art from odd to even shifts the vertical polar response for the symmetric crossover from tilted upward to tilted downward and shifts the VPR of the asymmetric crossover from tilted downward to tilted upward. This explains the change in handedness needed to phase-unify when one shifts from odd to even effective crossover orders. This also explains the shift in handedness to phase-unify when one shifts from connecting the negative tweeter terminal to the negative terminal of the power supply to connecting the positive tweeter terminal to the negative terminal of the power supply. FIG. 38 shows that reversing the polarity for a given loudspeaker and crossover shifts the tilt.

Additional Concepts

Phase-unification can be applied to unusual loudspeaker, or baffle, configurations that have become popular. For instance, the d'Appolito configuration is often applied to 2.5-way and can be phase-unified in a straightforward manner. Two 2.5-way loudspeakers with the d'Appolito configuration would be phase-unified if the left-hand loudspeaker had a crossover that was antisymmetric effective third-order between its midwoofer and tweeter and the right-hand loudspeaker had a crossover that was symmetric effective third-order between its midwoofer and tweeter and if the tweeter negative terminals are connected to the negative terminals of the power supply, all as previously described. When applied to these novel configurations, the present art typically imparts performance over and beyond the performance of the respective configuration.

Finally the application of unusual baffle configurations foreshadows phase-unified home-theater and quadraphonic loudspeaker systems, wherein the number of and type of drivers in each loudspeaker can differ. For instance, it has been determined that a 2.5-way with a d'Appolito configuration and a $2^{nd}$ order electrical crossover will phase-unify to some extent with a RHS 2-way, with a symmetric effective third-order crossover, if the tweeter negative terminals are connected to the negative terminals of the power supply. Phase-unifying this 2.5-way with a dissimilar loudspeaker implies a rule. Therefore a 2.5-way with a d'Appolito configuration and a $4^{th}$ order electrical crossover will phase-unify to some extent with a RHS 2-way, with a symmetric effective fifth-order and so forth for higher RHS crossover orders. A rule exists for phase-unifying a RHS 2-way using a symmetric effective crossover and an odd order with a 2.5-way loudspeaker using the d'Appolito configuration and a definite even-order electrical crossover. The existence of this rule implies the existence of a rule for phase-unifying a RHS 2-way using an asymmetric effective crossover and an even order with a 2.5-way loudspeaker using the d'Appolito configuration and a definite odd-order electrical crossover. The vertical polar response of the d'Appolito configuration is responsible for these rules. For instance, the symmetric vertical polar response at $v_b$ of the d'Appolito configuration for a 2.5-way simulates the symmetric vertical polar response at $v_b$ of a LHS 2-way with an asymmetric crossover and an odd effective order, if the filters between the midwoofer and tweeter in the 2.5-way is even-ordered according to the aforementioned rules.

Moreover implied is a rule for phase-unifying a RHS 3-way using a symmetric effective crossover and an odd order with a 3.5-way loudspeaker using the d'Appolito configuration and a definite even-order electrical crossover, and a rule for phase-unifying the 3.5-way d'Appolito that has an odd-order electrical crossover. Further implied are rules for phase-unifying a RHS N-way loudspeaker with an N.5-way d'Appolito loudspeaker, depending on the order of the electrical crossover in the latter.

Review of the Underlying Concepts Design Examples

A phase-unified effective third-order crossover was applied to a pair of two-way loudspeaker systems, the first using a cabinet with outer dimensions 22"(H)×12"(W)×9.5"(D). An Acoustic Research 8" woofer, AR1210132-1A, was mounted on this cubic foot enclosure that was ported, along with an Audax 0.375" tweeter, TIW60A4. Zobel circuits were applied to each woofer, as recommended (FIG. 7).

Figure 10:
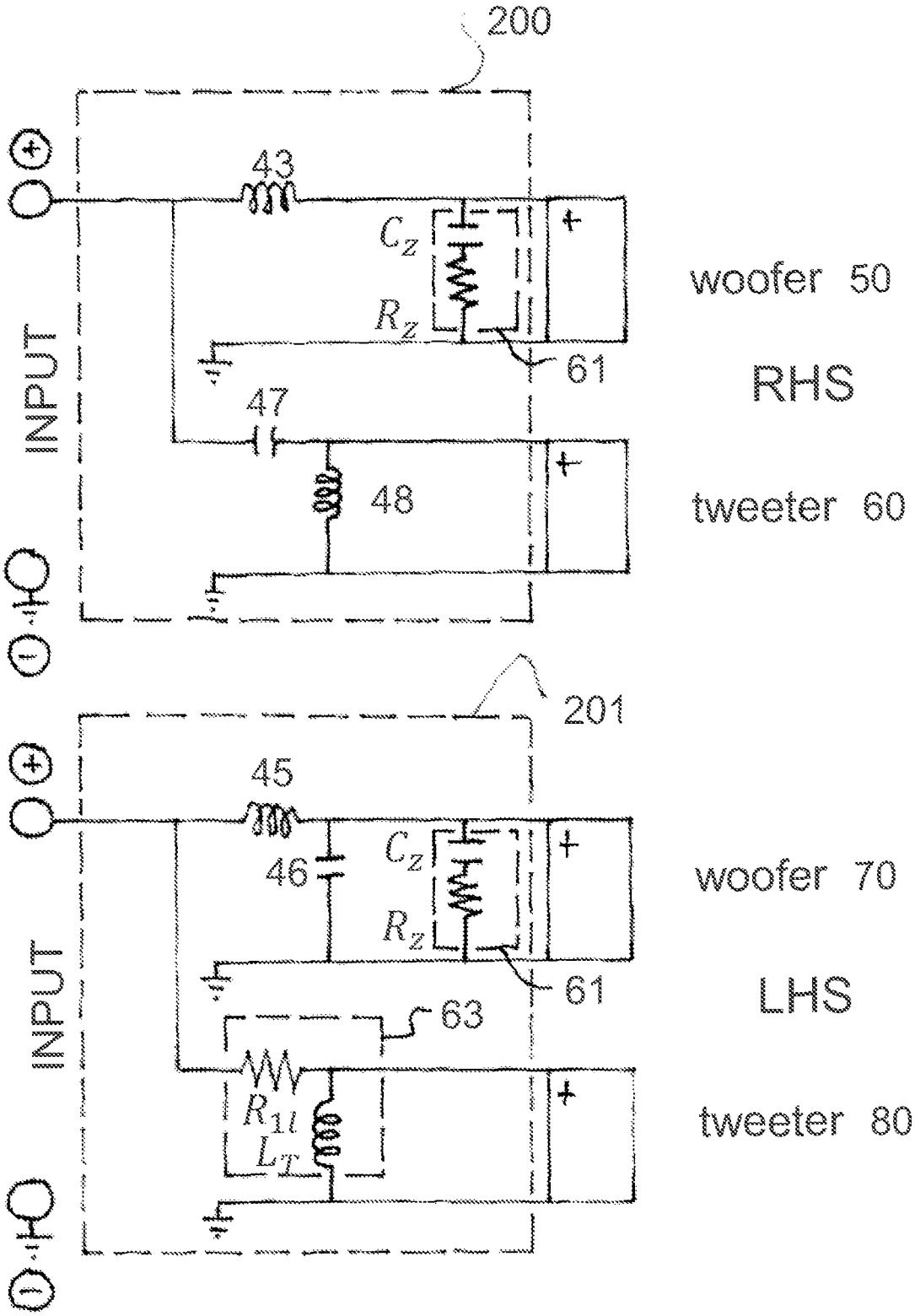
FIG. 10 shows the effective third-order crossover circuit for a two-way loudspeaker system, with a Zobel circuit applied to the woofer and with a parallel inductor loaded using a resistor applied to the tweeter, in accordance with the fourth alternative embodiment of the present invention.

The second such two-way loudspeaker system used a cabinet with outer dimensions 20.5"(H)×9"(W)×11"(D). A Peerless 6.5" woofer, TP165R, was mounted on this ported enclosure along with a Vifa tweeter, D19TD-00. The baffle step was corrected using a typical RL circuit, properly tuned, on the RHS woofer (FIG. 14) and replacing the Zobel C on the LHS woofer with a larger C (FIG. 12). The $1^{st}$ order electrical crossover on the LHS tweeter was an inductor in parallel, suitably loaded with a resistor in series with the tweeter (FIG. 10).

A phase-unified effective fourth-order crossover was applied to a two-way loudspeaker system, with each loudspeaker also using a cabinet with outer dimensions 22"(H)×12"(W)×9.5"(D). An Acoustic Research 8" woofer, AR1210132-1A, was mounted on this cubic foot enclosure that was ported, along with an Audax 0.375" tweeter, TIW60A4. Zobel circuits were applied to each woofer, as recommended (FIG. 16).

A phase-unified effective fourth-order crossover was applied to a two-way loudspeaker system, with each loudspeaker using a cabinet with outer dimensions 18.25"(H)×9.75"(W)×8.25"(D). A Vifa 1" tweeter, 27 TBF/G was used in the RHS loudspeaker along with a Scanspeak prototype 7" woofer, 18 W/8542-XX. A Vifa 1" tweeter, 27 TBF/G was also used in the LHS loudspeaker along with the Scanspeak 7" woofer, 18 W/8535, because another 18 W/8542-XX was not available. Both enclosures were sealed. Zobel circuits were applied to each midwoofer, as recommended, furthermore with any series L or C attached to the negative driver terminals and with attenuating resistors in series with any L or C parallel to a driver (FIGS. 17 and 18).

A phase-unified effective fifth-order crossover was applied to a two-way loudspeaker system, with each loudspeaker using a cabinet with outer dimensions 18.25"(H)×9.75"(W)×8.25"(D). A Vifa 6.5" woofer, P17WJ-00, was mounted on this sealed enclosure, along with an Audax 0.375" tweeter, TW010F1. The baffle step was corrected by increasing the size of the 1st inductor in series with each woofer. The R in parallel with the L in the typical RL circuit for such was omitted because the R merely reduces the slope of the L rolloff. Zobel circuits were applied to each woofer.

A phase-unified effective third-order crossover was applied to a three-way loudspeaker system, with each loudspeaker using a cabinet with outer dimensions 22"(H)×12"(W)×9.5"(D). An Acoustic Research 8" woofer, AR1210132-1A, was mounted on this sealed enclosure, along with an unknown 3.5" midrange and an Audax 0.375" tweeter, TIW60A4. Zobel circuits were applied to each midrange and woofer, as recommended. The series L on the RHS midrange was omitted because this L is redundant with the midrange Zobel (FIG. 28).

A phase-unified effective third-order crossover was applied to only the woofer-midrange crossover in a three-way loudspeaker system, with each loudspeaker using a cabinet with outer dimensions 24"(H)×13"(W)×11.5"(D). An Acoustic Research 10" woofer was mounted on this sealed enclosure, along with an Acoustic Research 3.5" midrange and an Audax 0.375" tweeter, AMTIW74A8. Zobel circuits were applied to each woofer, as recommended (FIG. 29).

CONCLUSION AND SCOPE

Complimentary crossovers that reduce phase distortion in a loudspeaker system are described. In the fundamental embodiment, this technology is applied to a pair of loudspeakers, with each loudspeaker possessing two drivers, a woofer and a tweeter. The effective third-order crossover on the right-hand loudspeaker remains symmetric, but the effective third-order crossover on the left-hand loudspeaker is rendered asymmetric, as described. Other embodiments apply this principle to higher crossover orders and greater numbers of drivers. For example, in a loudspeaker that possesses two drivers, a woofer and a tweeter, the effective fourth-order crossover on the right-hand loudspeaker is rendered asymmetric, as described, but the effective fourth-order crossover on the left-hand loudspeaker remains symmetric. This technology can be combined with other circuits like a Zobel, typically used for impedance correction. Some configurations of phase-unified loudspeakers require that a Zobel circuit is applied to all drivers except the tweeter. Accordingly a rule combining effective crossover order and handedness is established.

Having described the invention in detail, those skilled in the art will appreciate that modifications may be made to the invention without departing from its spirit. Therefore, it is not intended that the scope of the invention be limited to the specific embodiments illustrated and described. Rather it is intended that the scope of this invention be determined by the appended claims and their equivalents. All changes which come within the meaning and range of equivalency of the claims are to be embraced within their scope.

The invention claimed is:

1. A method of improving sound reproduction, reducing phase distortion, and improving polar response in a stereophonic or other audio reproduction system having two or more loudspeakers, each of which has two or more drivers including at least one driver reproducing lower frequencies and at least one driver reproducing higher frequencies, said method comprising forming two or more complementary parallel crossover networks in combination with said loudspeakers said method further comprising phase unifying said loudspeakers by utilizing an equivalent effective order in said crossover networks in a parallel fashion, the steps comprising:

selecting a polarity for any of said drivers;

designating the same polarity for each of said drivers; and designing said loudspeakers to have an approximately equivalent crossover frequency.

2. The method of improving sound reproduction as claimed in claim 1, further comprising phase-unifying a right hand and a left hand two-way loudspeaker, each having at least a woofer and a tweeter and a negative terminal of the tweeter connected to a negative terminal of a power supply, said right hand two-way loudspeaker having a symmetric effective third-order crossover and the left hand two-way loudspeaker having an asymmetric effective third-order crossover, at least one of said right hand and left hand two-way loudspeakers optionally having at least one of the following:

(a) a Zobel circuit applied to one or both woofer(s) in either of the two-way loudspeakers;

(b) notch filters, twister circuits or circuits to correct a baffle step applied;

(c) Thevenin equivalences; or (d) any combinations thereof.

3. The method of improving sound reproduction as claimed in claim 1, further comprising phase-unifying a right hand and left hand two-way loudspeaker, each having at least a woofer and a tweeter and a negative terminal of the tweeter connected to a positive terminal of a power supply, said right hand two-way loudspeaker having an asymmetric effective third-order crossover and the left hand two-way loudspeaker having a symmetric effective third-order crossover, at least one of said right hand and left hand two-way loudspeakers optionally having at least one of the following:

(a) a Zobel circuit applied to one or both woofer(s) in either of the two-way loudspeakers;

(b) notch filters, twister circuits or circuits to correct the baffle step applied;

(c) Thevenin equivalences; or (d) any combinations thereof.

4. The method of improving sound reproduction as claimed in claim 1, further comprising phase-unifying an effective fourth-order crossover for a right hand and a left hand two-way loudspeaker, each having at least a woofer and a tweeter and a negative terminal of the tweeter connected to a negative terminal of a power supply, said right hand two-way loudspeaker having an asymmetric effective fourth-order crossover and the left hand two-way loudspeaker having a symmetric effective fourth-order crossover, at least one of said right hand and left hand two-way loudspeakers optionally having at least one of the following:

(a) a Zobel circuit applied to one or both woofer(s) in either of the two-way loudspeakers;

(b) notch filters, twister circuits or circuits to correct the baffle step applied;

(c) Thevenin equivalences; or (d) any combinations thereof.

5. The method of improving sound reproduction as claimed in claim 1, comprising phase-unifying an effective fourth-order crossover for a right hand and a left hand two-way loudspeaker, each having at least a woofer and a tweeter and a negative terminal of the tweeter connected to a positive terminal of a power supply, with the right hand two-way loudspeaker having a symmetric effective fourth-order crossover and the left hand two-way loudspeaker having an asymmetric effective fourth-order crossover, at least one of said right hand and left hand two-way loudspeakers optionally having at least one of the following:

(a) a Zobel circuit applied to one or both woofer(s) in either of the two-way loudspeakers;

(b) notch filters, twister circuits or circuits to correct the baffle step applied;

(c) Thevenin equivalences; or (d) any combinations thereof.

6. The method of improving sound reproduction as claimed in claim 1, comprising phase-unifying an effective fifth-order crossover for a right hand and a left hand two-way loudspeaker, each having at least a woofer and a tweeter and a negative terminal of the tweeter connected to a negative terminal of a power supply, said right hand two-way loudspeaker having a symmetric effective fifth-order crossover and the left hand two-way loudspeaker having an asymmetric effective fifth-order crossover, at least one of said right hand and left hand two-way loudspeakers optionally having at least one of the following:

(a) a Zobel circuit applied to one or both woofer(s) in either of the two-way loudspeakers;

(b) notch filters, twister circuits or circuits to correct the baffle step applied;

(c) Thevenin equivalences; or (d) any combinations thereof.

7. The method of improving sound reproduction as claimed in claim 1, further comprising phase-unifying an effective fifth-order crossover for a right hand and a left hand two-way loudspeaker, each having at least a woofer and a tweeter and a negative terminal of the tweeter connected to a positive terminal of a power supply, said right hand two-way loudspeaker having an asymmetric effective fifth-order crossover and the left hand two-way loudspeaker having a symmetric effective fifth-order crossover, at least one of said right and left hand two-way loudspeakers optionally having at least one of the following:

(a) a Zobel circuit applied to one or both woofer(s) in either of the two-way loudspeakers;

(b) notch filters, twister circuits or circuits to correct the baffle step applied;

(c) Thevenin equivalences; or (d) any combinations thereof.

8. The method of improving sound reproduction as claimed in claim 1, further comprising phase-unifying an effective third-order crossover for a right hand and a left hand three-way loudspeaker, each having at least a woofer, a midrange and a tweeter and a negative terminal of the tweeter connected to a negative terminal of a power supply, with the right hand three-way loudspeaker having a symmetric effective third-order crossover and the left hand three-way loudspeaker having an asymmetric effective third-order crossover;

at least one of said right hand and left hand three-way loudspeakers optionally having at least one of the following:

(a) a Zobel circuit applied to one or both woofer(s) in either of the three-way loudspeakers;

(b) notch filters, twister circuits or circuits to correct the baffle step applied;

(c) Thevenin equivalences; or (d) any combinations thereof.

9. The method of improving sound reproduction as claimed in claim 1, further comprising phase-unifying an effective third-order crossover for a right hand and a left hand three-way loudspeaker, each having at least a woofer, a midrange and a tweeter and a negative terminal of the tweeter connected to a positive terminal of a power supply, said right hand three-way loudspeaker having an asymmetric effective third-order crossover and the left hand three-way loudspeaker having a symmetric effective third-order crossover, at least one of said right hand and left hand three-way loudspeakers optionally having at least one of the following:

a) a Zobel circuit applied to one or both woofer(s) in either of the three-way loudspeakers;

(b) notch filters, twister circuits or circuits to correct the baffle step applied;

(c) Thevenin equivalences; or (d) any combinations thereof.

10. The method of improving sound reproduction as claimed in claim 1, further comprising virtually phase-unifying an effective third-order crossover for a right hand and a left hand three-way loudspeaker, each having at least a woofer, a midrange and a tweeter and a negative terminal of the tweeter connected to a negative terminal of a power supply, with the right hand three-way loudspeaker having a symmetric effective third-order crossover applied near the baffle-step frequency and the left hand three-way loudspeaker having an asymmetric effective third-order crossover applied near the baffle-step frequency; the right hand and the left hand three-way loudspeakers preferably having, but not limited to, a $1^{st}$ order electrical crossover applied at a remaining crossover frequency;

at least one of said right hand and left hand three-way loudspeakers optionally having at least one of the following:

(a) a Zobel circuit applied to one or both woofer(s) in either of the three-way loudspeakers;

(b) notch filters, twister circuits or circuits to correct the baffle step applied;

(c) Thevenin equivalences; or (d) any combinations thereof.

11. The method of improving sound reproduction as claimed in claim 1, further comprising virtually phase-unifying an effective third-order crossover for a right hand and a left hand three-way loudspeaker, each having at least a woofer, a midrange and a tweeter and a negative terminal of the tweeter connected to a positive terminal of a power supply, with the right hand three-way loudspeaker having an asymmetric effective third-order crossover applied near the baffle-step frequency and the left hand three-way loudspeaker having a symmetric effective third-order crossover applied near the baffle-step frequency; the right hand and the left hand three-way loudspeakers preferably having, but not limited to, a $1^{st}$ order electrical crossover applied at a remaining crossover frequency;

at least one of said right hand and left hand three-way loudspeakers optionally having at least one of the following:

(a) a Zobel circuit applied to one or both woofer(s) in either of the three-way loudspeakers;

(b) notch filters, twister circuits or circuits to correct the baffle step applied;

(c) Thevenin equivalences; or (d) any combinations thereof.

12. The method of improving sound reproduction as claimed in claim 1, further comprising phase-unifying an effective third-order crossover for a right hand and a left hand 2.5-way loudspeaker, each having at least a woofer, a midwoofer and a tweeter and a negative terminal of the tweeter connected to a negative terminal of a power supply, with the output of the woofer for a given right hand or left hand 2.5-way loudspeaker about 12 dB below the midwoofer at the phase-unification frequency for that loudspeaker, but otherwise with the right hand 2.5-way loudspeaker having a symmetric effective third-order crossover and the left hand 2.5 loudspeaker having an asymmetric effective third-order crossover;

at least one of said right hand and left hand 2.5 loud speakers optionally having at least one of the following:

(a) a Zobel circuit applied to one or more midwoofer(s) in either of the 2.5-way loudspeakers;

(b) notch filters, twister circuits or circuits to correct the baffle step applied;

(c) Thevenin equivalences; or (d) any combinations thereof.

13. The method of improving sound reproduction as claimed in claim 1, further comprising phase-unifying an effective third-order crossover for a right hand and a left hand 2.5-way loudspeaker, each having at least a woofer, a midwoofer and a tweeter and a negative terminal of the tweeter connected to a positive terminal of a power supply, with the output of the woofer for a given right hand or left hand 2.5-way loudspeaker about 12 dB below the midwoofer at the phase-unification frequency for that loudspeaker, but otherwise with the right hand 2.5-way loudspeaker having an asymmetric effective third-order crossover and the left hand 2.5-way loudspeaker having a symmetric effective third-order crossover;

at least one of said right hand and left hand 2.5-way loudspeakers optionally having at least one of the following:

(a) a Zobel circuit applied to one or more midwoofer(s) in either of the 2.5-way loudspeakers;

(b) notch filters, twister circuits or circuits to correct the baffle step applied;

(c) Thevenin equivalences; or (d) any combinations thereof.

14. The method of improving sound reproduction as claimed in claim 1, further comprising phase-unifying an effective third-, fifth-, seventh-, ninth-, eleventh-, or higher odd-numbered order crossover for a right hand and a left hand N-way loudspeakers where N is an integer greater than 1, each having at least a woofer and a tweeter and a negative terminal of the tweeter connected to a negative terminal of a power supply, said right hand N-way loudspeaker having a symmetric effective crossover of the same odd order as the left hand N-way loudspeaker, said left hand N-way loudspeaker having an asymmetric effective crossover, at least one of the right hand and left hand N-way loudspeakers optionally having at least one of the following:

(a) a Zobel circuit applied to one or both woofer(s) in either of the N-way loudspeakers;

(b) notch filters, twister circuits or circuits to correct the baffle step applied;

(c) Thevenin equivalences; or (d) any combinations thereof.

15. The method of improving sound reproduction as claimed in claim 1, the steps further comprising phase-unifying an effective third-, fifth-, seventh-, ninth-, eleventh-, or higher odd-numbered order crossover for a right hand and a left hand N-way loudspeaker where N is an integer greater than 1, each having at least a woofer and a tweeter and a negative terminal of the tweeter connected to a positive terminal of a power supply, with the right hand N-way loudspeaker having an asymmetric effective odd order crossover and the left hand N-way loudspeaker having a symmetric effective crossover of the same odd order as the right hand N-way loudspeaker;

at least one of the right hand and left hand N-way loudspeakers optionally having at least one of the following:

(a) a Zobel circuit applied to one or both woofer(s) in either of the N-way loudspeakers;

(b) notch filters, twister circuits or circuits to correct the baffle step applied;

(c) Thevenin equivalences; or (d) any combinations thereof.

16. The method of improving sound reproduction as claimed in claim 1, further comprising phase-unifying an effective fourth-, sixth-, eighth-, tenth-, or higher even-numbered order crossover for a right hand and a left hand N-way loudspeaker where N is an integer greater than 1, each having at least a woofer and a tweeter and a negative terminal of the tweeter connected to a negative terminal of a power supply, with the right hand N-way loudspeaker having an asymmetric effective even order crossover and the left hand N-way loudspeaker having a symmetric effective crossover of the same even order as the right hand N-way loudspeaker;

at least one of the right hand and left hand N-way loudspeakers optionally having at least one of the following:

(a) a Zobel circuit applied to one or both woofer(s) in either of the N-way loudspeakers;

(b) notch filters, twister circuits or circuits to correct the baffle step applied;

(c) Thevenin equivalences; or (d) any combinations thereof.

17. The method of improving sound reproduction as claimed in claim 1, further comprising phase-unifying an effective fourth-, sixth-, eighth-, tenth-, or higher even-numbered order crossover for a right hand and a left hand N-way loudspeaker where N is an integer greater than 1, each having at least a woofer and a tweeter and a negative terminal of the tweeter connected to a positive terminal of a power supply, with the right hand N-way loudspeaker having a symmetric effective even order crossover and the left hand N-way loudspeaker having an asymmetric effective crossover of the same even order as the right hand N-way loudspeaker;

at least one of the right hand and left hand N-way loudspeakers optionally having at least one of the following:

(a) a Zobel circuit applied to one or both woofer(s) in either of the N-way loudspeakers;

(b) notch filters, twister circuits or circuits to correct the baffle step applied;

(c) Thevenin equivalences; or (d) any combinations thereof.

18. The method of improving sound reproduction as claimed in claim 1, further comprising virtually phase-unifying an effective third-, fifth-, seventh-, ninth-, eleventh-, or higher odd-numbered order crossover for a right hand and a left hand N-way loudspeaker where N is an integer greater than 2, each having at least a woofer, a midrange and a tweeter and a negative terminal of the tweeter connected to a negative terminal of a power supply, with the right hand N-way loudspeaker having at least a symmetric effective odd order crossover applied at a crossover frequency near the baffle step frequency and the left hand N-way loudspeaker having at least an asymmetric effective crossover of the same odd order as the right hand N-way loudspeaker applied at a crossover frequency near the baffle step frequency; the right hand N-way loudspeaker and left hand N-way loudspeaker having $1^{st}$ order electrical crossovers applied at remaining crossover frequencies;

at least one of the right hand and left hand N-way loudspeakers optionally having at least one of the following:

(a) a Zobel circuit applied to one or both woofer(s) in either of the pair of N-way loudspeakers;

(b) notch filters, twister circuits or circuits to correct the baffle step applied;

(c) Thevenin equivalences; or (d) any combinations thereof.

19. The method of improving sound reproduction as claimed in claim 1, further comprising virtually phase-unifying an effective third-, fifth, seventh-, ninth-, eleventh-, or higher odd-numbered order crossover for a right hand and a left hand N-way loudspeaker where N is an integer greater than 2, each having at least a woofer, a midrange and a tweeter and a negative terminal of the tweeter connected to a positive terminal of a power supply, with the right hand N-way loudspeaker having at least an asymmetric effective odd order crossover applied at a crossover frequency near the baffle step frequency and the left hand N-way loudspeaker having at least a symmetric effective crossover of the same odd order as the right hand N-way loudspeaker applied at a crossover frequency near the baffle step frequency; the right hand N-way loudspeaker and left hand N-way loudspeaker having, but not limited to, $1^{st}$ order electrical crossovers applied at remaining crossover frequencies;

at least one of the right hand and left hand N-way loudspeakers optionally having at least one of the following:

(a) a Zobel circuit applied to one or both woofer(s) in either of the N-way loudspeakers;

(b) notch filters, twister circuits or circuits to correct the baffle step applied;

(c) Thevenin equivalences; or (d) any combinations thereof.

20. The method of improving sound reproduction as claimed in claim 1, further comprising virtually phase-unifying an effective fourth-, sixth-, eighth-, tenth-, or higher even-numbered order crossover for a right hand and a left hand N-way loudspeakers where N is an integer greater than 2, each having at least the corresponding number of drivers, including a tweeter, with its negative terminal connected to a negative terminal of a power supply, with the right hand N-way loudspeaker having at least an asymmetric effective even order crossover applied at a crossover frequency near the baffle step frequency and the left hand N-way loudspeaker having at least a symmetric effective crossover of the same even order as the right hand N-way loudspeaker applied at a crossover frequency near the baffle step frequency; the right hand N-way loudspeaker and left hand N-way loudspeaker preferably having, but not limited to, $1^{st}$ order electrical crossovers applied at remaining crossover frequencies;

at least one of the right hand and left hand N-way loudspeakers optionally having at least one of the following:

(a) a Zobel circuit applied to one or both woofer(s) in either of the N-way loudspeakers;

(b) notch filters, twister circuits or circuits to correct the baffle step applied;

(c) Thevenin equivalences; or (d) any combinations thereof.

21. The method of improving sound reproduction as claimed in claim 1, further comprising virtually phase-unifying an effective fourth-, sixth-, eight-, tenth-, or higher even-numbered order crossover for a right hand and a left hand N-way loudspeaker where N is an integer greater than 2, each having at least the corresponding number of drivers, including a tweeter, with its negative terminal connected to a positive terminal of a power supply, with the right hand N-way loudspeaker having at least a symmetric effective even order crossover applied at a crossover frequency near the baffle step frequency and the left hand N-way loudspeaker having at least an asymmetric effective crossover of the same even order as the right hand N-way loudspeaker applied at a crossover frequency near the baffle step frequency; the right hand and left hand N-way loudspeakers preferably having, but not limited to, $1^{st}$ order electrical crossovers applied at remaining crossover frequencies;

at least one of the right hand and left hand N-way loudspeakers optionally having at least one of the following:

(a) a Zobel circuit applied to one or both woofer(s) in either of the N-way loudspeakers;

(b) notch filters, twister circuits or circuits to correct the baffle step applied;

(c) Thevenin equivalences; or (d) any combinations thereof.

22. The method of improving sound reproduction as claimed in claim 1, further comprising virtually phase-unifying an effective third-, fifth-, seventh-, ninth-, eleventh-, or higher odd-numbered order crossover for a right hand and a left hand N.5-way loudspeaker where N is an integer greater than 1, each having at least the corresponding number of drivers, including a tweeter, and a negative terminal of the tweeter connected to a negative terminal of a power supply, with the output of the woofer(s) for a given right hand or left hand N.5-way loudspeaker about 12 dB below the driver(s) that manifest(s) the baffle-step at the phase-unification frequency for that loudspeaker unless the woofer(s) manifest(s) the baffle-step, but otherwise with the right hand N.5-way loudspeaker having at least a symmetric effective odd order crossover applied at a crossover frequency near the baffle step frequency and the left hand N.5-way loudspeaker having at least an asymmetric effective crossover of the same odd order as the right hand N.5-way loudspeaker applied at a crossover frequency near the baffle step frequency; the right hand and left hand N.5-way loudspeakers preferably having, but not limited to, $1^{st}$ order electrical crossovers applied at remaining crossover frequencies;

at least one of the right hand and left hand N.5-way loudspeakers optionally having at least one of the following:

(a) a Zobel circuit applied to one or more woofer(s), midwoofer(s) or midrange(s), whichever manifests the baffle step, in either of the N.5-way loudspeakers;

(b) notch filters, twister circuits or circuits to correct the baffle step applied;

(c) Thevenin equivalences; or (d) any combinations thereof.

23. The method of improving sound reproduction as claimed in claim 1, further comprising virtually phase-unifying an effective third-, fifth, seventh-, ninth-, eleventh-, or higher odd-numbered order crossover for a right hand and a left hand N.5-way loudspeaker where N is an integer greater than 1, each having at least the corresponding number of drivers, including a tweeter, and a negative terminal of the tweeter connected to a positive terminal of a power supply, with the output of the woofer(s) for a given right hand or left hand N.5-way loudspeaker about 12 dB below the driver(s) that manifest(s) the baffle-step at the phase-unification frequency for that loudspeaker unless the woofer(s) manifest(s) the baffle-step, but otherwise with the right hand N.5-way loudspeaker having at least an asymmetric effective odd order crossover applied at a crossover frequency near the baffle step frequency and the left hand N.5-way loudspeaker having at least a symmetric effective crossover of the same odd order as the right hand N.5-way loudspeaker applied at a crossover frequency near the baffle step frequency; the right hand and left hand N.5-way loudspeakers preferably having, but not limited to, $1^{st}$ order electrical crossovers applied at remaining crossover frequencies;

at least one of the right hand and left hand N.5-way loudspeakers optionally having at least one of the following:

(a) a Zobel circuit applied to one or more woofer(s), midwoofer(s) or midrange(s), whichever manifests the baffle step, in either of the N.5-way loudspeakers;

(b) notch filters, twister circuits or circuits to correct the baffle step applied;

(c) Thevenin equivalences; or (d) any combinations thereof.

24. The method of improving sound reproduction as claimed in claim 1, further comprising virtually phase-unifying an effective fourth-, sixth-, eighth-, tenth-, or higher even-numbered order crossover for a right hand and left hand N.5-way loudspeaker where N is integer greater than 1, each having at least the corresponding number of drivers, including a tweeter, and a negative terminal of the tweeter connected to a negative terminal of a power supply, with the output of the woofer(s) for a given right hand or left hand N.5-way loudspeaker about 12 dB below the driver(s) that manifest(s) the baffle-step at the phase-unification frequency for that loudspeaker unless the woofer(s) manifest(s) the baffle-step, but otherwise with the right hand N.5-way loudspeaker having at least an asymmetric effective even order crossover applied at a crossover frequency near the baffle step frequency and the left hand N.5-way loudspeaker having at least a symmetric effective crossover of the same even order as the right hand N.5-way loudspeaker applied at a crossover frequency near the baffle step frequency; the right hand and left hand N.5-way loudspeakers having, but not limited to, $1^{st}$ order electrical crossovers applied at remaining crossover frequencies;

at least one of the right and left hand N.5-way loudspeakers optionally having at least one of the following:

(a) a Zobel circuit applied to one or more woofer(s), midwoofer(s) or midrange(s), whichever manifests the baffle step, in either of the N.5-way loudspeakers;

(b) notch filters, twister circuits or circuits to correct the baffle step applied;

(c) Thevenin equivalences; or (d) any combinations thereof.

25. The method of improving sound reproduction as claimed in claim 1, further comprising virtually phase-unifying an effective fourth-, sixth-, eight-, tenth-, or higher even-numbered order crossover for a right hand and a left hand N.5-way loudspeaker where N is an integer greater than 1, each having at least the corresponding number of drivers, including a tweeter, and the negative terminal of the tweeter connected to the positive terminal of the power supply, with the output of the woofer(s) for a given right hand or left hand N.5-way loudspeaker about 12 dB below the driver(s) that manifest(s) the baffle-step at the phase-unification frequency for that loudspeaker unless the woofer(s) manifest(s) the baffle-step, but otherwise with the right hand N.5-way loudspeaker having at least a symmetric effective even order crossover applied at a crossover frequency near the baffle step frequency and the left hand N.5-way loudspeaker having at least an asymmetric effective crossover of the same even order as the right hand N.5-way loudspeaker applied at a crossover frequency near the baffle step frequency; the right hand and left hand N.5-way loudspeakers having, but not limited to, $1^{st}$ order electrical crossovers applied at the remaining crossover frequencies;

at least one of the right and left N.5-way loudspeakers optionally having at least one of the following:

(a) a Zobel circuit applied to one or more woofer(s), midwoofer(s) or midrange(s), whichever manifests the baffle step, in either of the N.5-way loudspeakers;

(b) notch filters, twister circuits or circuits to correct the baffle step applied;

(c) Thevenin equivalences; or (d) any combinations thereof.

* * * * *